US008794291B2

(12) United States Patent
Boehler et al.

(10) Patent No.: US 8,794,291 B2
(45) Date of Patent: Aug. 5, 2014

(54) ADHESIVE TAPE STAMP AND METHOD FOR STAMPING AN ADHESIVE TAPE SECTION ONTO AN OBJECT

(75) Inventors: Christoph Boehler, Fuerth (DE); Dieter Lessig, Kassel (DE)

(73) Assignee: Boehler GmbH, Fuerth (DE)

( * ) Notice: Subject to any disclaimer, the term of this patent is extended or adjusted under 35 U.S.C. 154(b) by 334 days.

(21) Appl. No.: 12/531,989

(22) PCT Filed: Mar. 18, 2008

(86) PCT No.: PCT/EP2008/002127

§ 371 (c)(1),
(2), (4) Date: Sep. 18, 2009

(87) PCT Pub. No.: WO2008/113548

PCT Pub. Date: Sep. 25, 2008

(65) Prior Publication Data

US 2010/0108250 A1 May 6, 2010

(30) Foreign Application Priority Data

Mar. 21, 2007 (DE) ..... 10 2007 014 055

(51) Int. Cl.

| | |
|---|---|
| ***B29C 65/00*** | (2006.01) |
| ***B32B 37/00*** | (2006.01) |
| ***B32B 38/04*** | (2006.01) |
| ***B32B 38/10*** | (2006.01) |

(52) U.S. Cl.
USPC ..... 156/523; 156/577; 225/39; 225/77; 225/84; 206/411

(58) Field of Classification Search
USPC ..... 156/523, 577, 256; 225/39, 55, 77, 84; 242/588.3, 590, 601; 206/411
See application file for complete search history.

(56) References Cited

U.S. PATENT DOCUMENTS

| | | | | |
|---|---|---|---|---|
| 2,606,682 | A * | 8/1952 | Cutter | 156/523 |
| 5,326,421 | A * | 7/1994 | Taylor | 156/526 |

FOREIGN PATENT DOCUMENTS

| | | | |
|---|---|---|---|
| DE | 15 11 481 | | 7/1969 |
| DE | 1511481 | A1 | 7/1969 |
| JP | 53 141736 | | 12/1978 |
| JP | 53141736 | A | 12/1978 |
| JP | 58-166547 | | 11/1983 |
| JP | 01 048774 | A | 2/1989 |
| WO | 93/04969 | A | 3/1993 |
| WO | 9304969 | A1 | 3/1993 |

* cited by examiner

*Primary Examiner* — Linda L. Gray
(74) *Attorney, Agent, or Firm* — Lucas & Mercanti, LLP

(57) ABSTRACT

The invention is based on the aim of providing a novel office tool, and a corresponding method, wherein various application advantages of known office tools are combined. The invention provides an adhesive tape stamp 1 that is configured to implement a course of movement, wherein an adhesive tape section having a defined length is pressed onto an object in a stamping device, having a separating device 12, which is configured and/or disposed in order to separate an adhesive tape end as the adhesive tape section 23 from a continuous adhesive tape 19 at a separation point 22, and having a stamping device 11, wherein the stamping device 11 is configured and/or disposed to press the adhesive tape end and/or the adhesive tape section 23 onto the object in the stamping direction 4.

14 Claims, 43 Drawing Sheets

Figure 2:
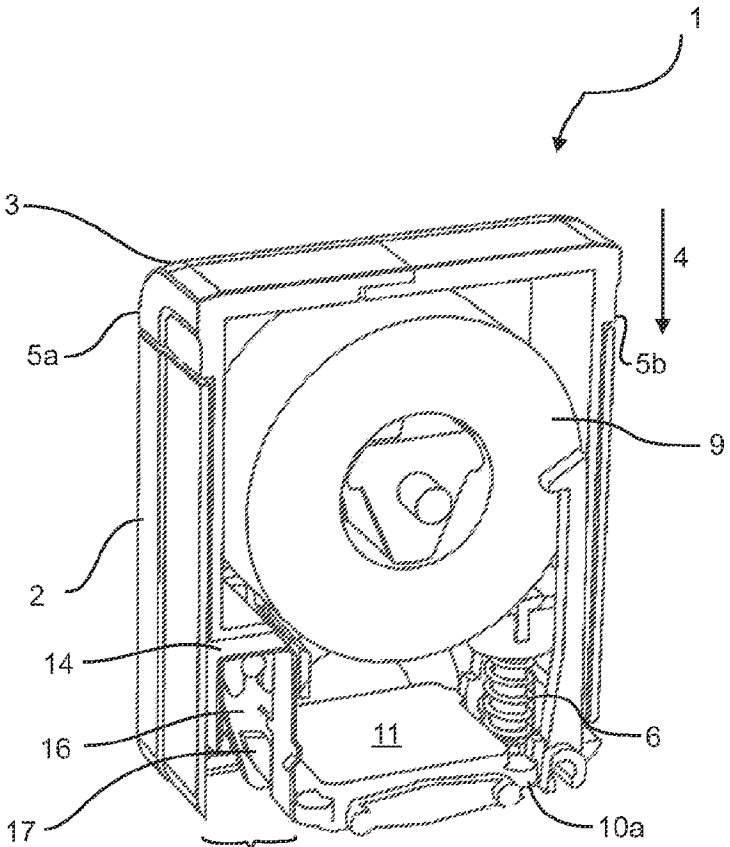

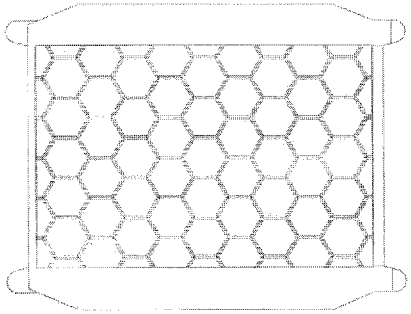
Fig. 71
Fig. 72
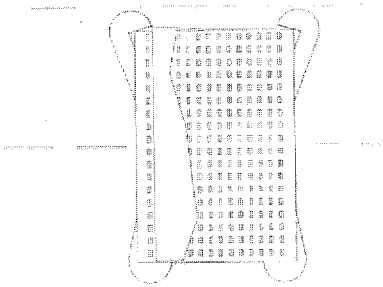
Fig. 73
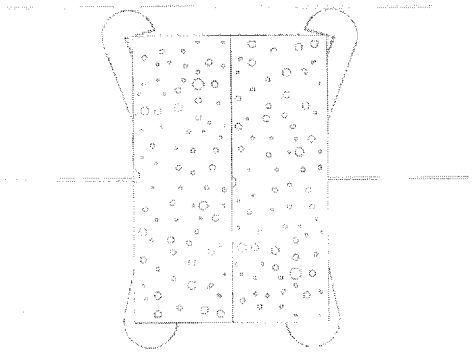
Fig. 74
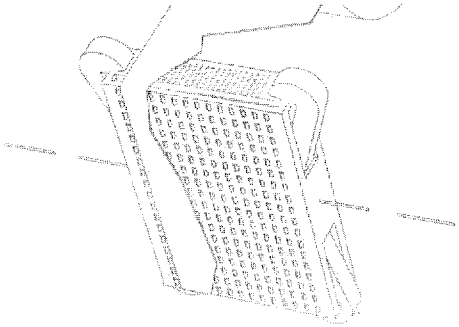
Fig. 75

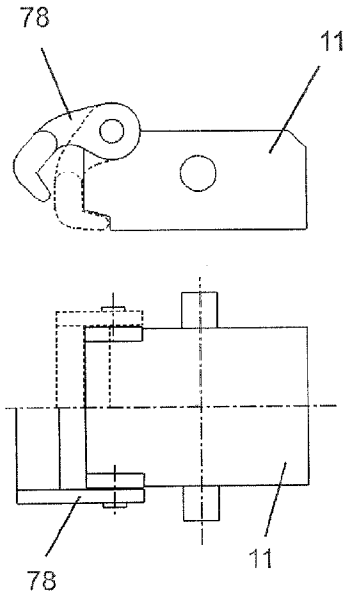
Fig. 78a
Fig. 78b
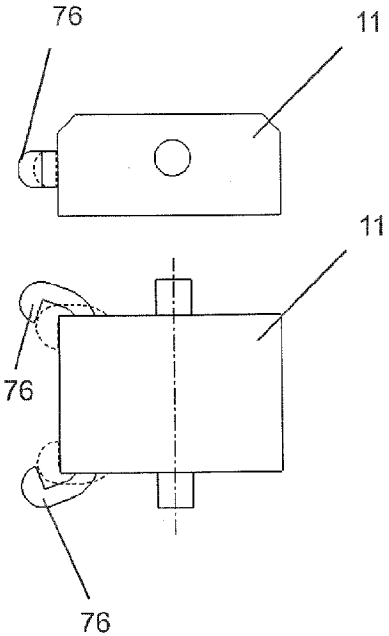
Fig. 77a
Fig. 77b
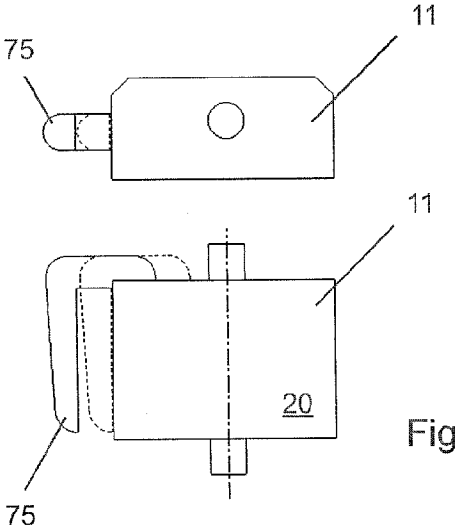
Fig. 76a
Fig. 76b

ADHESIVE TAPE STAMP AND METHOD FOR STAMPING AN ADHESIVE TAPE SECTION ONTO AN OBJECT

CROSS REFERENCE AND INCORPORATION BY REFERENCE

This application is a 371 of PCT/EP2008/002127 filed Mar. 18, 2008, which in turn claims the priority of DE 10 2007 014 055.1 filed Mar. 21, 2007, the priority of both applications is hereby claimed and both applications are incorporated by reference herein.

The invention relates to an adhesive tape stamp and, in particular, to an adhesive tape stamp, which is constructed for pressing an adhesive tape section of defined length in a stamping direction on an object, as well as to a method for stamping on an adhesive tape section.

A large number of helpful devices exist, which are used regularly, every day, in the office for joining two objects together. For example, on almost every desk there is a stapler, which connects two sheets of paper or the like together with a staple or the like, so that they cannot be lost. For most designs of the stapler, the two sheets of paper are placed on top of one another and pushed into a receptacle. By actuating the stapler mechanically in the stapling direction, a staple is driven through the papers and deformed on the reverse side, so that it can only be removed from the papers now by being destroyed.

A different possibility for joining two sheets of paper together consists of the use of adhesive tapes. These adhesive tapes generally are mostly transparent and wound on a roll. Since it is expensive to cut off a suitable length of the adhesive tape by means of scissors and then to glue the cut-off section of adhesive tape onto the papers, unrolling devices are frequently used, which have a storage device for the roll of adhesive tape as well as a cutting device, so that the adhesive tape can be pulled out in a simplified manner to the desired length and severed by the cutting device.

Furthermore, gluing devices are known, which have a roll with a transfer tape, on which a detachable adhesive film is disposed and brought by a transfer movement onto the adhesion partner. After the adhesive film is applied, the second adhesion partner is then pressed onto the adhesion site.

For example, the WO 93/04969 publication shows a gluing device with such a transfer tape, on which a detachable adhesive film is disposed. An adhesive film section of defined length is pressed or stamped onto the adhesion partner by a cumbersome mechanism.

It is an object of the invention to propose a novel office device or handling device as well as a corresponding method, wherein different use advantages of known office devices or application devices are combined.

This objective is accomplished by an adhesive tape stamp as described below and by a method as described below for stamping an adhesive tape section on an object. Preferred or advantageous embodiments of the invention are described in the specification below and the attached Figures.

According to the invention, an adhesive tape stamp, especially an adhesive tape applicator, for example, in the form of a tabletop device for the office desk, is the proposed in order to convert, particularly a manual actuation of the adhesive tape stamp into a sequence of motions, which, in particular, take place automatically and during which a section of adhesive tape of defined length is pressed onto an object in a stamping direction.

In particular, a manually operated, mobile device for applying adhesive tape sections of a pressure-sensitive adhesive tape is introduced. Preferably, a pressure-sensitive adhesive tape is used which does not have any geometric specifications or help for transferring the conveying forces, such as perforations, before or during the sequence of movements. The conveying forces are transferred preferably by the adhesive tape itself and, moreover, especially without a liner, which otherwise remains in the device unused as an aid/waste and, in the case of other embodiments from the prior art, takes over the task of conveying and/or isolating the adhesive forces.

For a particularly preferred embodiment of the invention, the adhesive tape stamp is constructed for immobilizing the endless adhesive tape by clamping it nondestructively during the course of the movements and particularly for the course of the application. Preferably, by the clamping immobilization, a frictional or positive fixing of the endless adhesive tape is realized for the purpose of guiding and/or introducing a tensile force and/or of positioning. Preferably, the adhesive tape stamp is constructed as a manually operated and/or a mobile device, for which the conveying of the adhesive tape by clamping is carried out in a movable holding and clamping device. As will still be explained below by means of a preferred embodiment and/or examples, the clamping preferably takes place at a stamp plate or, separately from the stamp plate, at the housing of the adhesive tape stamp or at a separate conveying device.

In the case of a possible further development of the invention, the stamping device comprises a holding device, which is constructed for the preferred clamping immobilization of the endless adhesive tape, particularly at its free end and/or at or in the region of the severing site relative to the stamping device. Preferably, the holding device of this further development is moved with the stamping device during the course of the movement, particularly during a lifting movement.

For a different further development of the invention, the adhesive tape stamp comprises a holding device, which acts together with the stamping device for the clamping immobilization of the endless adhesive tape.

This further development relates to immobilizations, for which at least sections of the holding device are mounted independently of the stamping device.

For a third, possible further development of the invention, the adhesive tape stamp comprises a holding device, which is constructed for the clamping immobilization of the endless adhesive tape and is mounted and/or disposed independently of the stamping device.

In a different, possible representation of the further developments, the holding device comprises two clamping partners, which form a pair of clamping partners, which jointly immobilize the endless tape, wherein, in accordance with the third further development no, in accordance with the second further development precisely one and in accordance with the first further development both of these clamping partners are hinged and/or mounted at the stamping device. In the case of an optimum embodiment, the adhesive tape stamp may comprise one, two or more clamping partner pairs.

Particularly in the case of a manual actuation, the actuating direction preferably corresponds to the stamp direction. The manual actuation may also take place in a different direction and is diverted into the stamp direction. In particular, the manual actuation is converted exclusively mechanically and/or does not require external energy, for example, over a transmission. Alternatively, the adhesive tape stamp may also be actuated for this purpose with external energy, especially electrical, pneumatic or hydraulic energy.

The adhesive tape section has a defined length, preferably of up to 3 cm, particularly of up to 5 cm and especially of up to 7 cm. The adhesive tape section is pressed onto the object with its longitudinal extent particularly perpendicular or essentially perpendicular to the direction of the stamp. The pressure is applied optionally by a rolling motion, the adhesive tape section initially being placed with a first end on the object and then pressed over its whole length onto the object. Preferably, however, the adhesive tape section is pressed onto the object at the same time over its whole length. The object may be realized in any way, for example, as two sheets of paper, which are disposed offset to one another and are to be connected to one another with the adhesive tape section.

The adhesive tape stamp has a severing device, which is actuated within the limitations of the course of movements and is constructed to sever an adhesive tape end completely from the endless adhesive tape at a severing site as the adhesive tape section. The adhesive tape end to be severed accordingly correspondence in length to the adhesive tape section, the severing site extending preferably perpendicularly to the longitudinal extent of the endless adhesive tape. The endless adhesive tape is made available, for example, as a roll of adhesive tape, on which, in particular, several meters of endless adhesive tape are rolled, and preferably is constructed as a transparent or translucent adhesive tape, coated on one side with adhesive. In particular, it has no perforations and/or can be severed in any desired length. For alternative embodiments of the invention, the endless adhesive tape is constructed as a label tape. It is also possible that the endless adhesive tape has markings or safety features, such as holograms, silver strips, haptic features or the like and can be used, for example, as a sealing tape. Optionally, the adhesive tape has regularly spaced recesses, preferably holes, particularly elongated holes, which are aligned particularly in the longitudinal extent of the endless adhesive tape and separate sections of the endless adhesive tape from one another. The sections may be in the form of labels, finished symbols or decorations, or also of official stamps, particularly postage stamps, or seals.

Furthermore, the adhesive tape stamp comprises a stamping device, which is also moved within the confines of the course of movements, for pressing and/or stamping the adhesive tape end and/or the adhesive tape section in the direction of the stamp onto the object. In addition, aside from the adhesive tape stamp, a or the stamping device is also disclosed as an independent object of the invention.

Preferably, the stamping device is constructed and/or disposed in order to carry out a superimposed rotational-linear movement, and the adhesive tape end is positioned in conformity with the severing and particularly suitable for the severing relative to or in the severing device and the adhesive tape end and/or the adhesive tape section is pressed and/or stamped onto the object in the stamp direction.

Preferably, the stamping device is formed and/or disposed, so that endless adhesive tape is unrolled during the rotational/linear movement from a supply of endless adhesive tape, especially from a roll of adhesive tape.

Accordingly, the stamping device preferably is constructed in order to pass the adhesive tape end and/or the adhesive tape section by means of the rotational-linear movement into a severing position and into a press-on position. Preferably, the linear portion of the rotational-linear movement is carried out parallel to the stamp direction and/or to the actuation direction.

In this connection, the invention is based on the consideration that adhesive tapes, as connecting material, admittedly have clear use advantages over staples or over transfer tapes transferring adhesive regions; however, they also have disadvantages when employed in every day use. For example, the adhesive tapes typically are unrolled from holding devices, severed at a stationary blade, picked up by hand and applied manually on the workpiece, a complex process, which requires a pronounced precision motoricity. Other handling devices place the adhesive tape on the workpiece, unroll an undefined length of the tape and sever this by a tilting motion. This unrolling motion typically results in stresses between the workpiece and the adhesive strip, particularly in the longitudinal axis of the adhesive tape. In addition, the adhesive tape is stretched because of the tensile forces and then applied in the stretched state. In the worst case, such as in the case of thin materials (paper, films), the restoring forces resulting from these stresses and strains, acting on the workpiece, lead to the folds and creases.

On the other hand, the inventive adhesive tape stamp, because it may be operated with one hand, is very convenient to work with and, because of the mechanism, has a high repetition accuracy. Moreover, because of the automation of the application of the adhesive tape section, a very high working speed can be achieved. Because of the refined mechanism of the adhesive tape stamp, the latter is handled easily, so that little is demanded of the precision motoricity of the user. Since the adhesive tape section is pressed onto the object in or essentially in the direction of the stamp, it is applied stress-free or essentially stress-free on the object, so that interfering restoring forces do not arise.

For a preferred embodiment of the invention, the stamping device is disposed and/or constructed so that it carries out an endless rotation over several stamping processes. With that, it becomes possible that the stamping device rotates in the same direction during the stamping processes; this leads, for instance, to a simplification of the guidance of the endless adhesive tape in the adhesive tape stamp.

For a preferred embodiment, the stamping device is constructed and/or disposed to carry out a reversing and inverting course of movements, during which the movement of the stamping device from a position of rest to the stamping position and the path of the stamping device to the position of rest always take place on the same path optionally with the same rotations and/or the same turning movements. Alternatively, the stamping device is constructed and/or disposed for carrying out an oscillating course of movements, in the simplest case, a simple linear movement from the position of rest to the stamping position and a further linear movement on the return path.

For a possible, simple embodiment, the stamping device has precisely one stamp surface. This embodiment is particularly preferred when the stamping device carries out a reversing and/or oscillating course of movements and/or if the holding device comprises precisely one pair of clamping partners.

For a practical, structural conversion, the stamping device has at least two stamp surfaces, which can be pressed onto the object alternately and/or sequentially one after the other, For example, the stamping device comprises an element, which is constructed as a regular triangle, quadrangle, pentagon or polygon and, accordingly, has three, four, five etc. stamp surfaces. For consecutive stamping processes, the stamp surfaces preferably are used consecutively. For modified embodiments, the stamping surfaces can also be constructed differently, for example, so that the element is advanced by two or more stamp surfaces per stamping process.

For a preferred conversion, a holder, which immobilizes the endless adhesive tape at the free end thereof and/or at or in the region of the severing site relative to the stamping device, is assigned to the latter.

During the linear-rotational movement, this holder enables the end of the adhesive tape to be carried along by the stamping device and endless adhesive tape to be pulled from a supply of endless adhesive tape, such as a roll. In addition, the holder enables the endless adhesive tape to be held at or in the region of the severing site, that is, in the closer vicinity thereof, for the severing process.

In the case of a structurally advantageous embodiment, the stamping device comprises a stamp plate, which has a stamp surface on each of the two upper sides. When the end of the adhesive tape and/or an adhesive tapes section is pressed onto the object, the stamp surfaces are used alternately.

For a preferred further development, a clamping device, which immobilizes the endless adhesive tape at the free end thereof or at or in the region of the severing site and, accordingly, forms the holder, is formed at the end and/or at the front of the stamp plate. Preferably, the immobilization is accomplished in that the clamping devices or sections thereof are pressed onto the front sides of the stamp plate. In the open state, the clamping device preferably forms an open, unbounded passage region, through which the adhesive tape can be passed over the whole of its width or at least approximately the whole of the width.

In the case of a practical embodiment, the two clamping devices are coupled mechanically to one another so that they open and close alternately. This further development enables first of all the free end of the endless adhesive tape to be taken hold of by a first clamping device and the endless adhesive tape to be unrolled from the supply of endless adhesive tape during the linear-rotational movement and, after it has been placed at least sectionally on the object, to be released. At the same time, at the other front side of the stamp plate, the second clamping device immobilizes the endless adhesive tape at the severing site, after which the endless adhesive tape is severed at the severing site by the severing device, the severed adhesive tape section being released with respect to the adhesive tape stamp.

It is particularly preferred if the holder or the clamping devices are disposed and/or constructed to be self-locking and/or self-holding, the stamping device being constructed so that it can be switched over between the immobilization of the endless adhesive tape at the free end thereof and in the region of the severing site.

For a different, possible embodiment of the invention, the end of the stamp plate has a clamping surface. In the case of a preferred embodiment, the clamping surface has a rounded or semicircular cross section. Together with at least one clamping organ, especially a clamping lever, which is mounted and/or hinged independently of the stamp plate, especially in the housing of the adhesive tape stamp, the clamping surface makes possible the clamping immobilization of the endless adhesive tape. In the case of this embodiment, the stamp plate or the clamping organ disposed at the stamping device, engages the end clamping surface, preferably the front clamping surface, so that the clamping surface and the clamping organ jointly form the holder.

For an alternate embodiment, the stamping device and/or the stamp plate has a clamping device and/or a clamping organ and clamping surface unit and/or a clamping function element only at one end as the holder, which immobilizes the endless adhesive tape at the end and/or at the front side of the stamping device.

For a different embodiment variation, the holder is constructed as a clamping device, which, during the course of the movement, moves relative to the stamping device. In particular, the holder is mounted and/or hinged independently of the stamping device in the adhesive tape stamp or the housing of the adhesive tape stamp.

For a preferred embodiment alternative, the direction of movement of the clamping device during the course of the movement is perpendicular or essentially perpendicular to the direction of movement of the stamping device or of the linear portion of the stamping device.

For a different, further embodiment variation, the adhesive tape stamp has a dispenser, which is constructed to arch the endless tape rigidly in the longitudinal direction and to supply it to the stamping device. This embodiment is based on the idea of configuring or forming a free end of the endless adhesive tape rigidly along the advancing direction so that, preferably without further holding devices and/or as a free end, it can be positioned under the stamping device. In the further course of motions, the rigid end section of the endless adhesive tape is then applied on the object by the stamping device.

For a preferred embodiment, the dispenser has an interacting pair of rolls, which are constructed concavely or convexly in the longitudinal section, in order to achieve an arch-shaped deformation in the cross-section of the endless adhesive tape. Preferably, at least one roll of the pair of rolls has a lamellar construction, the individual lamellas being able to rotate independently of one another. It is likewise preferred if the dispenser comprises at least three rolls in order to transport and/or divert the endless adhesive tape jointly.

In addition to the holder, a synchronization device may be provided at the stamping device and interact with synchronization means on the endless adhesive tape. Using the synchronization device, it is possible to stamp location-defined sections of the endless adhesive tape on objects. Such location defined sections may carry, for example, graphic representations of decorations, objects, labels or the like, which are meaningful only if they are stamped on completely. For example, value stamps, particularly postage stamps, may be separated from one another by the synchronization means. In the case of a preferred structural conversion, the synchronization device is constructed as one or more pegs, which preferably engage synchronization means of the endless adhesive tape, constructed as elongated holes. Preferably, the peg and/or the synchronization means are disposed on the front face of the stamp plate and, moreover, in the direction of rotation, especially in front of the holder and/or the severing site.

For a preferred structural conversion, the adhesive tape stamp has a housing, which comprises a resting part, which rests on the object, and an actuating part, which can move linearly to the resting part for actuating the adhesive tape stamp. In particular, in this embodiment, the adhesive tape stamp forms a table top handling device, which especially may be operated with one hand. The actuating part of the housing, preferably is pushed into the resting part and is secured by means of a locking device, which is constructed, for example, as hook elements, to prevent it falling out unintentionally. Preferably, the supply of endless adhesive tape, especially the roll of endless adhesive tape, is stored in the actuating part of the housing.

To make it easier to exchange the supply of endless adhesive tape, the actuating part of the housing and the resting part of the housing are constructed so that they can be swiveled open and or separated. Optionally, the resting part of the housing is constructed in one part and the actuating part of the housing is constructed in two parts.

For a different, preferred embodiment, the actuating part of the housing embraces and overlaps the resting part of the housing especially completely and/or lid-like and covers it telescopically. This embodiment may optionally also be referred to as an upside-down arrangement of the housing parts. For this embodiment, it is possible that the actuating part of the housing is constructed as one part and/or overlaps the resting part of the housing. For this preferred construction, the actuating part of the housing at the same time is the operating element and the adhesive tape stamp at the actuating part of the housing may be held enclosed by the hand. For example, the front side offers a supporting surface for the thumb and the opposite, rear side offers the counter-surface for the index, middle and small finger for holding the adhesive tape stamp by hand. The hand may remain in the position described during the actuation of the adhesive tape stamp, since the actuating surfaces remain uncovered during the course of movement. This embodiment once again supports the endeavor to configure the adhesive tape stamp, so that it may be operated with one hand.

In the case of a preferred further development of the housing, the latter is to be opened for the insertion of the endless adhesive tape or the supply of such tape. In the open state, the housing parts, especially the actuating part of the housing and the resting part of the housing form a mechanical chain with one another and/or are connected with one another so that they cannot be lost.

For a specific embodiment, the actuating part of the housing, which at the same time is the carrier for the endless adhesive tape, or the supply of such tape, is pulled out of the resting part of the housing initially in a linear motion and then tilted to the side over a swivel joint. Preferably, the movable parts of the housing are not separated from one another in order to retain their orientation to one another and to make it easier to assemble them. The now exposed components enable the endless adhesive tape or the supply of endless tapes and the start of the tape to be inserted easily, The adhesive tape stamp is closed in the reverse sequence.

The locking between the actuating part of the housing and resting part of housing may be accomplished, for example, by means of two elements or by overcoming a pressure point.

For a preferred structural realization, the stamping device and the endless adhesive tape device are disposed flush in the actuating device and/or stamping device. Alternatively, the stamping device is located in a space projected perpendicularly by the adhesive tape roll onto the substratum. This embodiment enables great the adhesive tape stamp to be constructed very compactly. Aside from an accurate, symmetrical arrangement of the endless adhesive tape device and the stamping device, a partial overlapping of these two components in said projection direction is also possible. Any control elements for the stamping device, etc. preferably lie next to the roll, in order not to form a collision contour for the roll producing the course of movement.

In a further development of the structural embodiment, the stamping device is supported in the actuating part of the housing, so that the stamping device carries out a linear motion in the direction of the stamp during the actuation of the adhesive tape stamp. In addition, it is preferred if the stamping device is supported rotatably in the actuating part of the housing and, at the same time, engages a forced guidance in the resting part of the housing. The forced guidance and/or the stamping device is/are constructed so that a rotational movement is superimposed on the linear movement of the stamping device during the actuation of the adhesive tape stamp in the stamp direction by the forced guidance.

For a preferred embodiment, the forced guidance is constructed as a connecting link guide, which has, for example, grooves, which are open to the stamp device for guiding the latter. Preferably, for this embodiment, the stamp plate has at least one fork device, which is disposed laterally with two guide bolts, which engage the connecting link guide, by which they are guided. In order to increase the operational reliability, bilateral connecting link guides are preferably disposed in the resting part of the housing and bilaterally disposed fork guides are disposed in the stamping device or stamp plate.

For a different embodiment of the forced guide, the rotation of the stamping device is produced by a gear wheel segment of simplified construction, which is disposed torque-proof on the axis of rotation of the stamping device and which engages a contour piece, mounted on the resting part of the housing, or rolls thereon and transfers this rotation to the stamping device. This form of forced guidance may also be disposed on both sides of the stamping device.

For a skillfully constructed configuration of the invention, control elements, such as change-over wedges are especially integrally molded in the resting part of the housing. They are constructed and/or disposed for controlling the clamp devices, which are coupled mechanically to one another, the clamping organ, the clamping device and/or the dispensing device. Preferably, during the linear-rotational movement, the control elements are contacted by the clamping devices in order to scan them. In particular, the control is constructed so that the clamping devices are constructed in each case as a pair of clamps, which embrace the corner regions of the stamp plate and, by a swiveling motion in one plane parallel or essentially parallel to the stamp surfaces, are pressed against the front side of the stamp plate in order to fix the adhesive tape, the swiveling being brought about by the control elements.

For a preferred constructive conversion, the clamps of a longitudinal side of the stamp plate are rigidly connected with one another and can be swiveled in a rocker fashion relative to the longitudinal side of the stamp plate. In order to support the swiveling motion, the pair of clamps of a longitudinal side, which are coupled rigidly to one another, are mounted elastically and rigidly connected with one another so that they are pressed to the outside and/or pre-tensioned. This elastic mounting can be brought about, for example, over separate elastic elements or over a common elastic element, which supports the two pairs of clamps against one another. For a first, possible, alternative embodiment, the elastic element is constructed as a spring element, especially as a spiral spring element. For a second possible alternative embodiment, the pairs of clamps have elastic overmoldings, which can be coupled to one another.

Preferably, the separating device is constructed so that it is cocked in the stamp direction by the manual actuation especially of the actuating part of the housing and triggered at the lower dead point or in the region of the lower dead point of the rotational-linear movement. This construction provides the user with a pleasant sensation when, after moving the actuating part of the housing completely into the resting part of the housing, the separating device releases the deposited and/or impressed and/or stamped-on adhesive tape section with an audible and palpable beating.

The separating device has a blade, which preferably is constructed so that, for carrying at the separating movement, it is moved essentially vertically to the stamp direction. In particular, the stamping device and separating device are disposed so that the blade strikes a side surface of the stamping device and/or a front side of the stamp plate during the separation.

For a possible realization of the adhesive tape stamp, the endless adhesive tape is constructed as a double-sided adhesive tape, which has a coating of adhesive on both sides. Such two-sided adhesive tapes or pressure-sensitive adhesive tapes are used, for example, for being positioned between two adhesion partners and differ from transfer tapes owing to the fact that a tape-like support remains between the layers of adhesive or between the adhesion partners. Here also, a section of adhesive tape is applied, the double-sided adhesive tape having an additional transfer tape. The advantages of this embodiment are obvious; for example, it is possible to immobilize two adhesion partners congruently.

For a preferred embodiment of the invention, a or the stamp surface and/or further contact surfaces of the adhesive tape, especially of the double-sided adhesive tape with the adhesive tape stamp as surface or surfaces, is/are constructed with adhesion-reducing properties.

Such an adhesion-reducing property, can be achieved, for example, by the surface of an adhesion-reducing coating or boundary coating. Adhesion-reducing coatings consist, for example, of the materials polytetrafluoroethylene, polytetrafluoroethene (Teflon) or similar adhesive coatings. Preferably, these adhesion-reducing materials have surface energies lower than 34 mN/m and especially lower than 20 mN/m.

Furthermore, it is optionally possible to apply fine structures, especially in the micrometer range, in the surface in order to strengthen the adhesion-reducing property. Examples of such adhesion-reducing surface structures are given by the lotus surfaces. For further embodiments, the adhesion-reducing properties are produced by means of adhesion-reducing structures, especially by coarse structures, which have only a slight contact area with the adhesive tape, from which a release force results, which is lower than that of a full contact surface. For example, the contact surface of the tape corresponds only to about 3% to 15% of the base surface of the stamp.

Further possibilities for achieving adhesion-reducing properties are surface patterns, which require lower detachment forces due to their geometry.

For a preferred further development of the invention, the surfaces are constructed so that the adhesive-reducing property decreases from an edge region to a central region of the surface. This has the advantage that a low peeling tension is achieved especially in the edge region and, by thinning out the relief pattern and/or by forming especially arrow-like points, the detachment process commences with a lower force and a higher notch effect.

A further object of the invention relates to a method with the distinguishing features of claim 44 for stamping an adhesive tape section on an object by means of an adhesive tapes stamp, which is to be actuated manually, and is constructed preferably as described just now or as in one of the preceding claims.

For the method claimed, the adhesive tapes stamp, which is constructed particularly to be operated with one hand, is positioned on the object and, by the mechanical actuating of the adhesive tape stamp, a course of motions is carried out particularly in the direction of the stamp and the free end of the endless adhesive tape initially is immobilized at a or the stamping device or independently thereof by means of the holding device. This situation accordingly forms the starting position of the adhesive tape stamp. By actuating the adhesive tape stamp in the direction of the stamp, the stamping device is then guided in the stamping direction, for example, with a superimposed linear-rotation movement about its own axis. At the same time, because of the immobilization of the free end of the endless adhesive tape, the endless adhesive tape is pulled from a supply of endless tape and, in the further course, an adhesive tape end of the endless adhesive tape is deposited and/or pressed and/or stamped onto the object. With or during the deposition of the end of the adhesive tape on the object, on the one hand, the free end of the adhesive tape is released and the endless adhesive tape is immobilized or stretched in the region of a severing site at the stamping device. After and/or with the deposition of the end of the adhesive tape on the object, the endless adhesive tape is severed at the severing site so that, on the one hand, an endless tape section is released on the object and, on the other, the endless tape, immobilized or stretched in the region of the severing site, now forms the new free end of the endless adhesive tape. In the further course, especially after the release of the adhesive tape stamp, the stamping device is returned over a restoring mechanism, especially a spring mechanism, into the starting position optionally by way of a second, superimposed linear-rotational movement, which has the same direction of rotation as the first superimposed linear-rotational movement. Preferably, after the stamping process, the stamping device returns into the starting position; however, it may be rotated by 180°.

Figure 7:
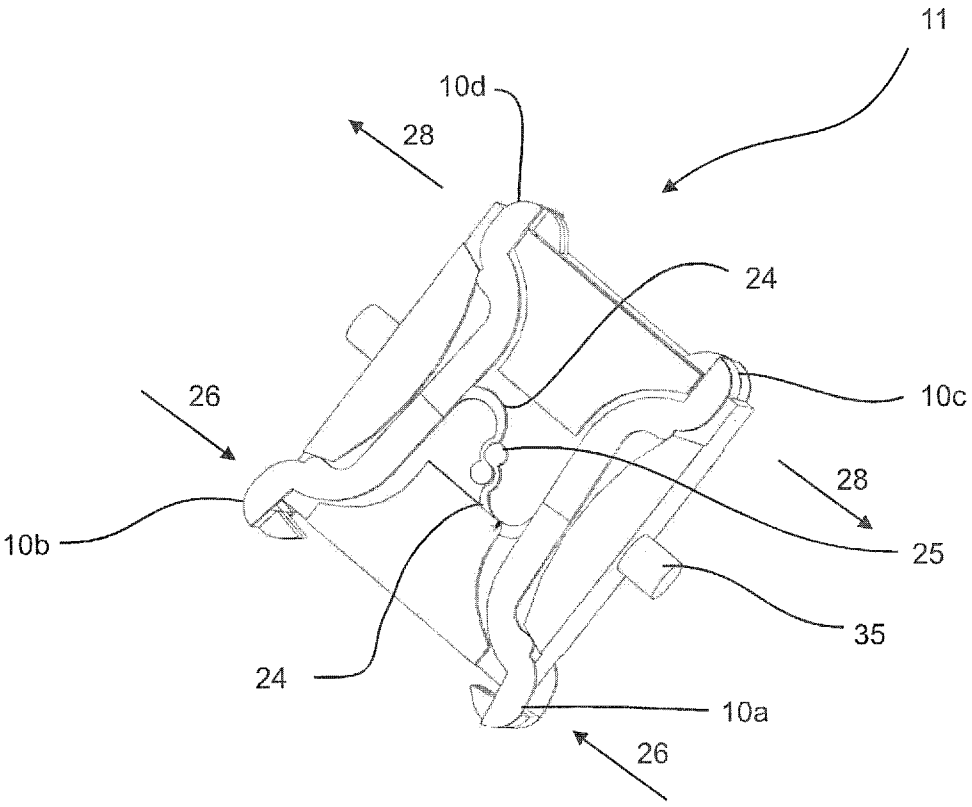
Figure 9:
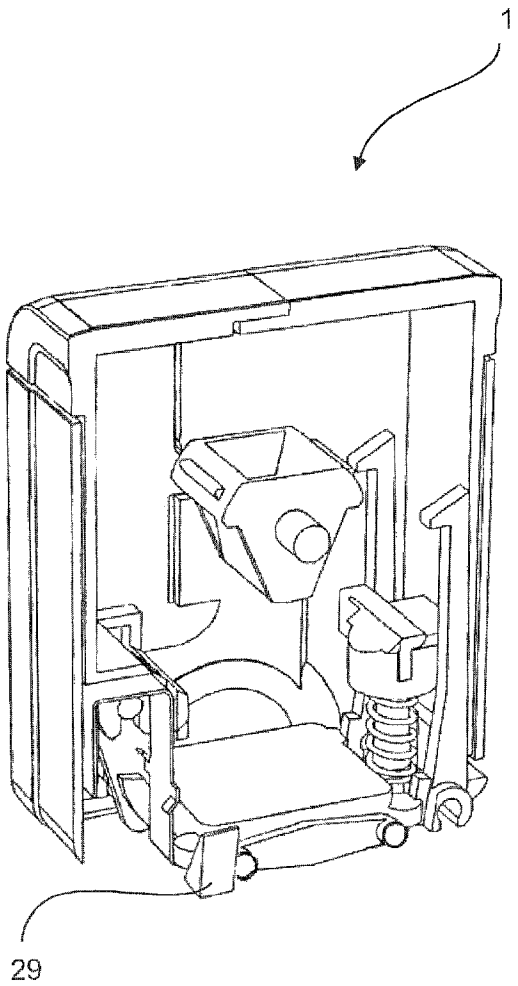
Figure 8:
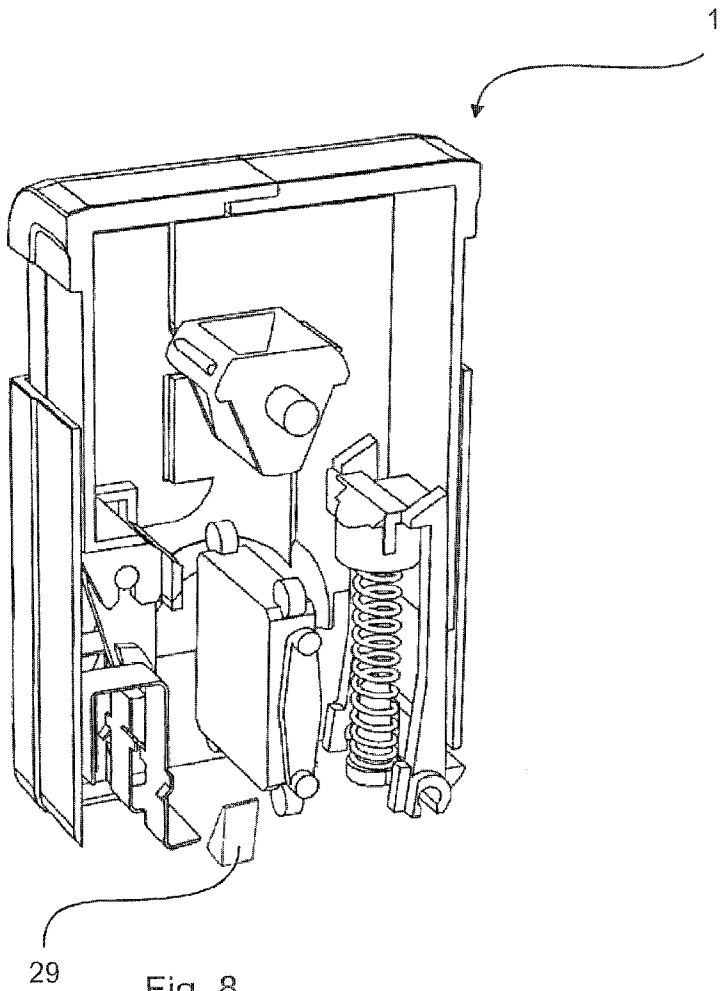
Figure 10:
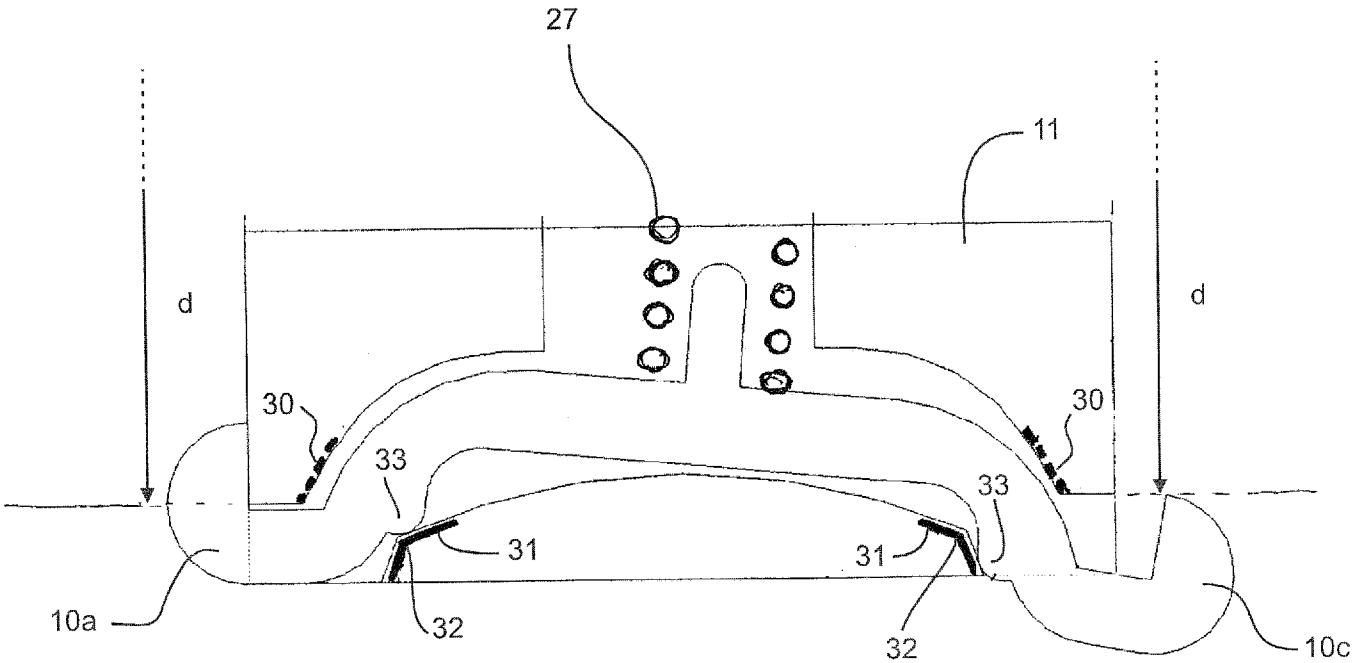
Figure 15:
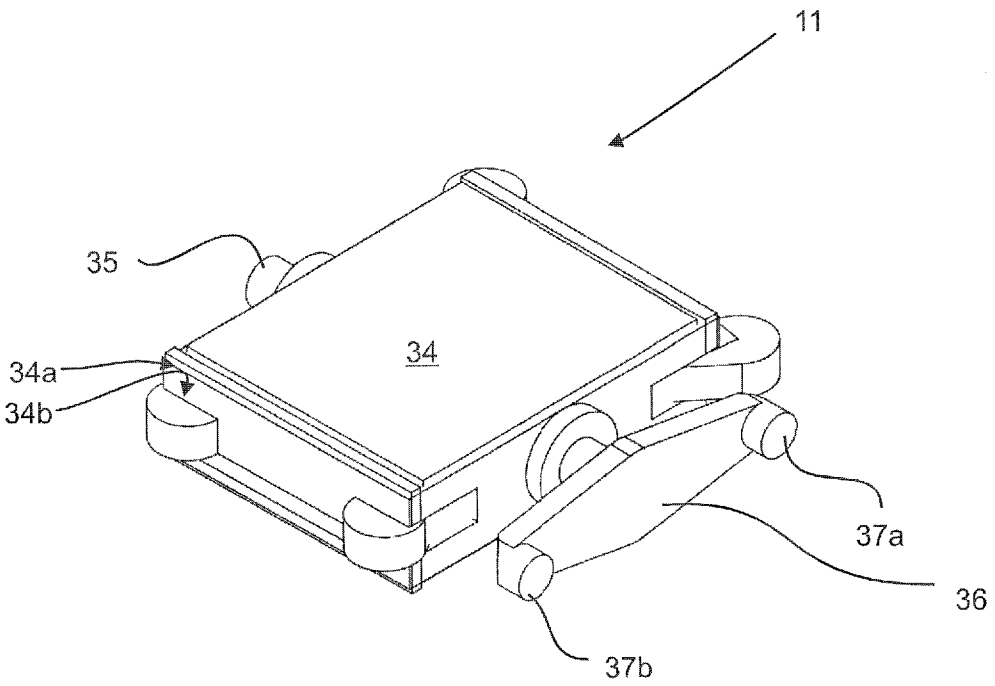
Figure 16:
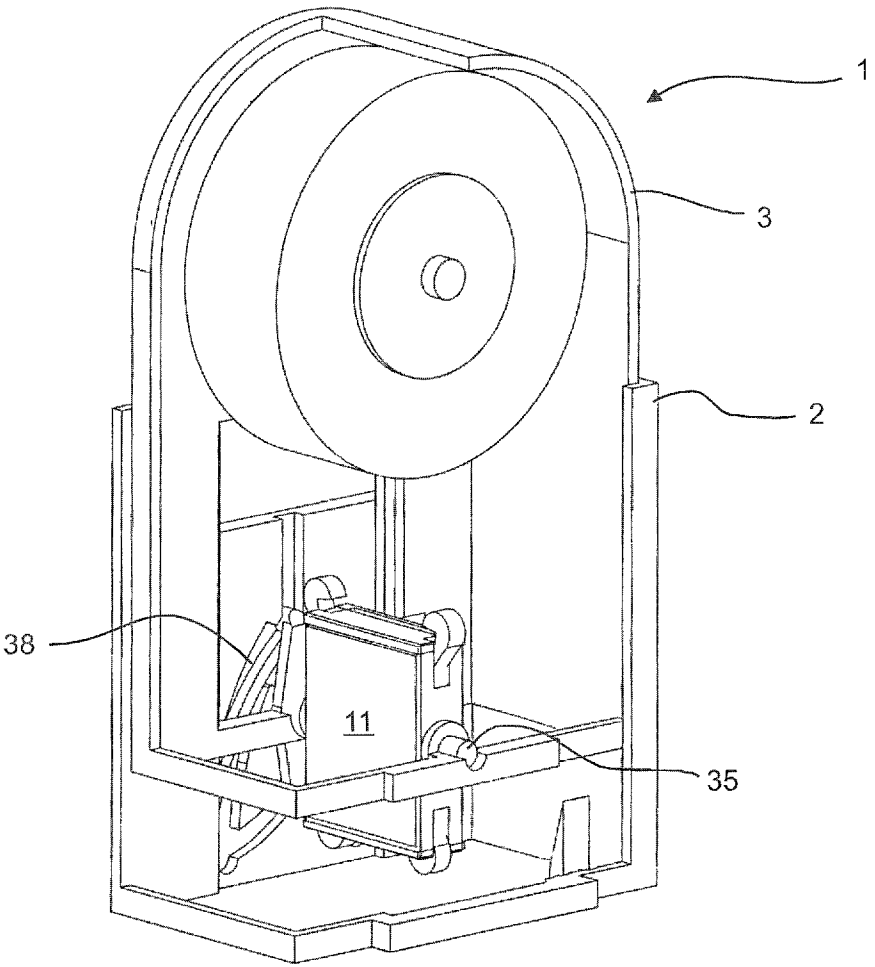
Figure 35:
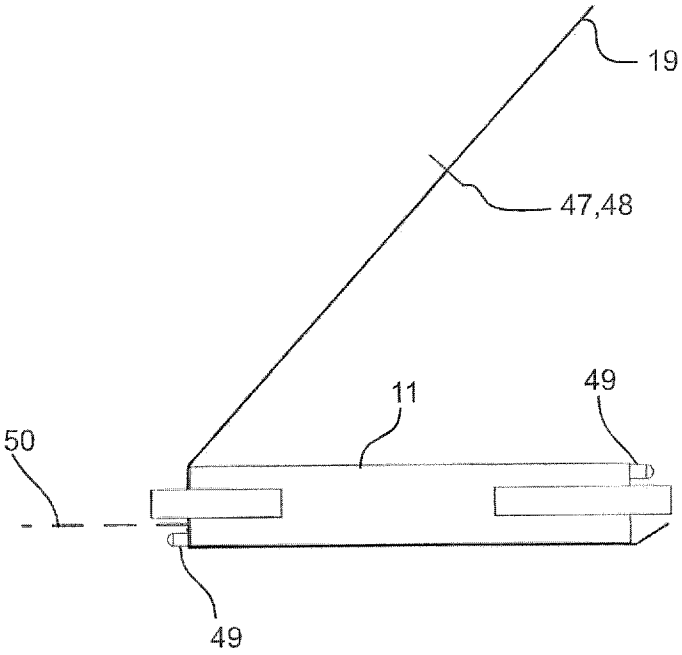
Figure 41:
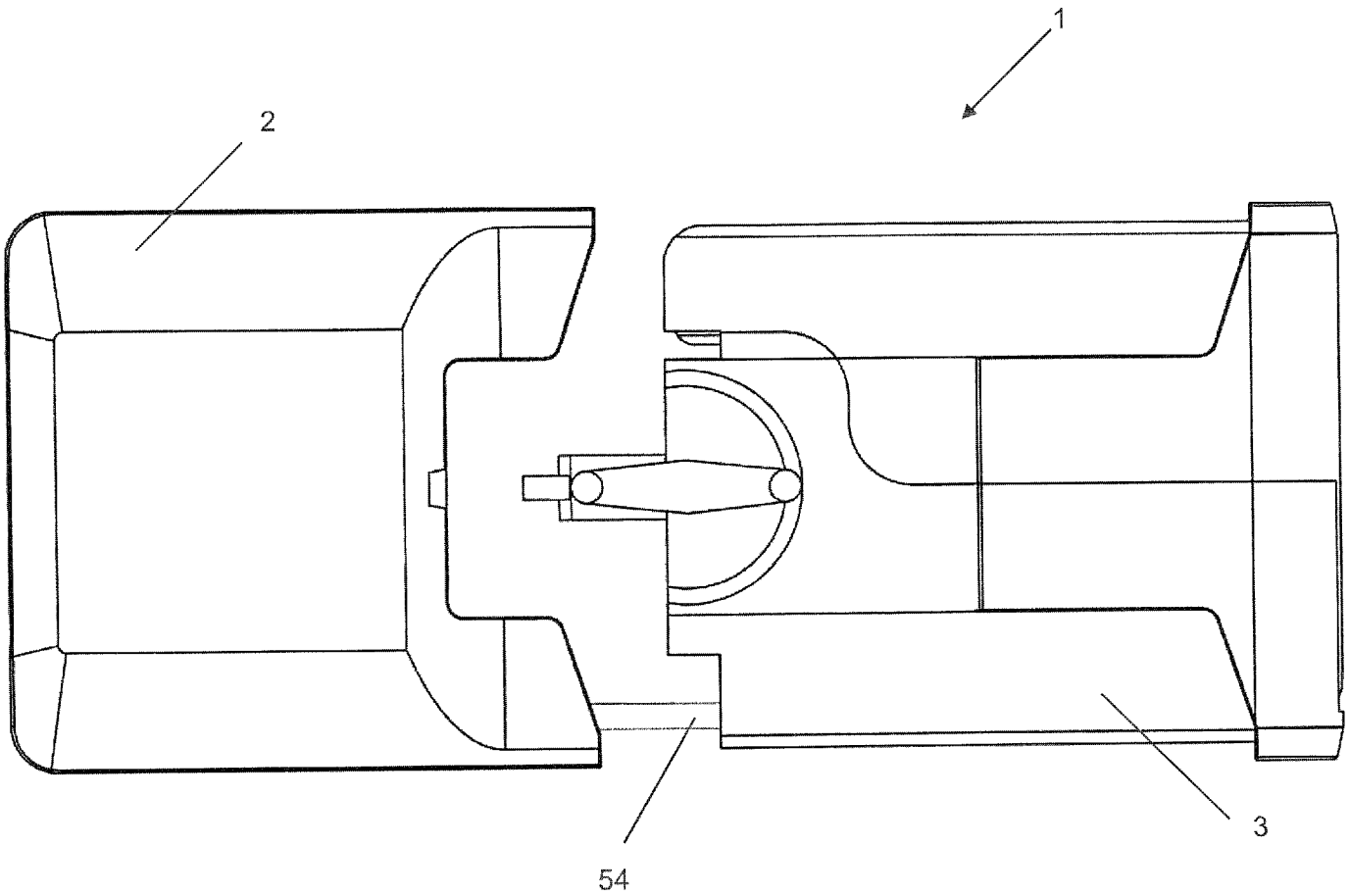
Figure 42:
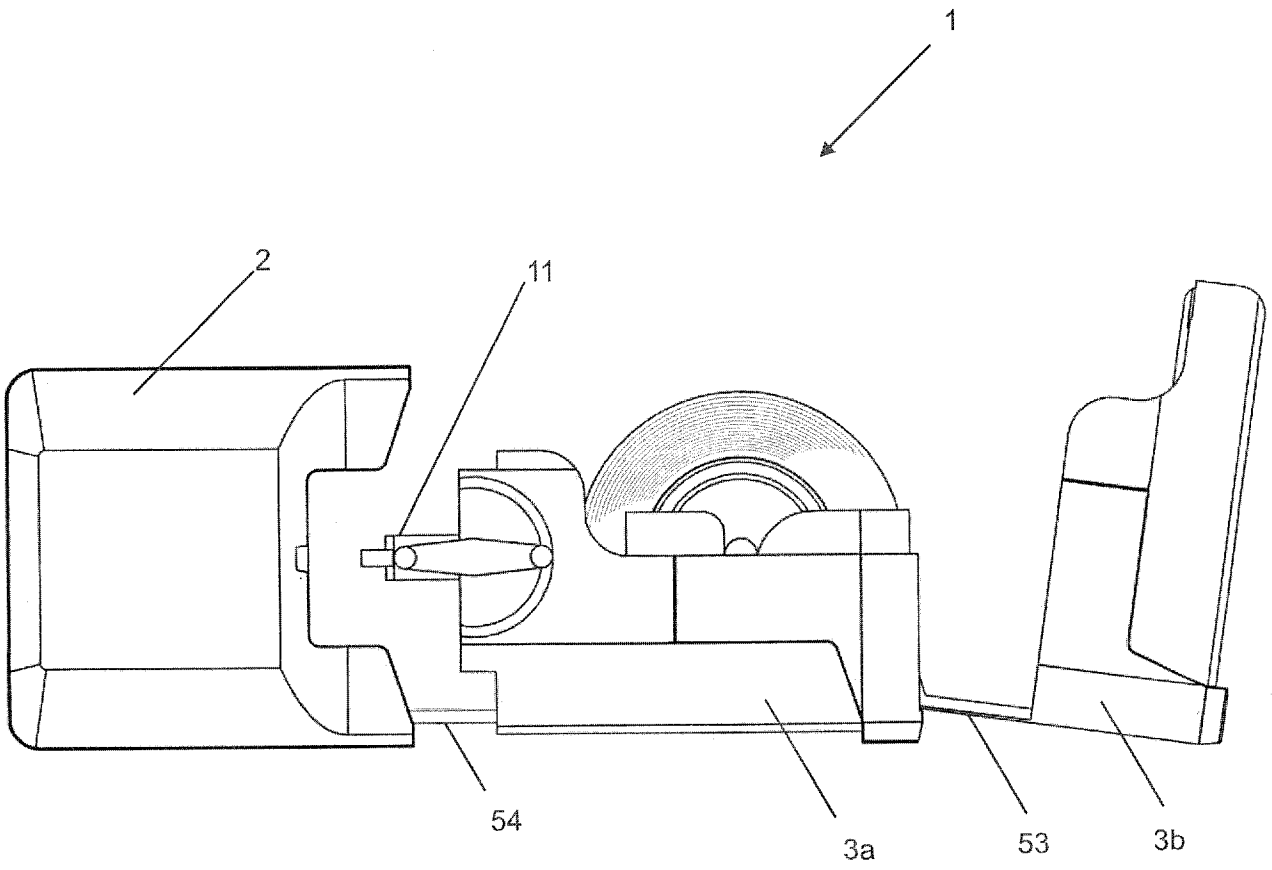
Figure 43:
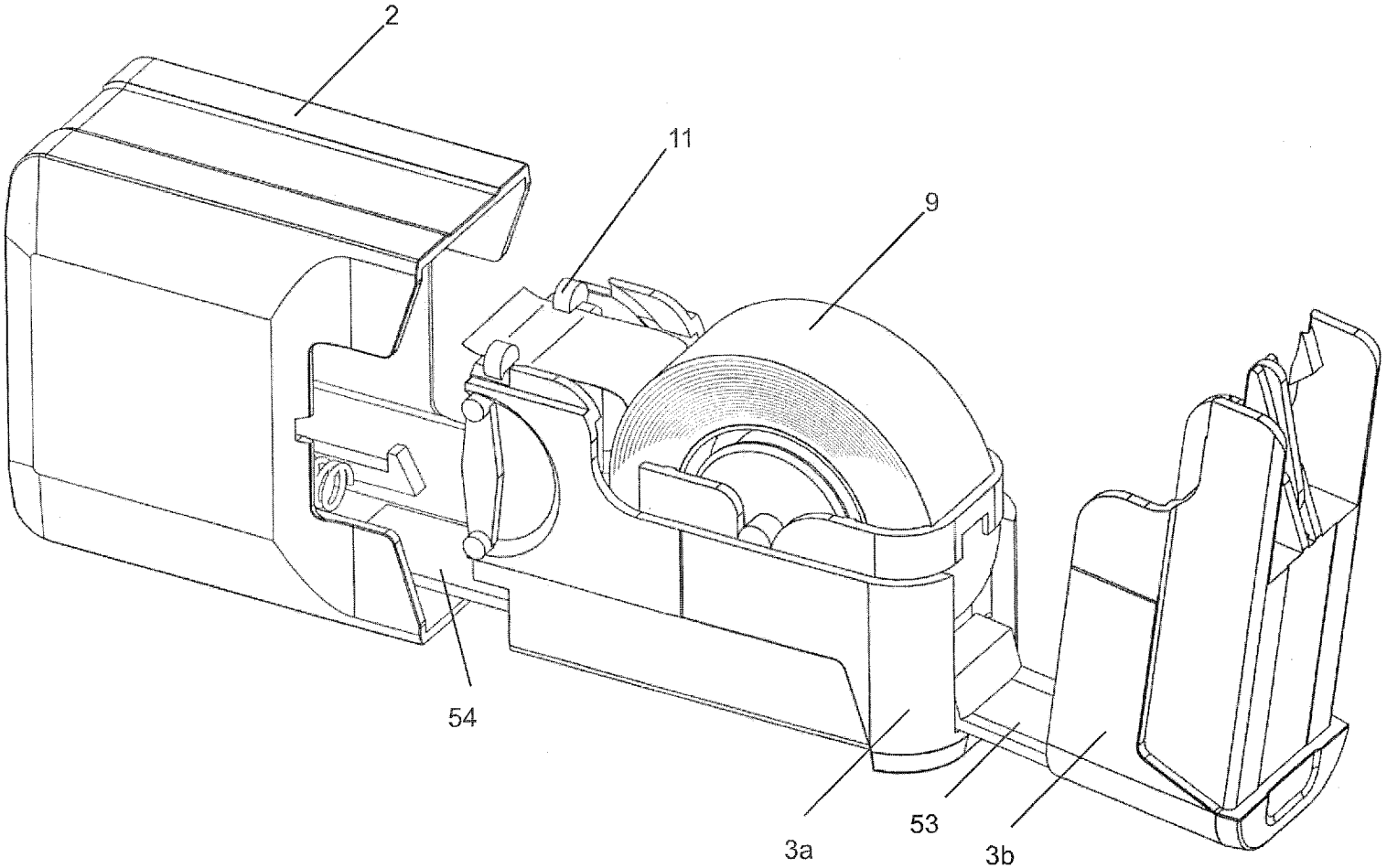
Figure 57:
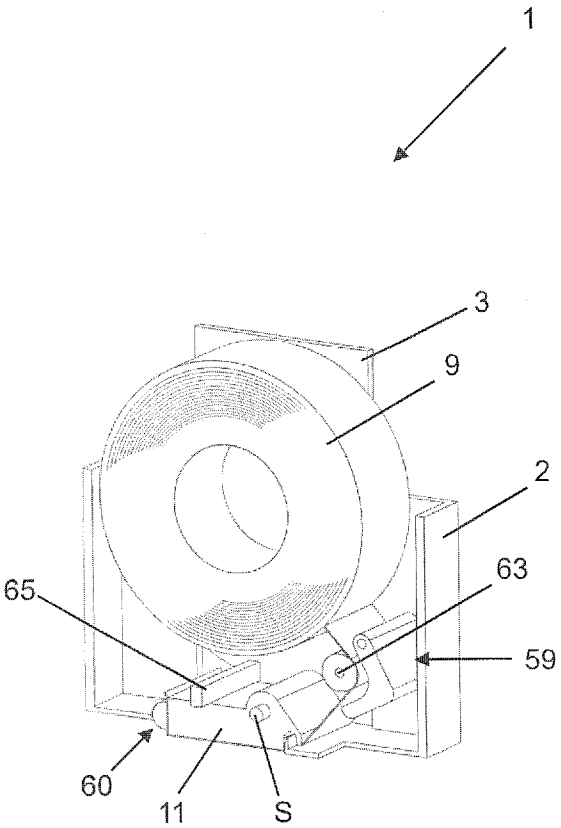
Figure 56:
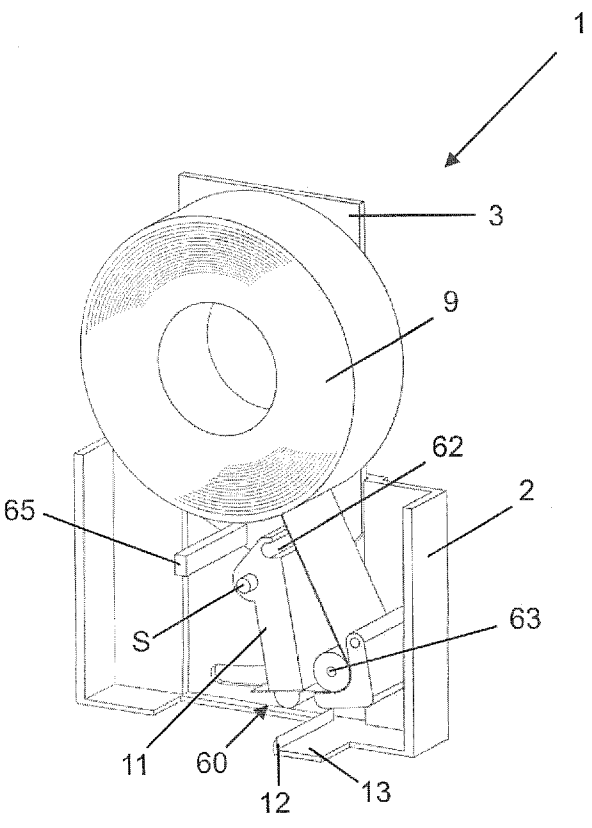
Figure 63:
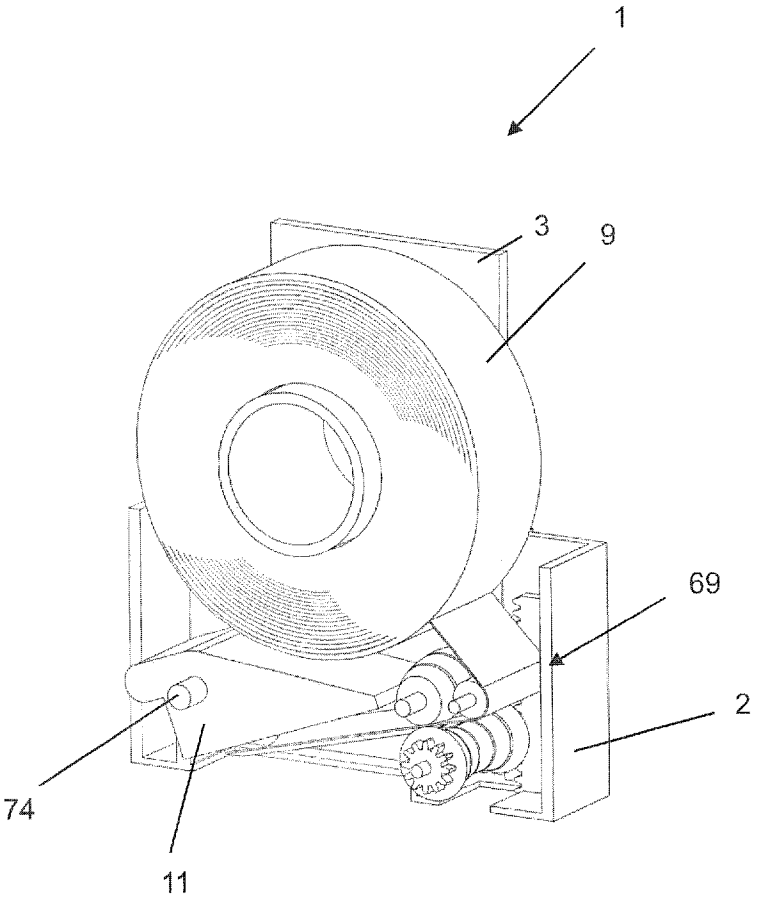
Figure 64:
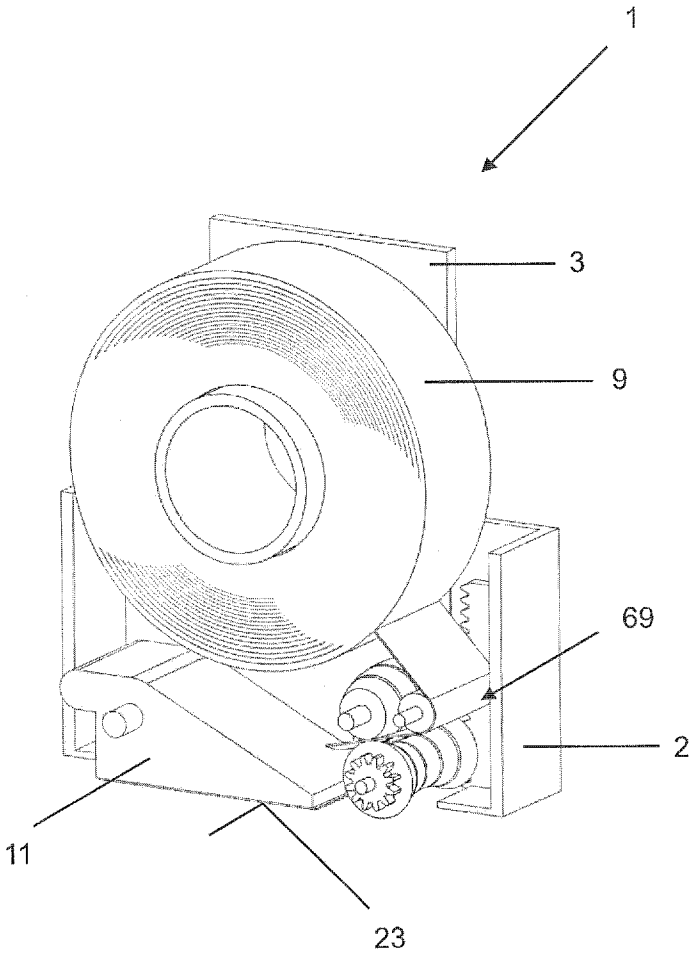

Further distinguishing features, advantages and effects of the invention arise out of the following description and the attached Figures of preferred examples of the invention. In the drawings FIGS. 1 and 2 show diagrammatic, three dimensional representations of an adhesive tape stamp as a first example of the invention in different positions, FIGS. 3 to 6 show a diagrammatic representation of the course of movement during the operation of the adhesive tape stamp in FIGS. 1 and 2, FIG. 7 shows a diagrammatic, three dimensional representation of a stamp plate of the adhesive tape stamp with split, external clamps, FIGS. 8 and 9 show diagrammatic, three dimensional representations of the adhesive tape stamp of FIGS. 1 and 2 with further parts suppressed in the drawing, FIG. 10 shows a section of a detail of one of the stamp plates in plan view, constructed with plans in the middle plane, FIGS. 11 to 14 shows a diagrammatic plan view of the stamp plate in different states to illustrate the mode of functioning, FIG. 15 shows a diagrammatic, three dimensional representation of the stamp plate with stamp covering, FIG. 16 Shows the adhesive tape stamp in FIGS. 1 and 2 in a diagrammatic, three dimensional view from a different viewing angle, FIGS. 17 to 20 show the connecting link guide for guiding the stamp plate in plan view to illustrate the course of movements, FIGS. 21 to 30 show a second example for realizing a forced guidance of the stamp plate in various positions, each as a diagrammatic, three dimensional representation with elements suppressed in the drawing, FIG. 31 shows a diagrammatic exploded representation of the stamp plate in FIGS. 21 to 30, FIGS. 32 and 33 show diagrammatic, three dimensional representations of the adhesive tape stamp in FIGS. 1 and 2 to illustrate the dismantling, FIGS. 34 and 35 shows an example of the stamp plate for pre-perforated tapes, which are to be stamped onto sections of defined length, FIGS. 36 to 40 show an example of the construction of a housing for an adhesive tape stamp, FIGS. 41 to 43 show a further example of the construction of a housing for an adhesive tape stamp, FIGS. 44 to 47 show a further example of the construction of an adhesive tape stamp, FIGS. 48 to 51 show a further example of the construction of an adhesive tape stamp, FIGS. 52 to 55 show a further example of the construction of an adhesive tape stamp, FIGS. 56 and 57 show a further example of the construction of an adhesive tape stamp, FIGS. 58 to 61 show a further example of the construction of an adhesive tape stamp, FIGS. 62 to 64 show a further example of the construction of an adhesive tape stamp, FIGS. 65 to 75 show examples of the construction of adhesion-reducing structures on the stamp plate and other contact surfaces, FIGS. 76 to 78 show further embodiments of the stamp plate, FIGS. 79 to 87 show a further embodiment of a severing device in a diagrammatic representation and the course of movement of the device when in the adhesive tape stamp is actuated and FIGS. 87 to 90 show an adhesive tape stamp as an example of the invention with a possible embodiment of the severing device in FIGS. 79 to 87.

Identical or mutually corresponding parts in the Figures have been given identical or mutually corresponding reference numbers.

Figure 1:
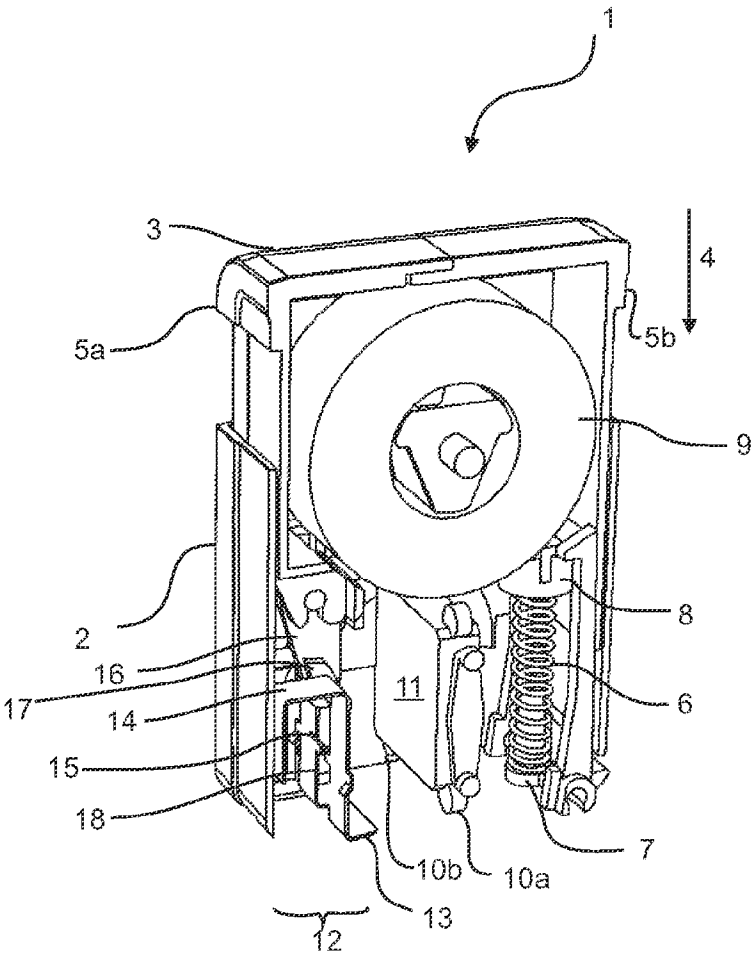

FIG. 1, in a three-dimensional view from above with elements partially suppressed in the drawing, shows an adhesive tape stamp 1 as a first example of the invention. The adhesive tape stamp 1 has a resting part 2 of the housing, which is constructed in order to place an underside, open in the downward direction in FIG. 1, on an object and an operating part 3 of the housing, which is pushed at least sectionally into the resting part 2 of the housing and is guided linearly movably therein. The linear guidance is constructed so that the actuating part 3 of the housing can be shifted in one direction 4 (arrow) of the stamp by a manual actuation in the form of pressure exerted on the upper side of the actuation part 3 of the housing pointing upward in FIG. 1. As is evident from looking at FIGS. 1 and 2 together, the linear motion of the actuating part 3 of the housing along the stamp direction 4 is optionally limited by the integrally laterally molded projections 5 *a, b* of the actuating part 3 of the housing which, after the maximum travel on the other side of the resting part 3 of the housing, rest positively there as end stops. Alternatively, in order to avoid the danger of jamming, a space remains free between the integrally molded projections and the resting part 2 of the housing. The travel is then limited by placing the stamp plate 11 on the substrate or a stop is provided in the adhesive tape stamp.

The adhesive tape stamp 1 has a spring device 6, which is fixed with its lower end on a support 7, which is connected to pivotably with the resting part 2 of the housing, and with its upper end in a round fastening foot 8, which is open in the downward direction, so that the spring device 6 is compressed against the force of a spring by the traversing movement of the actuating part 3 of the housing in the stamp direction 4. After the actuating part 3 of the housing is released or after the pressure is relieved by the user, the spring device 6 ensures that the actuating part 3 of the housing is guided counter to the stamp direction arrow 4 back into the starting position.

A roll 9 of endless tape is mounted rotatably in the actuating part 3 of the housing. The free end of the adhesive tape is clamped at least temporarily by means of two clamps 10 *a* and 10*b* at the lower front side of a stamp plate 11 shown in FIG. 1. As can be seen from a comparison of FIG. 1 with FIG. 2, the stamp plate 11, after the linear movement of the actuating part 3 of the housing in the stamp direction 4, is rotated by 90° in the counterclockwise direction and, at the same time, shifted in the stamp direction 4. The adhesive tape, immobilized with the clamps 10 *a, b*, is pressed by this course of movement with the adhesive side onto the upper side of an object, which is not shown.

As can be seen best from FIG. 1, the adhesive tape stamp 1 has a severing device 12, which is cocked and triggered by the linear movement of the actuating part 3 of the housing. The severing device 12 comprises a blade 13, which is suspended resiliently in a direction perpendicular to the stamp direction 4 and constructed as the free end of an angularly bent spring blade. 14. In a cross sectional plane parallel to arrow 4, the spring blade 14 has a fastening section, which initially extends vertically in FIG. 1 and with which the spring blade 14 is fastened to the resting part 2 of the housing. After the fastening section, the spring blade 14 folds at right angles into the housing of the adhesive tape stamp 1. After a thither rectangular fold, the spring blade 14 is aligned perpendicularly in a clamping section in FIG. 1 and parallel to be fastening section and then, after a further rectangular fold, goes over into the blade 13. An upwardly directed latch 15, which points to the fastening section and interacts with a release mechanism 16 of the severing device 12, as will still be explained in the following, is disposed in the clamping section.

The release mechanism 16 is fastened in the actuating part 3 of the housing and has a downwardly directed triangular continuation, on which an actuation wedge 17 is disposed, which, during the linear movement of the actuating part 3 of the housing, traces the latch 15 with an inclined side, so that the latch together with the clamping section and consequently with the blade 13, is shifted to the fastening section of the spring blade 14. As soon as the actuating wedge 17 has scanned the latch 15 completely, it enters an opening 18 in the spring blade 14, so that the clamping section is released and the blade 13 can hasten in the direction of the interior of the housing of the adhesive tape stamp 1. This state is shown in FIG. 2, in which it can be seen that the blade 13 strikes against a front side of the stamp plate 11 and, by this striking movement, cuts off and, with that, releases the adhesive tape, which is already stamped onto the object (not shown). The adhesive tape is severed completely.

After the actuating part 3 of the housing is released, it is pushed back by the spring device 6 into the starting position. At the same time, the actuating plate 11 is rotated further in the original direction of rotation.

As is evident from the three dimensional representation, the stamp plate 11 is in a space, which is projected by a projection of the adhesive tape roll 9 or 19 onto the substrate in the stamp direction.

For a better understanding of the course of movements of the stamp plate 11, reference is made to FIGS. 3 to 6, which show the stamp plate 11 as well as the adhesive roll 9 in a diagrammatic representation.

Figure 3:
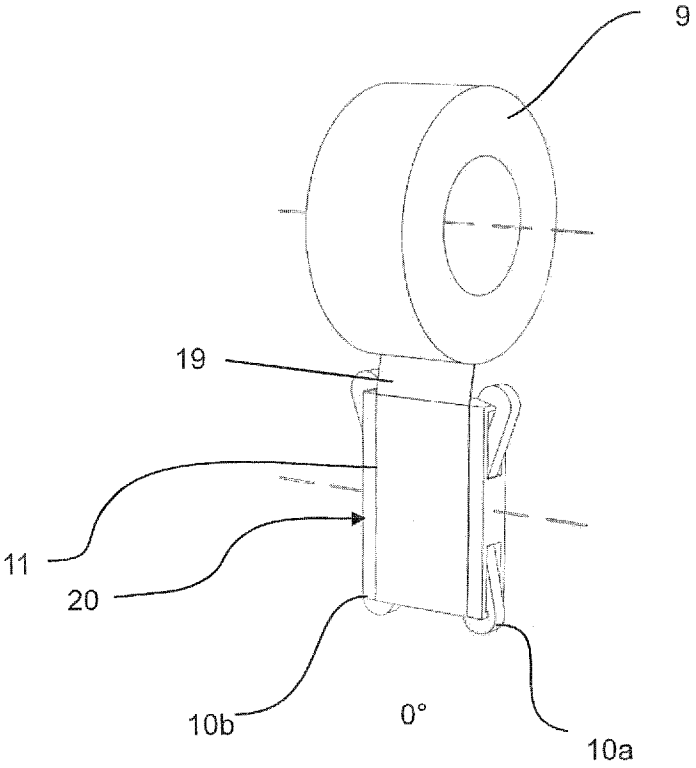

FIG. 3 illustrates the stamp plate 11 and the roll of adhesive tape 9 in the state, which corresponds to the starting position of FIG. 1. The stamp plate 11 is disposed vertically. In the following this is referred to as an angle of 0°. The clamps 10 *a, b* are closed, so that the free end of adhesive tape 19 is immobilized at the front side of the stamp plate 11. The adhesive tape 19 extends in the backward direction starting out from the clamps 10 *a, b*, over the first upper side of the stamp plate 11, which forms a first stamp surface 20, to the roll of adhesive tape 9.

Figure 4:
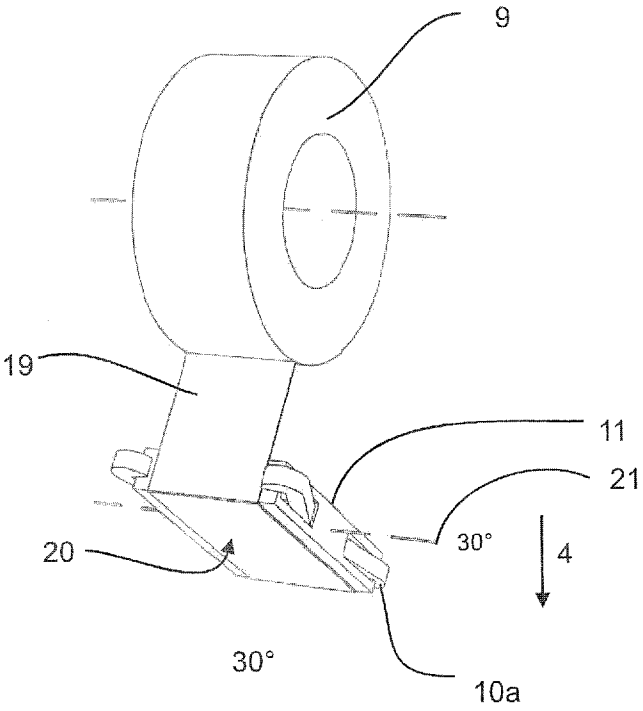

FIG. 4 shows the arrangement of FIG. 3. The stamp plate 11, on the one hand, has carried out a linear movement in the direction of arrow 4 and, on the other, a rotation about it its center axis 21 by about 30°. Additional adhesive tape 19 was unwound from the roll of adhesive tape 9 by this movement.

Figure 5:
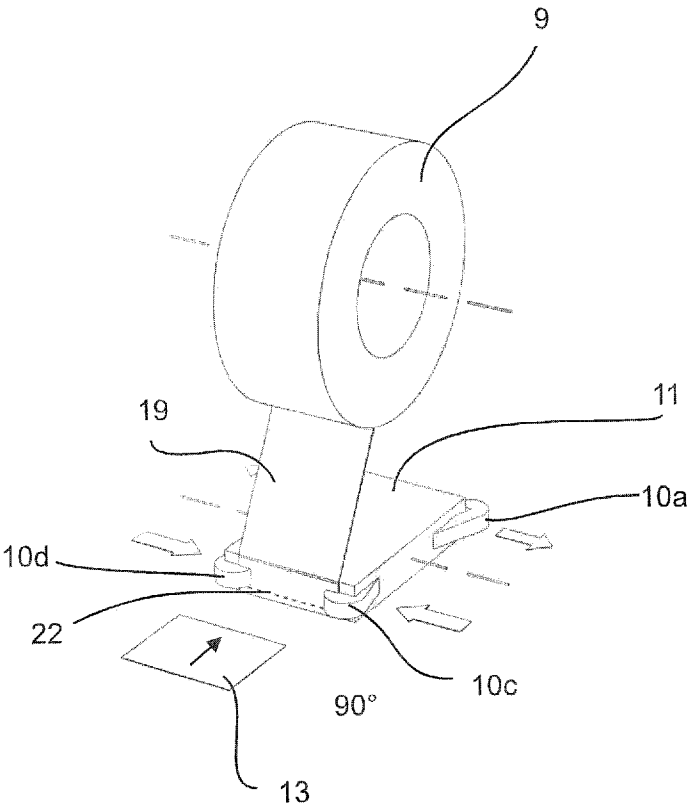

FIG. 5 shows the arrangement in FIGS. 3 and 4 in the region of the lower dead point of the actuation part 3 of the housing, wherein the stamp plate 11 has carried out the linear as well as the rotational movement further and now makes an angle of 90° with the starting position. In this state, the end of the adhesive tape 19 is pressed onto the object, which is not shown. Moreover, the clamps 10 *a, b*, and, with that, the free end of the adhesive tape are released; however, the adhesive tape is immobilized by the clamps 10 *c*, 10 *d*, at the opposite front side of the stamp plate 11. After or with the immobilization of the adhesive tape 19, the latter is severed at a severing site 22 by the blade 13. Starting out from the roll of adhesive tape 9, the severing side is disposed after the clamps 10*c, d*, so that the end of the adhesive tape, pressed onto the object, is released as adhesive tape section.

Figure 6:
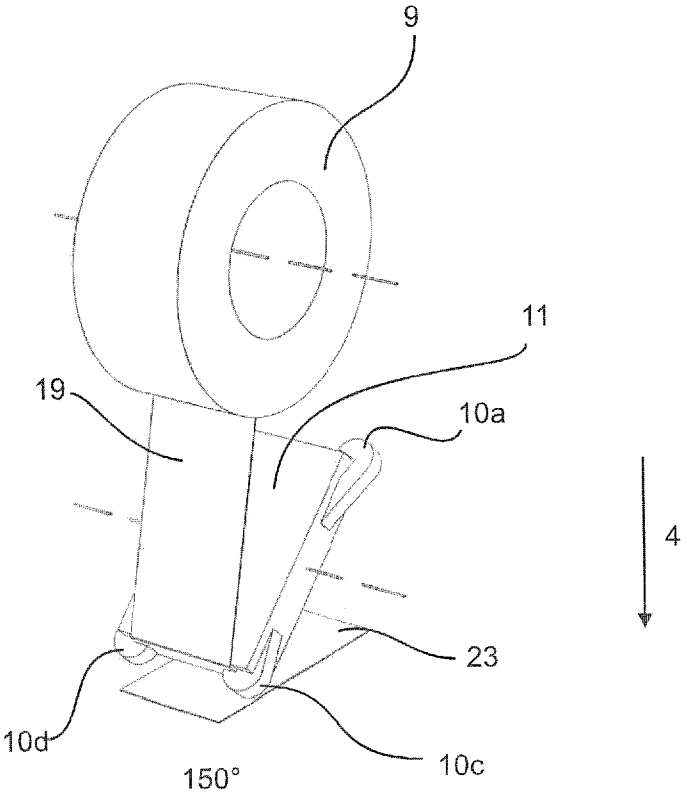

FIG. 6 shows the arrangement in FIGS. 3 to 5 during the backward motion of the actuating part 3 of the housing counter to the direction of the arrow 4, wherein the direction of rotation of the stamp plate 11 is continued further, so that the stamp plate 11 makes an angle of about 150° with its starting position. The adhesive tape section 23, deposited on the object, can be seen. After the stamp plate 11 has returned to the starting position, it is rotated by 180° from the position in FIG. 3. If a further stamping process is carried out, the stamp plate 11 is rotated once again through 180° in the course of the process so that, after the second stamping process, the stamp plate 11 is returned to the starting position in the same orientation as in FIG. 3. With that, the stamp plate 11 carries out an endless rotation over several stamping processes without changing direction.

FIG. 7 shows a three-dimensional plan view of a construction of the stamp plate 11, wherein, however, a covering, which forms the stamp surface 20 and is made from a yielding material and/or a material with a high coefficient of friction, was suppressed in the drawing in order to be able to show the inner life of the stamp plate 11 better. The stamp plate 11 has the four clamps 10 *a, b, c* and *d*, which are each disposed in the corner regions of the stamp plate 11. In the representation of FIG. 7, the clamps 10 *c* and 10 *d* are closed, so that this front side immobilizes the adhesive tape 19, which is not shown. On the opposite front side, the clamps 10 *a* and *b* are disposed and are open in this state. The clamps 10 *a* and *c* or 10 *b* and *d*, each of which is assigned to a longitudinal side, are rigidly connected mechanically with one another and can be opened and closed in rocker fashion. The pairs of clamps 10 *a* and *c* or 10 *b* and *d* are slipped onto the plate body of the stamp plate 11 from the outside. The stamp plate 11 has a center axis 35, which is constructed as a continuous knockout spindle and forms the axis of rotation during the superimposed linear-rotational movement. The plate body is constructed in one piece and, on both sides, shows external guide tracks for guiding the clamp pairs 10 *a* and *c* or 10 *b* and *d*. For producing an outwardly directed pre-tension, each pair of clamps 10 *a* and *c* or 10 *b* and *d* has a curved or elastic overmolding 24, which preferably support one another in a common contacting region 25. The clamps a, b, c, d are controlled by exerting pressure on the respectively opened clamps—here 10 *a, b*—in a pressure direction 26 perpendicularly to the side surface of the stamp plate 11.

By exerting pressure in the arrow directions 26, the opened clamps are pressed inwards, the closed clamps 10 *a, c* are pressed apart over the rocker-like coupling in the directions of the arrows 28 and the adhesive tape held is released.

FIGS. 8 and 9 show the adhesive tape stamp of FIGS. 1 and 2 in the same positions. The roll of adhesive tape 9 was suppressed, in order to show further details of the adhesive tape stamp 1. The wedge-shaped clamp switch 29 should be pointed out especially. It is disposed on either side of the stamp plate 11 at the inside of the resting part 2 of the housing and in each case has a ramp, which is constructed so that, with the departure of the outwardly turned sides of the opened clamps 10 *a, b, c* or *d*, these are closed in the arrow direction 26 (FIG. 7). The length and position of the ramp is such, that the closing process of the opened clamps 10 *a, b, c* or *d* commences a few millimeters before the lower dead point, that is, in the region from 0 to 10 mm. The clamp switches 29 accordingly control the opening and closing of the clamps 10 *a, b, c* and *d*.

FIG. 10, in a diagrammatic plan view of one side of the stamp plate 11, shows an enlargement of a section of a pair of clamps 10 *a* and *c* as an alternative embodiment. On the side of the clamp 10*c*, the stamp plate 11 is open, so that a free passage region of width d is formed, which is constructed approximately equal to or has at least the width of the adhesive tape and accordingly permits the adhesive tape 19 to be inserted or placed against the stamp plate 11. During the swiveling motion, the coupled clamps 10 *a, c* are controlled by inner and outer control surfaces 10 or 31, which form a common channel-like depression in the stamp plate 11, in which the pair of clamps 10*a, c* is taken up sectionally or inserted. The pre-tensioning of the pair of clamps 10 *a, c* is achieved not with overmoldings 24 (FIG. 7) but by a spring 27, which is supported at the other pair of clamps 10 *b, d* and is not shown in FIG. 10. The inner control surfaces 30 are constructed to shift the pair of clamps 10 *a, c* in the direction of the longitudinal extent of the stamp plate 11 during the shifting motion. The outer control surfaces 31 form a counter-bearing for the inner control surfaces 30 and, by the position and course, determine the track and/or the ratio of the opening to the spread of the pair of clamps 10 *a, c*. In each case, because of the outer control surfaces 31 has a point of inflection 32, so that a locking nose 33, integrally molded to each of the clamps 10 *a, c*, can lock, clamp or bolt behind the point of inflection 32. At the same time, a tensile force or a clamping force is produced by the locking so that the clamp 10*a* or *b*, opposite to the locking, is pulled against the front face of the stamp plate 11 and clamps the adhesive tape. By these means, the stamp plate 11 is constructed to be self locking and/or self holding. The guide tracks and the pairs of clamps 10 *a, b, c* and *d* in FIG. 7 may be constructed similarly. Owing to the fact that the plate body of the stamp plate 11 in FIG. 10 consists of an upper and a lower half, the other half in FIG. 10 being faded out, the pairs of clamps 10 *a, b, c* and *d* and the spring 27 move in the plane separating the halves, so that the center axis 35 (not shown) is constructed as two separate, aligned axle stubs.

Figures 11, 12, 13, 14:
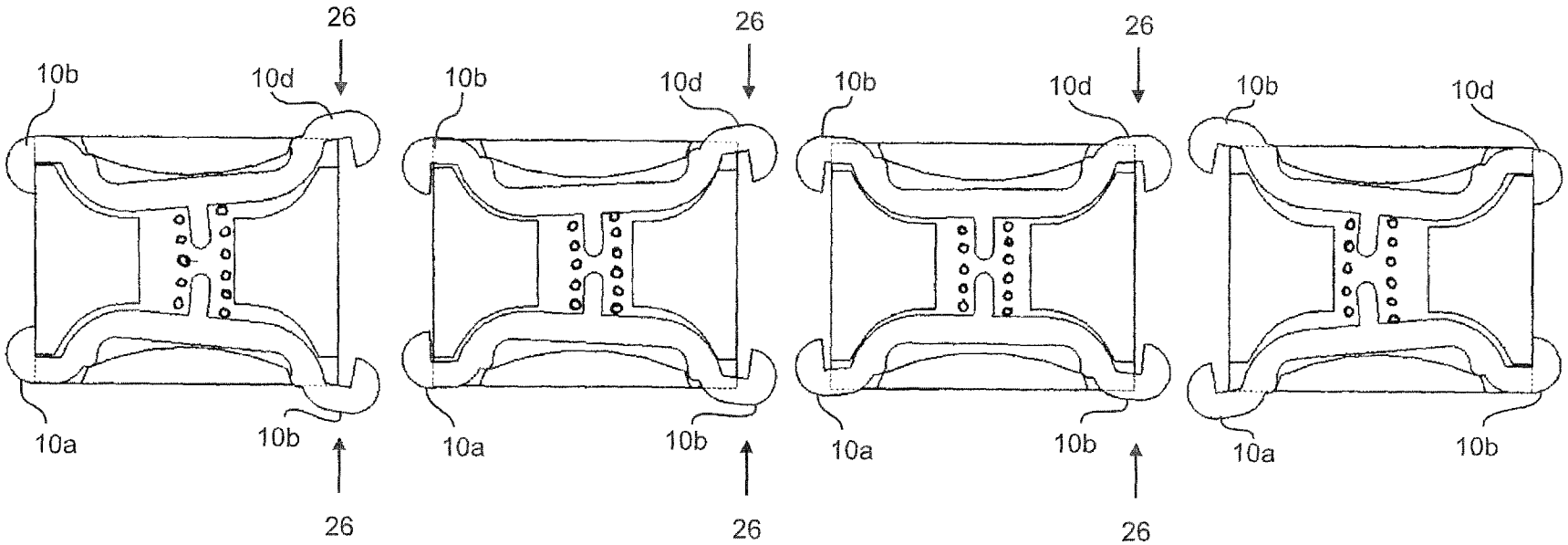

FIGS. 11 to 14, in a diagrammatic plan view of the stamp plate 11, show the step by step sequence when changing the closing side of the stamp plate 11. In FIG. 11, the clamps 10 *d* and *c* are opened, so that the adhesive tape can be inserted, and clamps a and b are in the closed position. The locking noses 33 of the clamps 10 *d* and *c* are in the locking position and are clamped behind the corresponding points of inflection 32, the clamps 10 *a* and *b* being pulled to the front side of the stamp plate by the clamping force. FIG. 12 shows the start of the unlocking. The locking noses are guided against an elastic resistance over the ponds of inflection 32 and the clamps 10 *a, b* commenced to open up. FIG. 13 shows the stamp plate 11 half open on both sides. In FIG. 14, the stamp plate is shown in the changed closed position; in comparison to FIG. 11, the right side with the clamps 10 *c* and *d* is now closed and the clamps 10 *a* and *b* are now opened.

FIG. 15 shows the stamp plate 11 in FIG. 10 with the deposited covering 34, which is constructed for pressing the adhesive tape section 23 onto the object. In addition to the covering 34, a material covering 34*a*, especially one with a high coefficient of friction and/or elastic properties, may be provided at the edges of the front surface of the stamp plate 11, so that the endless adhesive tape 19 is guided over this material covering 34*a* and or be disposed on the front side of the stamp plate 11 in the clamping region of the clamps 10 *a, b. c* and *d*, so that the endless adhesive tape 19 is clamped between the material covering 34*b* and the clamps 10 *a, b. c* and *d*, especially with elastic deformation of the material covering 34*b*. The stamp plate 11 shows the centrally disposed center axis 35, which is mounted rotatably in the actuating part 3 of the housing, in order to permit the rotational movement. For controlling the rotational movement, a fork 36 is provided at the longitudinal side of the stamp plate 11. The fork 36 has two guide bolts 37 *a, b* and/or the guide bolts 37 *a, b* are rigidly connected with the stamp plate 11.

As is evident from FIG. 16, which, in contrast to the FIG. 1 *ff*, permits a view into the housing of the adhesive tape stamp 1 from the opposite side, the guide bolts 37 *a, b* engage the fork 36 or the stamp plate 11 in a connecting link guide 38, which is formed in the side walls of the resting part 2 of the housing as inwardly turned open grooves. It may be inferred once again from this representation that the stamp plate 11 is mounted rotatably over the center axis 35 in the actuating part 3 of the housing.

The guidance of the guide bolts 17 *a, b* is shown diagrammatically in FIGS. 17 to 20 for the angle positions of 0', 30°, 90° and 150°; however, it is shown in greater detail than in a plan view of the connecting link guide 38, which has an inverted heart shape, which is formed by the groove-like depressions in the resting part 2 of the housing.

Figure 17:
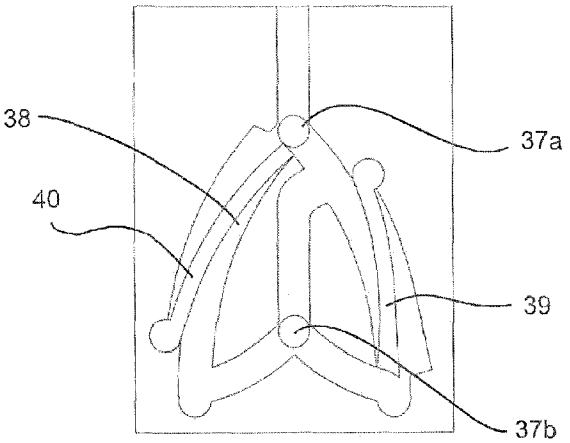

For the 0° angle positions shown in FIG. 17, the guide bolts 37 *a, b* are disposed perpendicularly to one another and are at the point of the heart (37*a*) or at the depression of the heart (37*b*). By shifting the resting part 2 of the housing relative to the actuating part 3 of the housing, the guide bolts 37 *a, b* in the representation of FIGS. 17 to 20 are pressed vertically downward in a linear motion. However, because of the connecting link guide 38, the guide bolt 37 *a* is guided along the right boundary of the heart and the guide bolt 37 *b* is guided along the left boundary of the heart, so that a rotational motion about the center axis is superimposed on the linear motion of the guide bolts 37 *a, b.*

Figure 18:
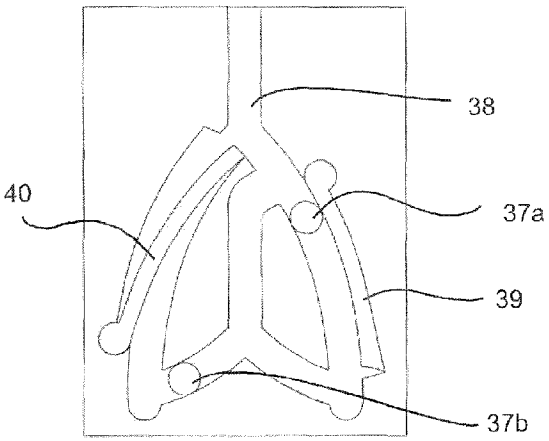

FIG. 18 shows that during the scanning of the right boundary of the heart by the guide bolt 37 *a*, a downwardly directed, elastic, first ratchet lever 39, the fulcrum of which is disposed in the region of the tip of the heart, is pressed to the outside.

Figure 19:
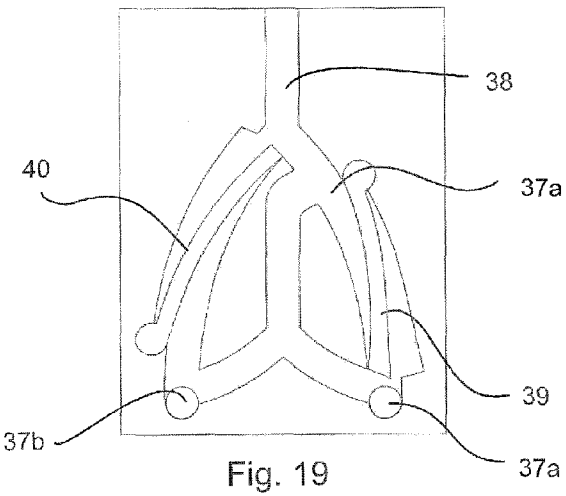

FIG. 19 shows the connecting link guide 58 in a 90° angle setting of the stamp plate. The guide bolts are each disposed at the tip of the heart halves. This condition forms the lower dead point during the travel movement of the actuating part 3 of the housing. After the release of the actuating part 3 of the housing, the guide bolts 37 *a, h* are pulled upward. However, a return of the guide bolts 37 *a, b* is prevented by the free end of the ratchet lever 39, so that the rotational movement of the stamp plate 11 is continued in the same direction of rotation on the return path.

Figure 20:
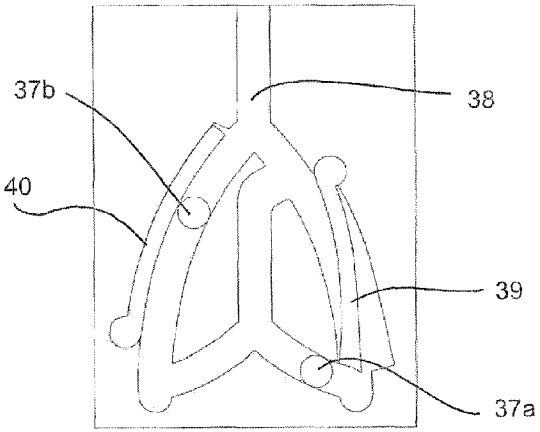

As is evident from FIG. 20 at an approximately 150° angle position, the guide bolt 37 *b* moves along the left boundary of the card in the direction of the tip of the heart. A second ratchet lever 40, the fulcrum of which is disposed in the region of the tip of the left half of the heart, is pressed to the outside. On the other hand, the guide bolt 37 *a* migrates in the direction of the heart depression. As soon as an angle position of 180° is reached, the guide bolts 37 *a, b* have exchanged their position in comparison to the starting position, so that the stamp plate 11, although it is disposed once again as in the starting position, is rotated through 180°. The free end of the second ratchet lever 40 snaps into place behind the guide bolt 37*b*, so that, in the case of a renewed actuation of the adhesive tape stamp 1, the guide bolt 37 *b* is positively guided by the right boundary of the heart.

FIGS. 21 to 25 show the course of movement for a second embodiment of the adhesive tape stamp 1. The parts, which are not shown, may be constructed identically with or analogous to the parts of the first example. FIGS. 26 to 30 show the close of movements in the same positions as in FIGS. 21 to 25. For greater clarity, the stamp plate 11 has been suppressed in the drawing.

The second embodiment differs from the first especially in that an E-shaped nose plate 41 and a clutch 42, which is referred to in the following as nose guide 42, is used instead of the connecting link guide.

Figure 21:
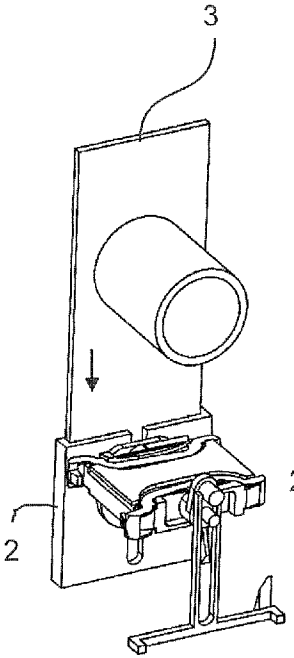
Figure 27:
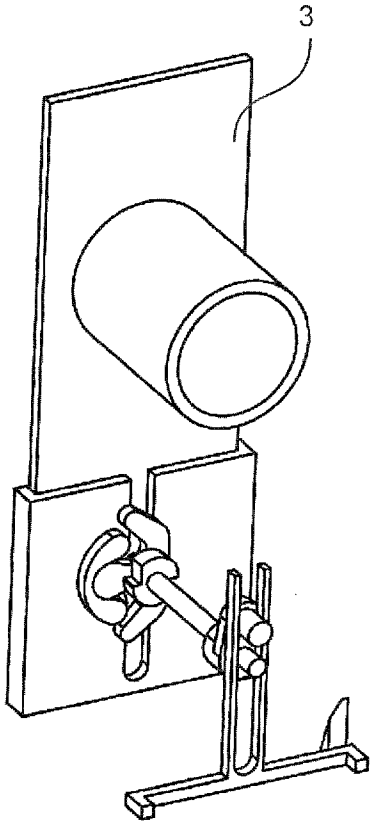
Figure 26:
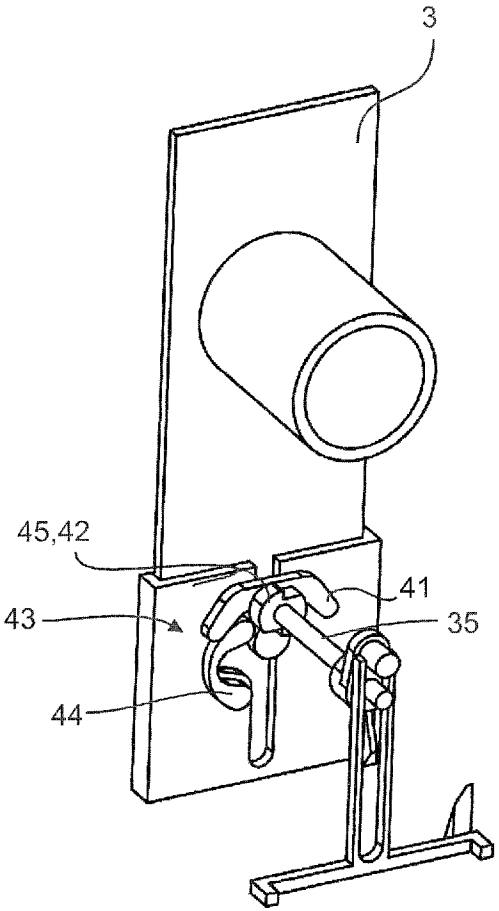

In the first position in FIGS. 21 and 26, the actuating part 3 of the housing is at the upper dead point and the stamp plate 11 is aligned horizontally. The nose plate 41 is directed downward with the open regions between the free legs of the "E" and lies with a left leg on a diverting kidney, which is connected firmly with the resting part 2 of the housing.

For the linear movement of the resting part 2 of the housing in the stamp direction 4, the nose plate 41 is rotated by the diverting kidney 44 in that the nose plate 41 rolls or is rolled on the diverting kidney 44. In the position shown in FIGS. 22 and 27, the stamp plate 11 is rotated through about 90° and the middle leg of the nose plate 41 engages the open region of the diverting kidney 44.

Figure 23:
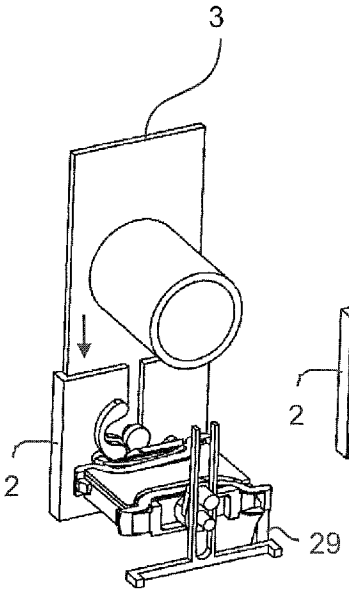
Figure 22:
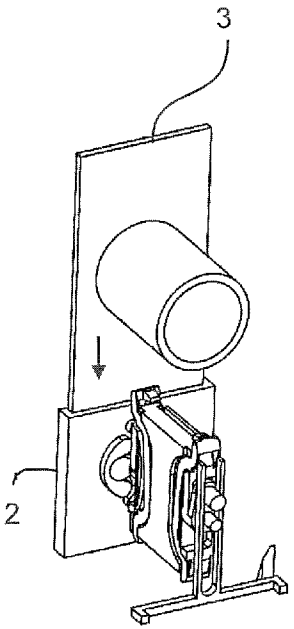
Figure 28:
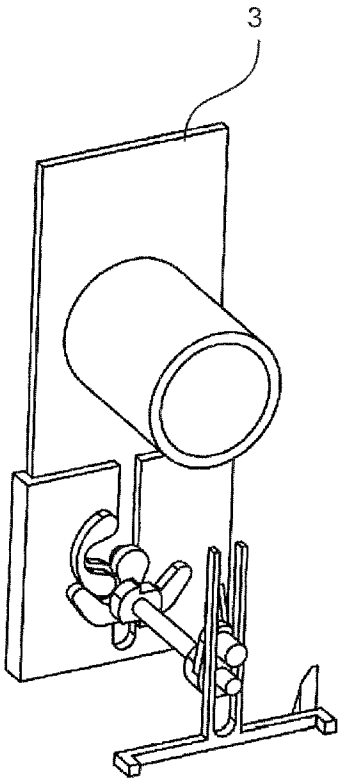

FIGS. 23 and 28 shows the adhesive tape stamp in a third position. The rotation about the center axis 35 was continued and the nose plate 41 is disposed rotated by about or almost 180°. In this connection, it is advantageous if the stamp plate 11 was rotated by less than 180°, so that, when lowering further, the clamp switch 29 contacts the substrate at about the same time that the opposite plate edge of the stamp plate 11 touches down on it. The rotational movement of the superimposed rotational-linear movement of the stamp plate 11 is concluded in the third position.

Figure 24:
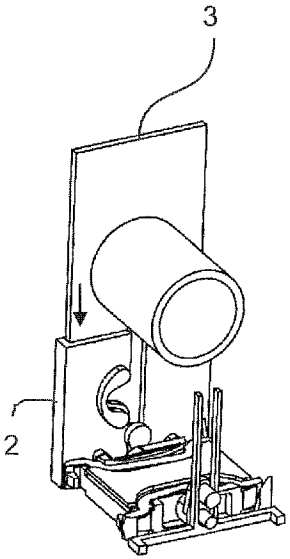
Figure 29:
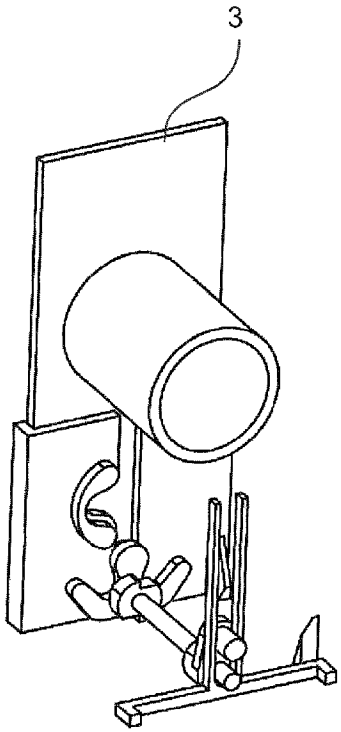

For the transition to the fourth position, which is shown in FIGS. 24 and 29, the stamp plate 11 is shifted exclusively linearly in the stamp direction 4 the nose plate 41 and the diverting kidney 44 are at a distance from one another.

Figure 25:
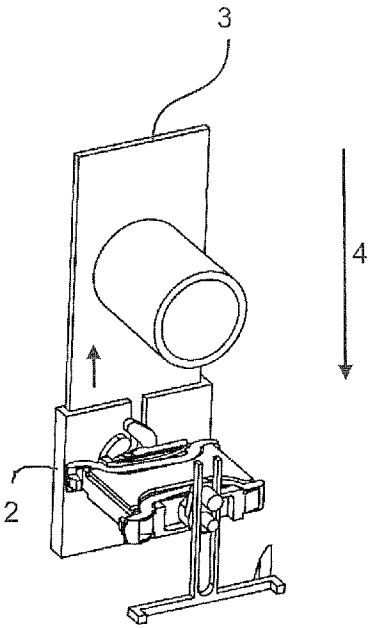
Figure 30:
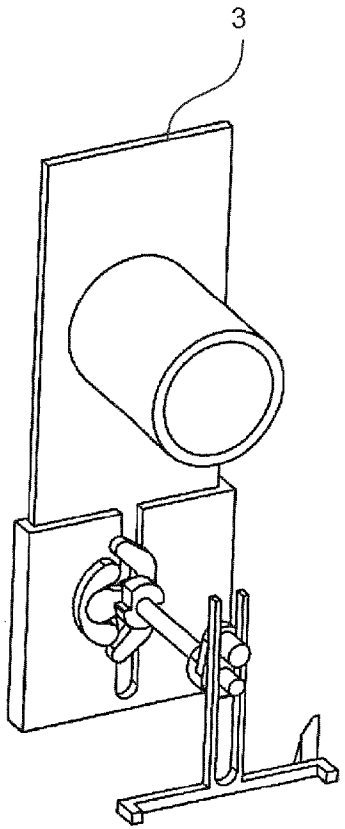
Figure 31:
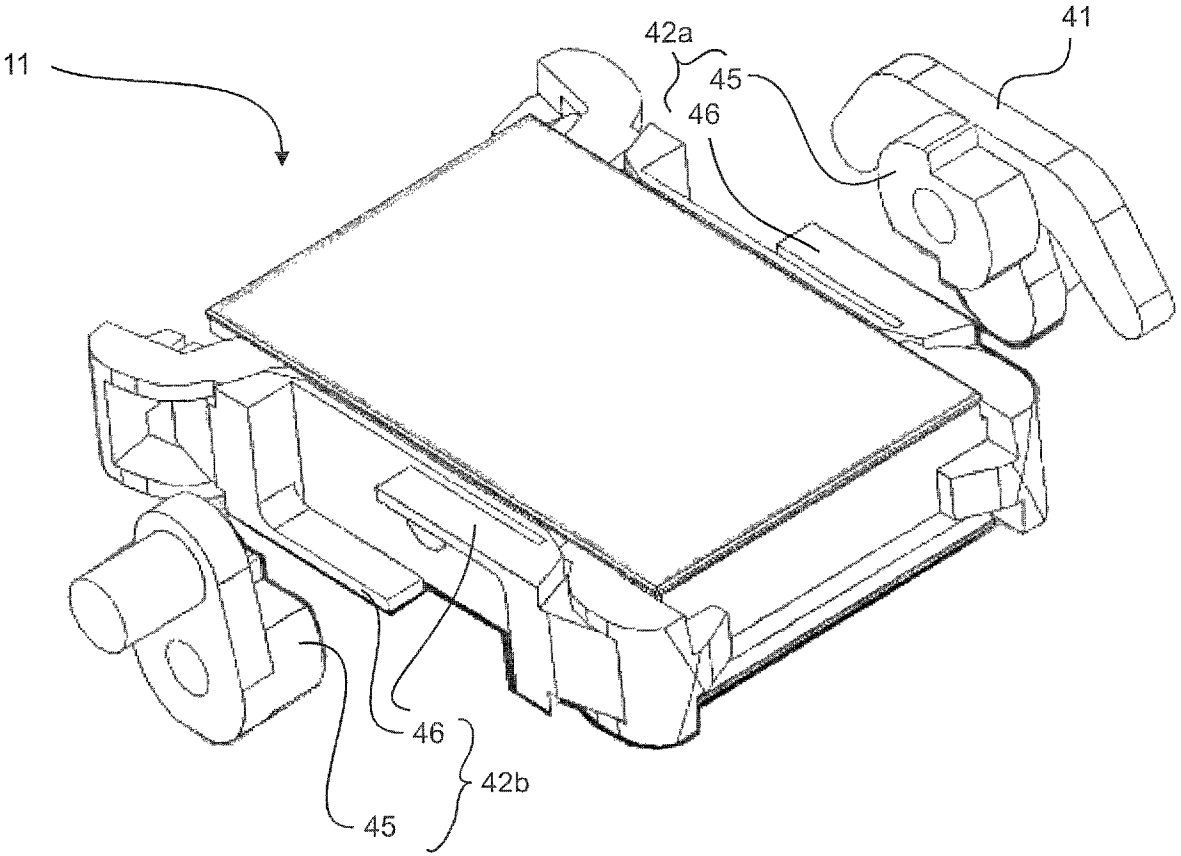

FIGS. 25 and 30 show the adhesive tape stamp 1 in a fifth position, in which the stamp plate 11 has been retracted into the starting position. In much the same way as in the second position, the middle leg of the nose plate 41 engages the open region of the diverting kidney 44. However, in contrast to the second position, the stamp plate 11 is horizontal.

The stamp plate 11 and the nose plate 41 are jointly rotated clockwise during the downward movement of the actuating part 3 of the housing. On the other hand, during the upward movement of the actuating part 3 of the housing, the nose plate 41 is returned counterclockwise on the same path as during the downward movement and the stamp plate 11 is returned without being rotated into the starting situation of the first position, where the stamp plate 11 then is disposed in a position rotated by 180° from the starting position. For the embodiment shown in FIGS. 21 to 31, this behavior is achieved by the interaction of the drive clutch 42*a* and the reversing safeguard 42*b*. The drive clutch 42*a*, located on the side of the nose guide, is engaged exclusively during the downward movement of the actuating housing 3. The rotational movement (clockwise with respect to FIGS. 21 to 24) starting out from the nose plate 41 is transferred by the circular disk 45 over the latched ratchet 40 onto the stamp plate 11. At the same time, the reversing safeguard 42*b*, located on the opposite side of the stamp plate, runs freely, the ratchet being disengaged.

FIG. 31 shows a diagrammatic, exploded representation of the stamp plate 11 for use with the nose guide of FIGS. 21 to 30. At each of the flank sides, the stamp plate 11 has two ratchets 46, which are disposed parallel to one another and are constructed as free swinging latches, which are fixed only at the end.

For a modification of this example, which is not shown, the stamp plate 11 has drive clutches, which are disposed on one or both sides and may be constructed and/or arranged similarly to the drive clutch 42*a*.

The function of the reversing safeguard is fulfilled with a safeguarding element, which is constructed, for example, as a vertically aligned retaining hook with a horizontally aligned retaining nose and fastened in the actuating part 3 of the housing. The retaining nose is constructed and/or disposed to prevent any reversing of the stamp plate 11 in that it engages a recess at the front side of the stamp plate 11. During the downward movement of the stamp plate, the retaining nose is released from the recess by the inherent rotation of the stamp plate 11, so that the stamp plate 11 is rotated by the engaged drive clutch 42*a* during the downward movement. While the stamp plate 11 is being pressed onto the object, the retaining nose, tagged along with the actuating part 3 of the housing, snaps into the recess at the front of the stamp plate 11, locking the latter. During the upward movement, the drive clutch 42*a* is disengaged and rotation during the reverse direction is prevented by the snapped-in retaining element. In the starting state, the stamp plate 11 is immobilized by the retaining element, which is disengaged once again in the manner described during the next upward movement.

Figure 32:
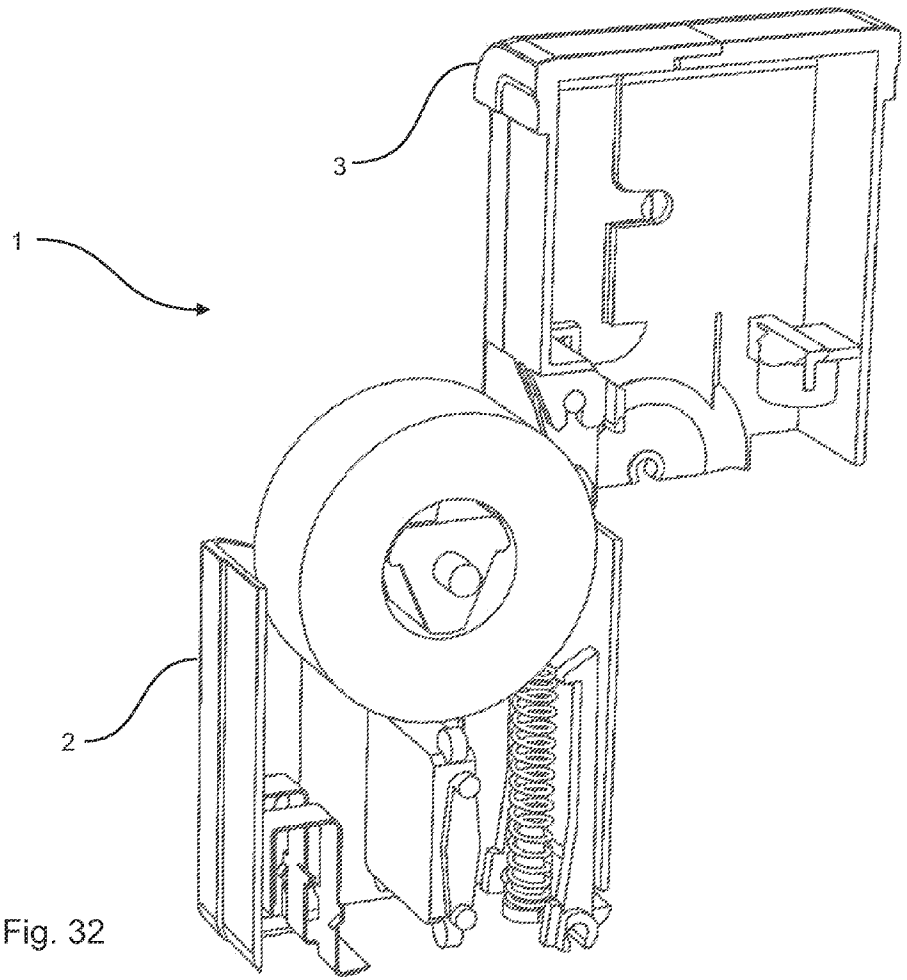
Figure 33:
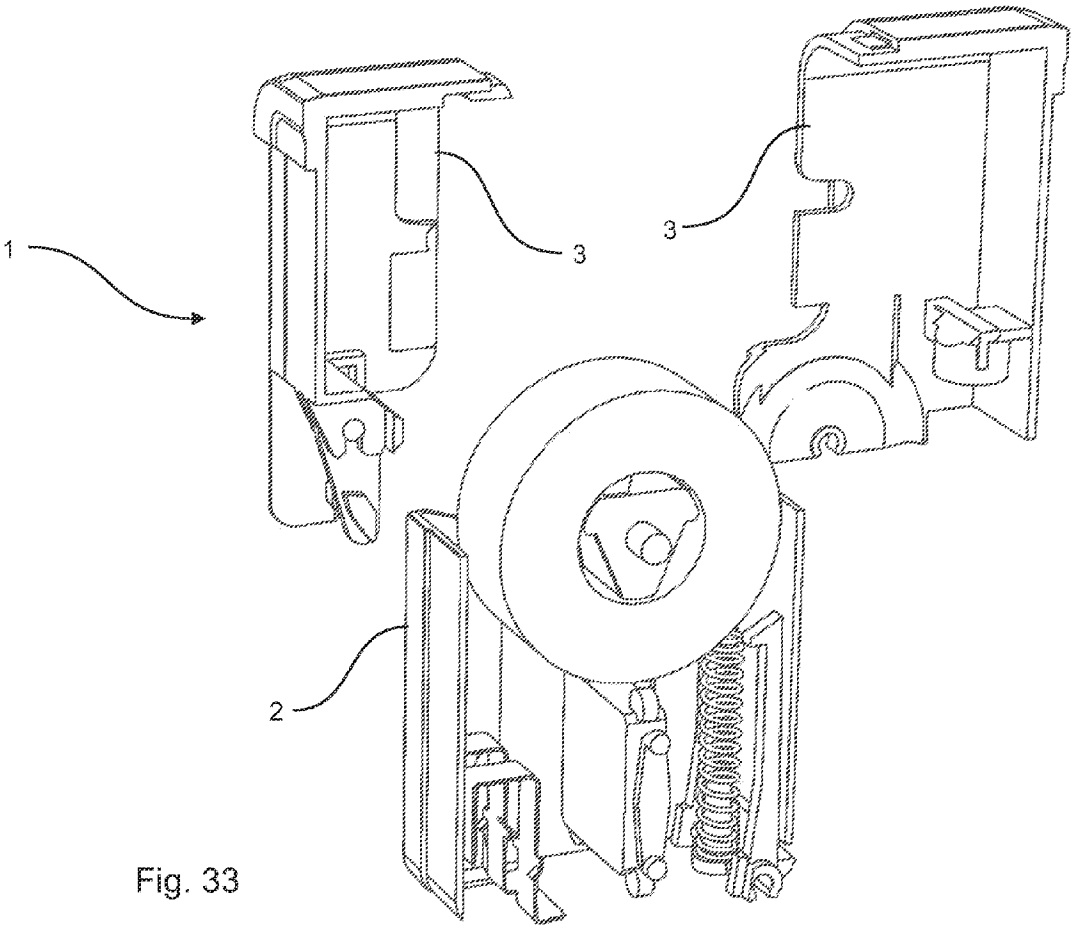
Figure 34:
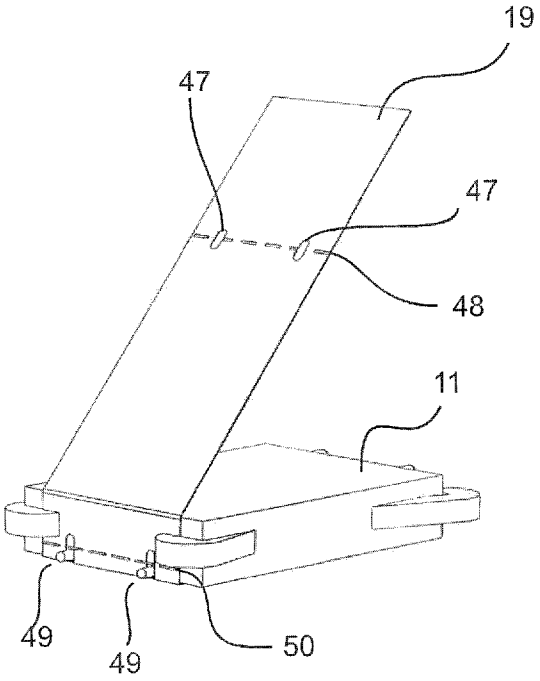

FIGS. 32 and 33 show the adhesive tape stamp 1 in the dismantled state. It can be seen that the resting part 2 of the housing is constructed as a one-part injection molded part and the actuating part 3 of the housing is constructed as a two-part injection molded part, in which the roll of adhesive tape 9 is mounted.

FIGS. 34 and 35 illustrate a use of the adhesive tape stamp 1, wherein a special construction of the stamp plate 11 is used. For this use, the adhesive tape 19 has synchronization means, which are spaced regularly in the tape direction and are constructed preferably as oval holes or elongated hole 47 and are disposed in a planned severing site 45 of the adhesive tape 19. The severing site 48 is shown by a broken line, which preferably is not constructed as a perforation. The stamp plate 11 has synchronization devices in the form of pins 49, which protrude from the front sides and the distance between which corresponds to the distance between the elongated holes 27, so that the pins 49 are threaded into the elongated holes 47. In particular, the pins 49 are positioned underneath the actual severing site 50, so that the adhesive tape 19 is severed between the clamps 10 *a, b, c* and *d* and the pins 49. This configuration enables the adhesive tape section 23 to be released from the pins 49 as the stamp plate 11 is rotated further. The adhesive tape 19 may have an imprint or a different configuration, which is divided into sections, which correspond to the distances between the elongated holes 47 in the direction of the tape and carry, for example, previously produced elements such as signatures, labels, symbols, decorations, etc. The synchronization device ensures that only adhesive tape sections are severed, which correspond to the subdivided sections of the adhesive tape 19.

Figure 36:
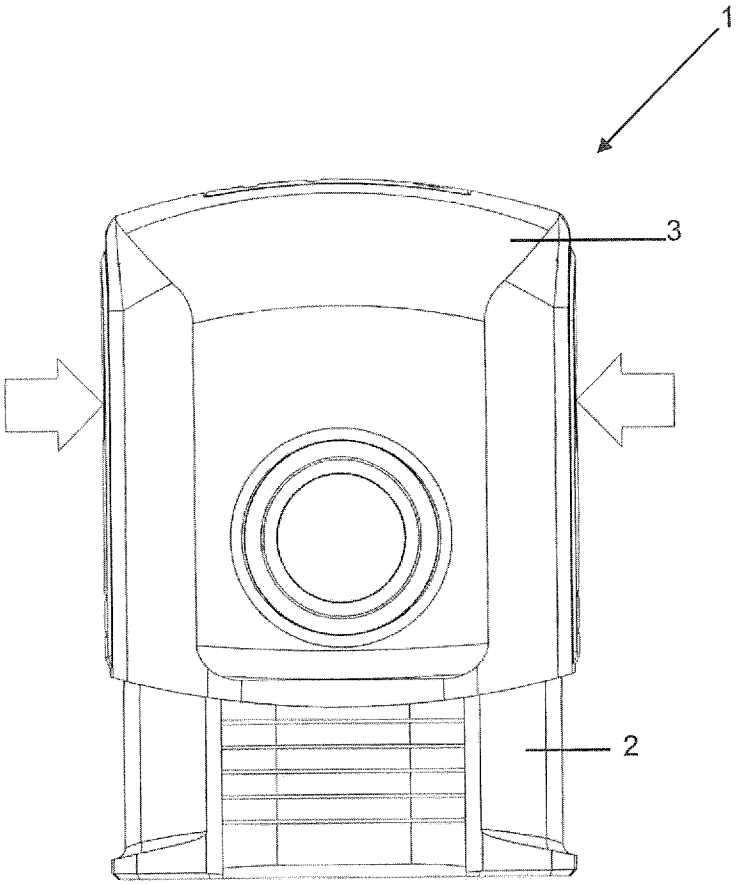

In a diagrammatic plan view from the front, FIG. 36 shows the adhesive tape stamp 1 in a further embodiment, wherein the actuating part 3 of the housing encloses the resting part 2 of the housing completely or lid-like, so that the actuating housing 3 is inverted over the resting part 2 of the housing. The actuating part of the housing is constructed in the form of a box and accommodates the resting part 2 of the housing in its interior with five closed sides. Analogously to the earlier examples, the actuating part 3 of the housing can be shifted manually relative to the substrate and to the resting part 2 of the housing in the direction of the stamp.

Figure 37:
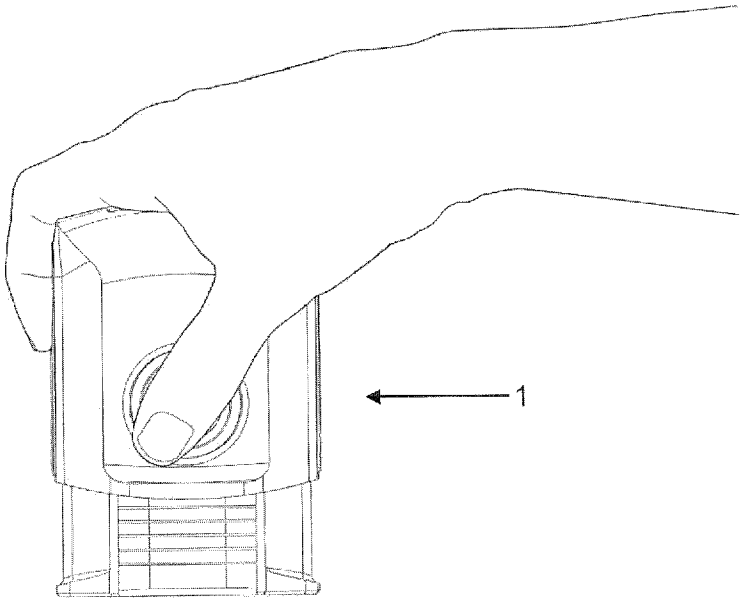

As is evident particularly from FIG. 37, which shows the adhesive tape stamp of FIG. 36 while it is being actuated with one hand, which has been drawn diagrammatically, a user can enclose the actuating part 3 of the housing by hand. During the course of the movement, the hand position does not have to be altered relative to the actuating part 3 of the housing, since all contact surfaces remain uncovered during the course of the movement.

Figure 38:
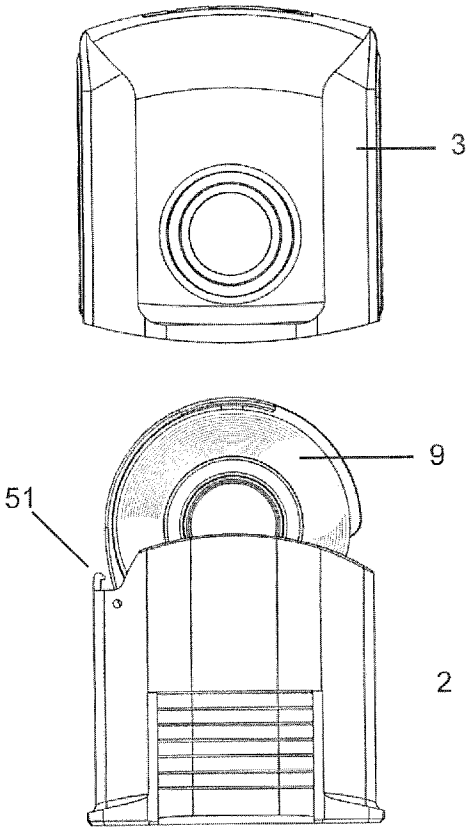

FIG. 38 shows the adhesive tape stamp of FIGS. 16 and 37 in an opened state, wherein, after a locking organ in the form of a locking hook 31 here was unlocked, the actuating part 3 of the housing was pulled from the resting part 2 of the housing counter to the stamp direction.

Figure 39:
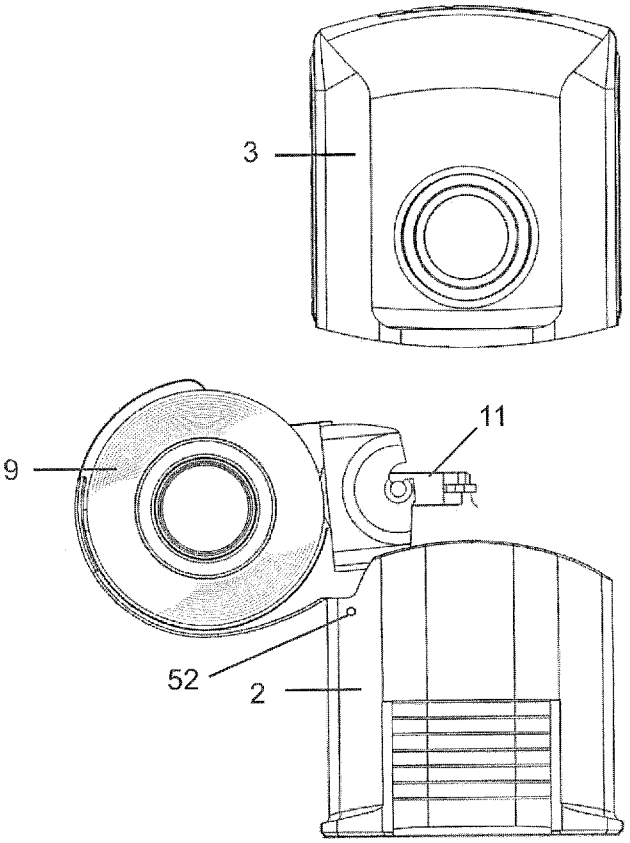
Figure 40:
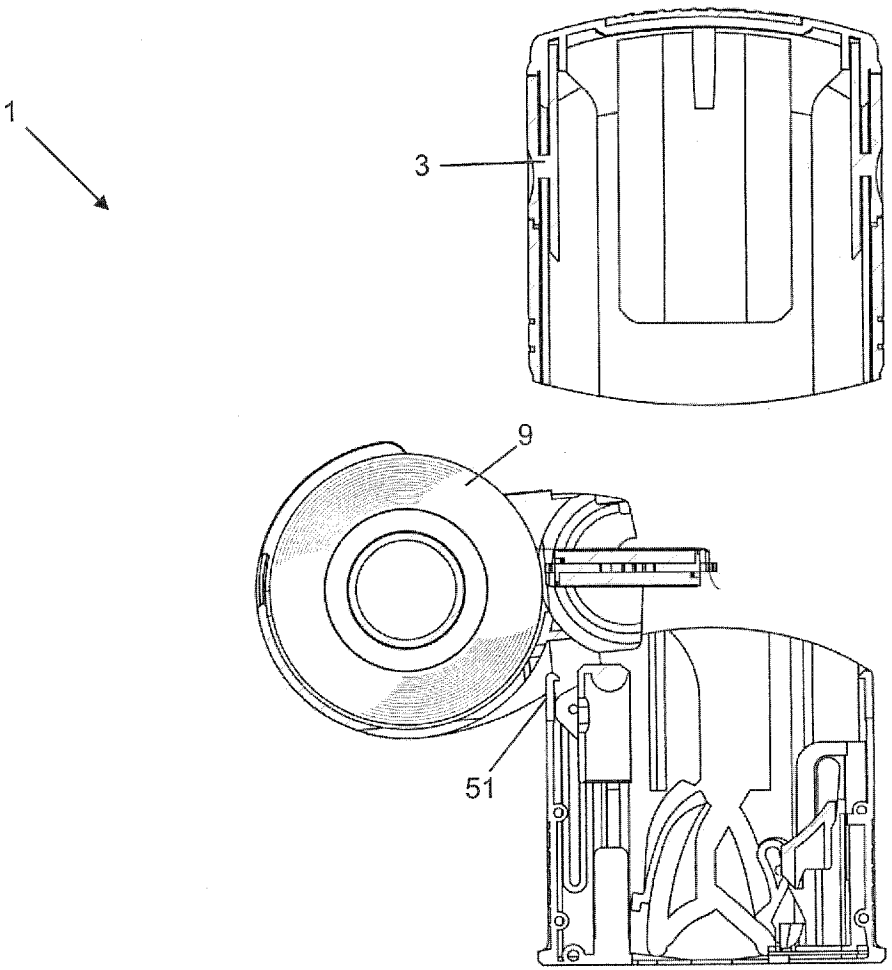

From FIGS. 39 and 40, which show a plan view or sectional view through the adhesive tape stamp 1 in FIG. 38, a swivel joint 52 can be recognized, which permits an assembly, consisting of the adhesive tape 9 or its receptacle and the stamp plate 11 to be folded out of the resting part 2 of the housing by, for example, 90°. By the chain-like and/or captive connection between the assembly and the resting part 2 of the housing, the insertion of a new adhesive tape 9 or the exchanging of adhesive tapes 9 is greatly facilitated. Likewise, the likelihood of losing components of the adhesive tape stamp 1 is decreased.

FIGS. 41, 42 and 43 show the adhesive tape stamp 1 with a mechanism, different from that of FIGS. 38 to 40, for tipping up and changing the adhesive tape 9 in a diagrammatic, lateral plan view (FIGS. 41, 42) or in a diagrammatic, three-dimensional view at an angle from above (FIG. 4). As is evident from the Figures, the actuating part 3 of the housing is constructed essentially in two parts. A first part 3*a* of the actuating part 3 of the housing shows an assembly comprising the stamp plate 11 and the roll of adhesive tape and a second part 3*b* of the actuating part forms a lid for the first part 3*a*. The first part 3*a* and the second part 3*b* are connected captively and/or chain-like with one another over a connecting organ 51 in the form of a bridge projecting from the second part 3*b*. The actuating part 3 of the housing is coupled analogously over a second connecting organ with the resting part 2 of the housing.

When a new adhesive tape 9 is inserted or adhesive tapes 9 are exchanged, the actuating part of the housing is unlocked and pulled out of the resting part 2 of the housing. In a next step, the actuating part 3 of the housing is opened in that the first part 3*a* is separated from the second part 3*b*. In the opened state, the adhesive tape 9 can simply be exchanged. This embodiment has the advantage that the adhesive tape stamp 1 can be dismantled advantageously, in order to exchange rolls of adhesive tape and to get the start of the tape ready and inserted for the sequence of functions. A combined linear tilting motion is required to open the housing. During the opening process, after the unlocking, the actuating part 3 of the housing is pulled linearly out of the resting part 2 of the housing. At the same time, for example, the adhesive tape stamp 1 rests on one of its side surfaces. The resting part of the housing 2 and the actuating part of the housing 3 are held together by mechanical connecting organs 54, so that these parts of the housing can be pulled apart by their own covering, in order to produce space for inserting the tape. The connecting organ 54 can be pushed and/or swivel. As a first component 3*a*, the actuating part 3 of the housing has a roll carrier and, as a second component 3*a*, a covering and these are connected with one another by a swivel joint. The position of the axis of the swivel joint makes it possible to open the actuating part 2 of the housing and to insert the tape. The swiveling angle is, for example, between about 90° and 180°. Preferably, the second part 3*b* rests on the substrate during the opening.

The constructions of the housings and FIGS. 36 to 43 can be used for any type of adhesive tape stamp 1, and especially for any type of mechanism.

FIGS. 44 to 47 show a further example of the adhesive tape stamp 1 in a diagrammatic, three dimensional representation, wherein parts of the housing are suppressed. For this embodiment, the housing may be constructed in any way, but especially in the form of one of the preceding embodiments shown.

The adhesive tape stamp 1 has a stamp plate 11, which is disposed in the projection space underneath the roll of endless tape 1 in the direction of the stamp 1. As is evident when FIGS. 44 to 47 are looked at together, the stamp plate 11 is supported and/or hinged in the actuating part 3 of the housing. For controlling the stamp plate 11 and/or for clamping the adhesive tape 19 at the stamp plate 11 during the course of the movements, the adhesive tape stamp 1, in this embodiment, has clamping levers 55, which are supported and/or hinged in the resting part 2 of the housing. The clamping levers 55 may assume a double function namely, on the one hand, of clamping the adhesive tape 19 and, on the other, of controlling or driving the clamping plate 11. There are various possible alternatives for the kinematics. Either the clamping levers 55 or the stamp plate 11 or both are controlled jointly by devices at the housing. In the event that any clamping levers 55 or the stamp plate 11 are controlled by devices at the housing, provisions may be optionally made so that in each case the other partner is pre-tensioned, for example, by elastic devices or runs along only passively.

At their free ends, facing away from the swiveling axis, the clamping levers 55 have a clamping organ 56 or 57, which is semicircular or circular in cross-section. The clamping organs 56 and 57 are constructed complementarily to one another in such a manner that they can engage one another and form a common swiveling axis or axis of rotation, for example, in order to permit the stamp plate 11 to be handed over to the position shown in FIG. 44.

Figure 46:
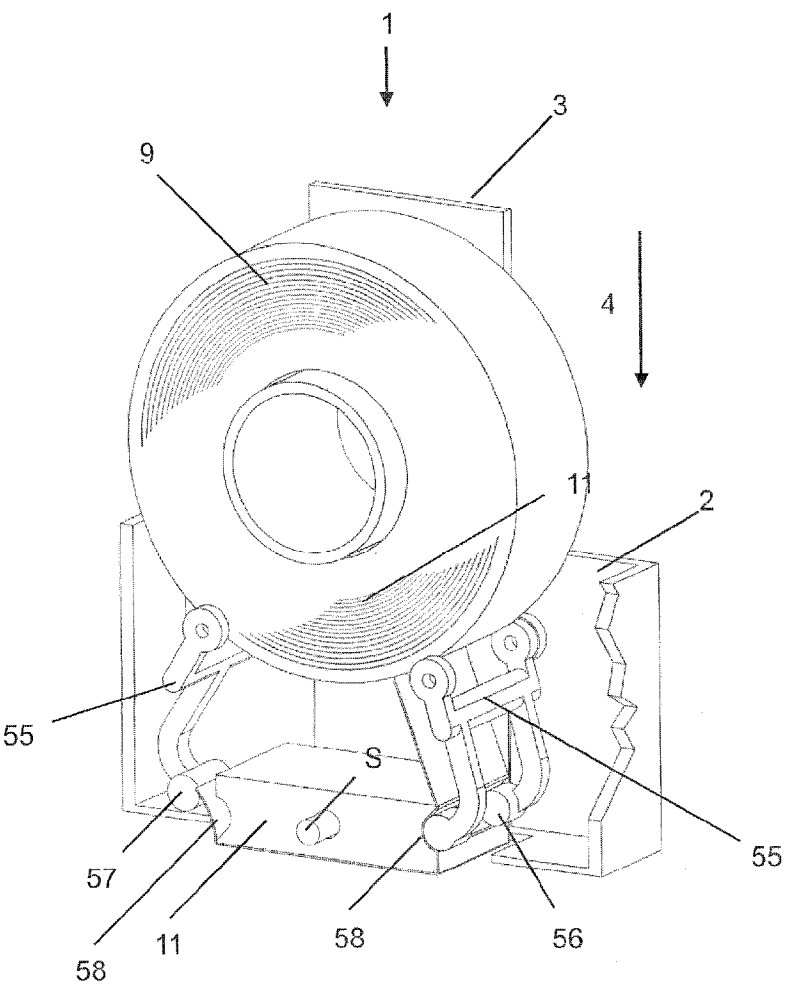

As can be inferred particularly well from FIG. 46, the clamping organ shows two laterally disposed clamping sections with a free region in between. The free region is constructed in such a way that, with a central clamp section, the clamping organ 57 can engage the free interstice. The clamping sections of the clamping organs 56 and 57 supplement one another to form a rod-like formation.

For the embodiment of the adhesive tape stamp 1 of FIGS. 44 to 47, the endless adhesive tape 19 is clamped by the interaction of a clamping partner, which is hinged in the housing, with a second clamping partner, which is realized by a front side of the stamp plate 11. The front side of the stamp plate 11 has a hemispherical groove 58, especially one which is complementary to the clamping organs 56 and 57, wherein the adhesive tape 19 is clamped in the groove by the clamping organ 56 or the clamping organ 57 or both together. The shape of the clamping organs 56 or 57 may also be described as cylindrical or cylindrical segmental.

During the actuation of the adhesive tape stamp 1, the kinematics is driven by depressing the actuating part 3 of the housing, in which the roll of adhesive tape 9 is stored. The start of the tape is clamped by pressing the clamping organs 56 and 57 against the font side of the plate by means of the clamping levers 55. The clamping organs 56 and 57, which may also be referred to as contacting elements, form a positive connection with the groove 58 and a detachable, rotating or swiveling joint. The clamping levers 55 are disposed underneath the roll of adhesive tape and to the side of the stamp plate 11.

Figure 44:
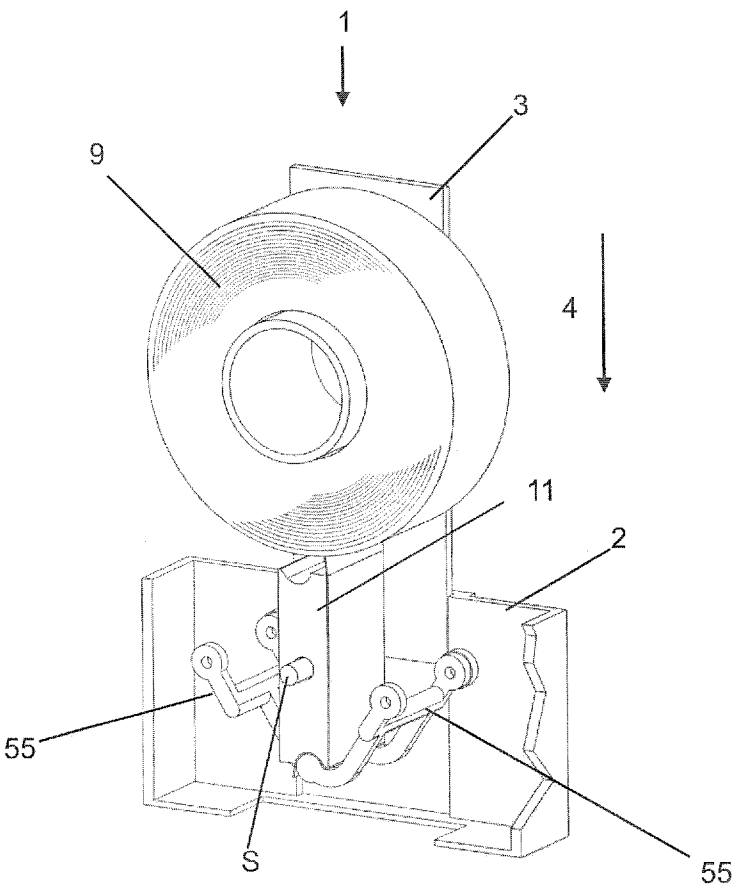

FIG. 44 shows the starting position of the adhesive tape stamp 1, wherein the stamp plate 11 is vertical and both clamping organs 56, 57 press the adhesive tape 19 against the downward pointing front side of the stamp plate 11.

Figure 45:
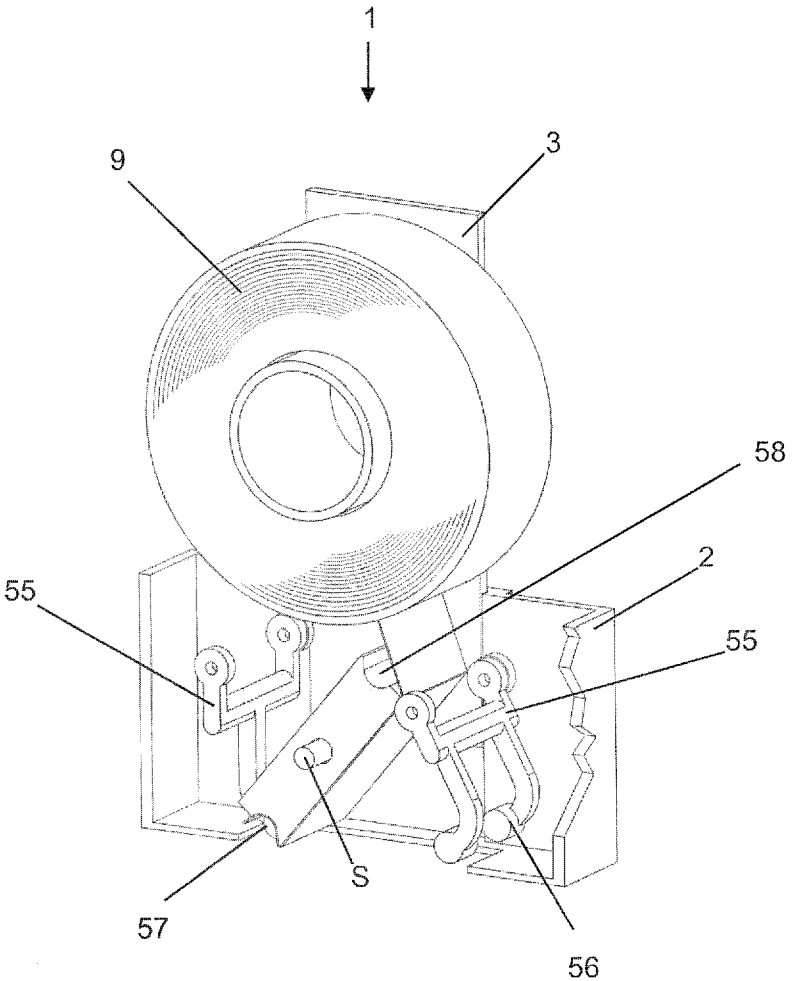

FIG. 45 shows the course of motion during a commencing downward movement, during which the right contacting lever 55 is swivelled to the outside and is detaching itself or has detached itself from the front side of the stamp plate 11. The stamp plate 11 is controlled by the left clamp lever 55 in that the latter is caused to rotate by the forced conditions at the fulcrum points in the region of the groove 58. The adhesive tape 19 is unwound from the roll of adhesive tape 9 by the rotation, in that tensile forces are introduced into the adhesive tape 19 by the immobilizing groove 58 and the clamping organ 57.

FIG. 46 shows the further downward movement down to the horizontal contacting position of the stamp plate 11. In this phase, the right clamping lever 55 swivels back to the front side of the plate and fixes the adhesive tape 19 by means of a positive connection between the groove 58 and the clamping organ 56. In the region of the immobilization, the adhesive tape 19 is severed completely by a cutting device, which is not shown, in the stamp direction 4 underneath the clamping of the adhesive tape 19. At the same time, the left clamping lever 55 swivels to the outside and releases the free end of the tape. The free adhesive tape section 23 is pressed onto the substrate.

Figure 47:
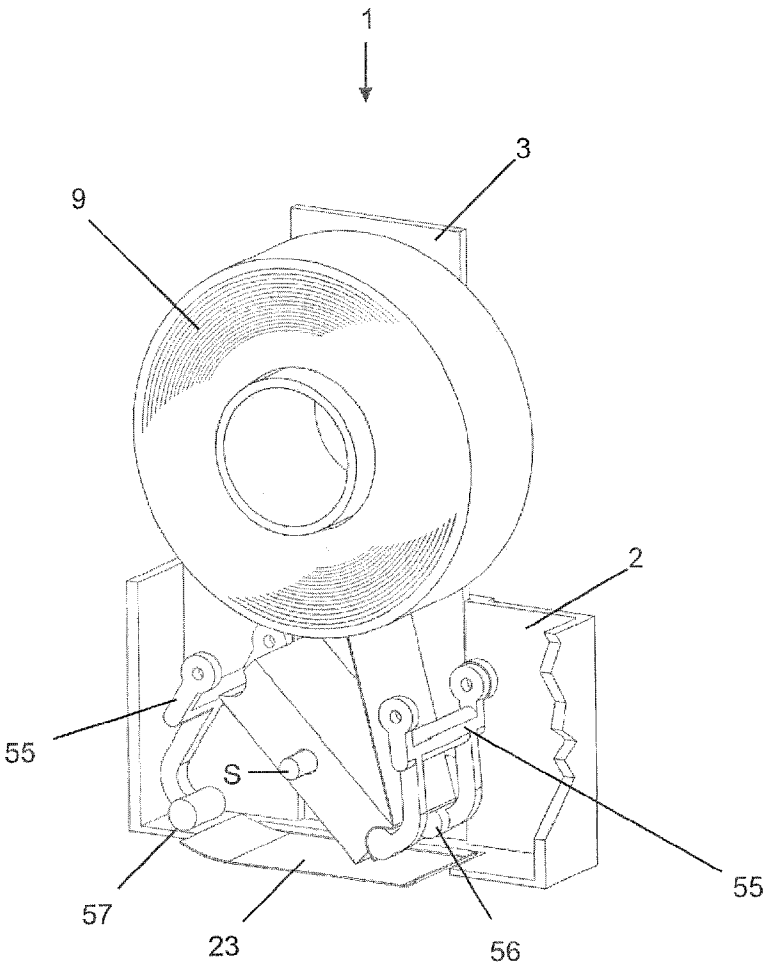

FIG. 47 finally shows the return movement of the stamp plate 11 together with an upward movement of the actuating part 3 of the housing, when the right lever 55, together with the groove 58, once again forms a rotating and/or swiveling joint and, on the one hand, guides the stamp plate 11 back into the starting position of FIG. 44 and, on the other, by clamping the tape, unwinds adhesive tape 19 from the roll 9.

After the upward movement, the adhesive tape stamp 1 is once again in the starting position shown in FIG. 44.

FIGS. 48 to 51 show a further example of the adhesive tape stamp 1 wherein, for the purpose of a simplified representation, only the roll of adhesive tape 9, the stamp plate 11, the severing device 12 and a feeding device 59 are shown. The roll of adhesive tape 9 and the stamping device 11 are mounted and/or hinged in the actuating part of the housing. On the other hand, the severing device 12 and the supplying device 59 are immobilized, mounted or hinged in the resting part of the housing.

In contrast to the earlier embodiments, the adhesive tape stamp 1 or the stamp plate 11 has a clamping device 60, which is carried along with the stamp plate 11, at only one free side. The clamping device 60 is realized by a clamping organ 61 which, together with the front side of the stamp plate 11, permits a frictional immobilization of the adhesive tape 19 by clamping at the front side of the stamp plate 11. Accordingly, both clamping partners of the clamping device 60 are moved along with the stamp plate 11. The other, free side of the stamp plate 11 has, for example, a groove-like or channel-like molding 62, which interacts with a blade 13 of the severing device 12, which points in the direction of the stamp. This will still be described in the following.

Figure 48:
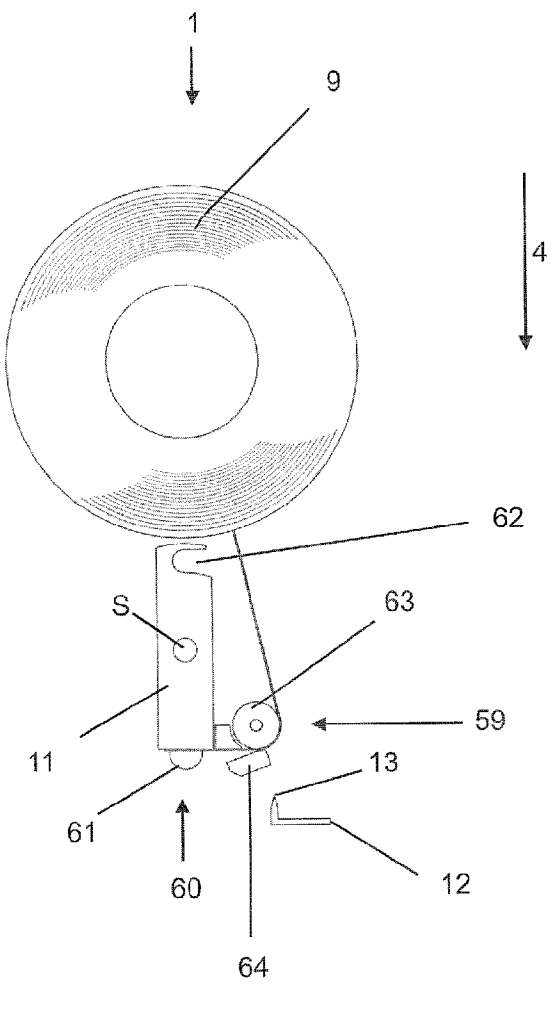

The supplying device 59 comprises a deflection roller 63, which is constructed for the temporary immobilization of the adhesive tape 19. The tape clamping 64 is formed by two clamping jaws, which can be moved towards one another. For the actuation of the adhesive tape stamp 1 in FIGS. 48 to 51, the stamp plate 11 is in the starting position, as shown in FIG. 48, parallel to the stamp direction 4, that is, the stamp plate 11 is vertical. The adhesive tape 19 runs from the roll of adhesive tape 9 around the deflection roller and through the opened tape clamping 64 and is immobilized temporarily at the side surface of the stamp plate 11, which is facing away from the roll of adhesive tape 9.

Figure 49:
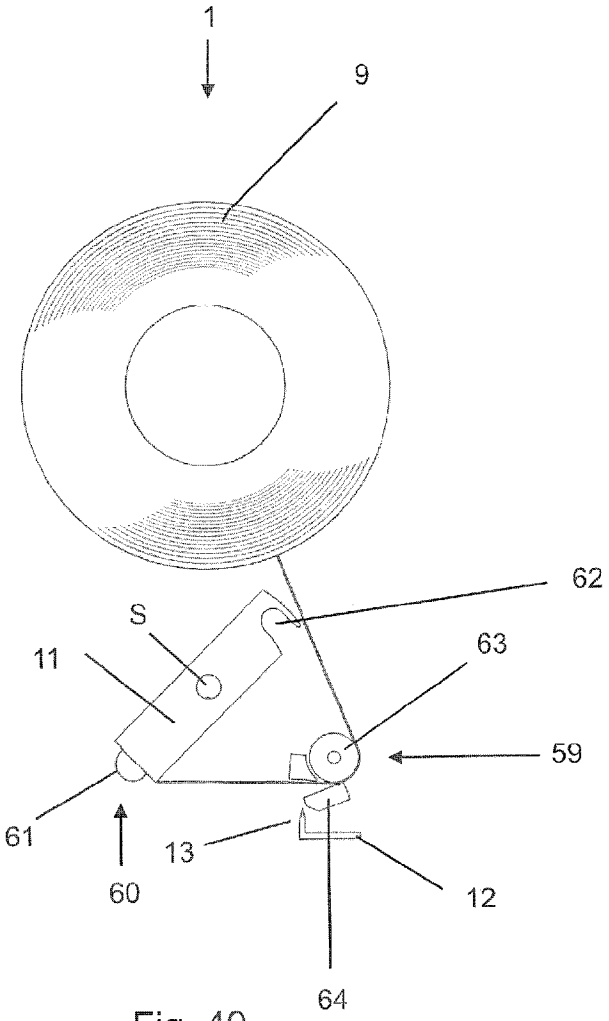

FIG. 49 shows the adhesive tapes stamp 1 during the downward movement. The supplying device 59 has moved relative to the clamping device 22, war shifted especially linearly and/or swiveled about an axis of rotation (not shown) in order to bring the outlet region for the adhesive tape 19 of the tape clamping 64 into the region of the blade 13 of the severing device 12. The stamp plate 11 has carried out a rotation of about 40° about its own axis of rotation.

Figure 50:
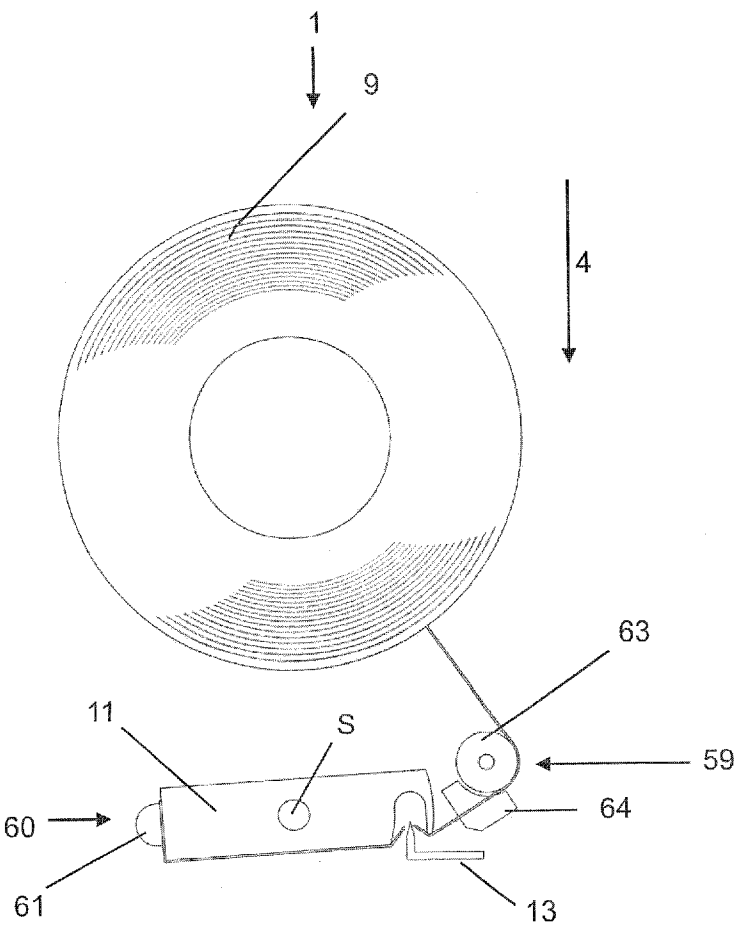

In FIG. 50, the adhesive tapes stamp 1 can be seen in a sectional or delivery position, wherein the stamp surface of the stamp plate 11 is pressed almost onto the substrate and the tape clamping 64 is closed and immobilizes the adhesive tape 19. The supplying device 59 is moved further in such a manner, that the adhesive tape 19 is positioned properly relative to the severing device 22, the severing taking place through the interaction of the molding 62 and the rigid blade 13.

Figure 51:
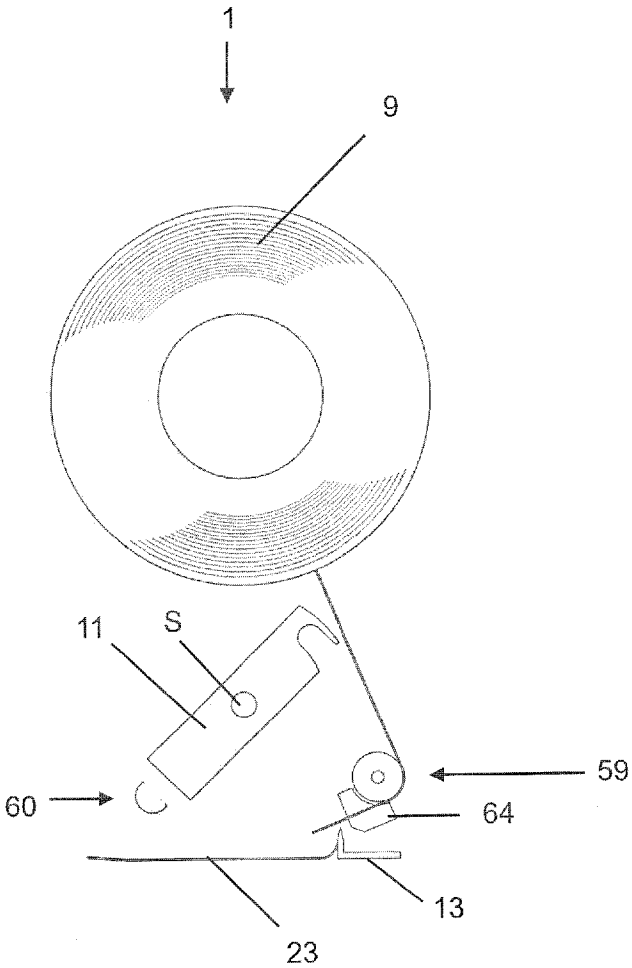

As is evident particularly from FIG. 51, the new free end of the adhesive tape 19 is immobilized in a defined manner by the tape clamping 64. The clamping device 60 at the end side of the stamp plate 11 is open, in order to release the adhesive tape section 23 on the substrate. At the transition from the backward movement shown in FIG. 51 to the starting position shown in FIG. 48, the free end of the adhesive tape is captured in the tape clamping 64 by the clamping device 60 and, after the capture, is immobilized once again by clamping. Accordingly, during the return movement or rotation to the left of the stamp plate 11, the clamping device 60 is first of all opened, once again takes up the free end of the adhesive tape and is closed shortly before reaching the starting position, while the tape clamping 64 is opened once again.

Figure 52:
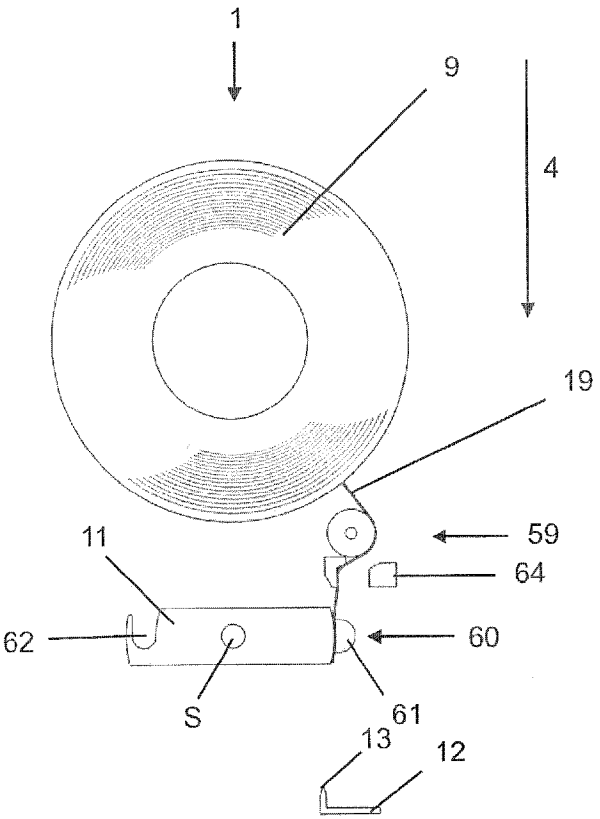
Figure 55:
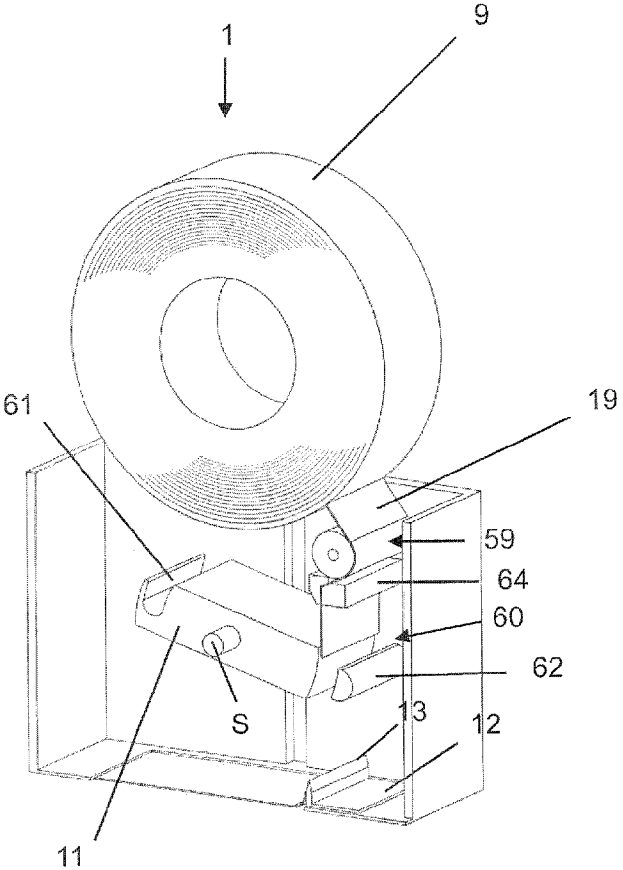

FIGS. 52 to 55 show a modification of the embodiment of the adhesive tape stamp 1 in FIGS. 48 to 51, wherein the stamp plate 11 in the starting position of FIG. 52 is in a horizontal position and the free end of the adhesive tape, which is to be captured, is aligned vertically.

Figure 53:
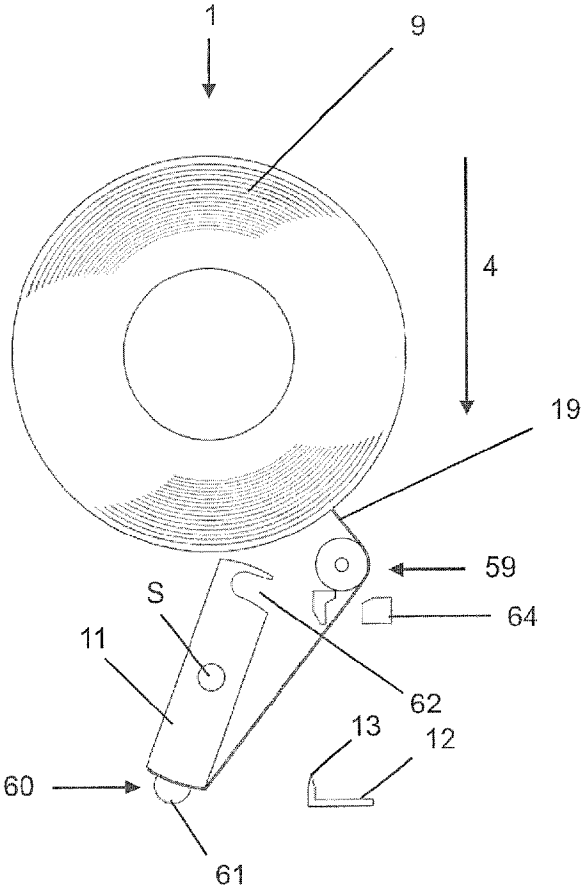

On the other hand, a similar course of movements is realized. In FIG. 52, the tape clamping 64 is open and the clamping device 69 is closed. Upon actuating the adhesive tape stamp 1, the stamp plate 11 rotates clockwise and is shifted linearly in the direction of the stamp for, the adhesive tape 19 being pulled off from the roll 9 (FIG. 53).

Figure 54:
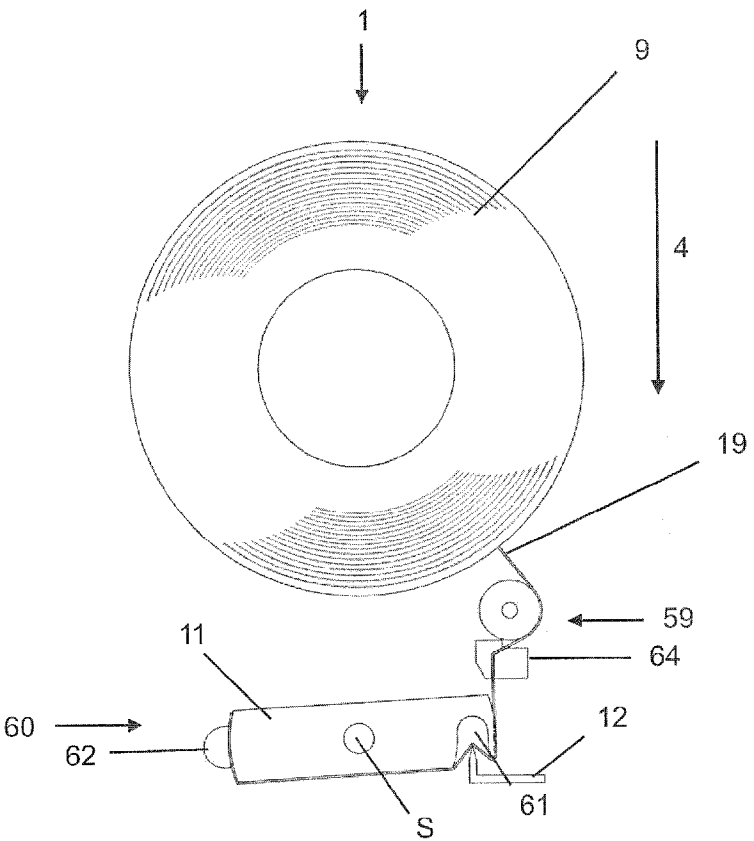

FIG. 54 shows the position of the adhesive tape stamp 1 corresponding to that of FIG. 50. The tape clamping 60 is closed and, in a next step, the clamping device 60 is opened to release the free adhesive tape section 23. During the return movement of the adhesive tape stamp 1, shown in a diagrammatic, three-dimensional representation in FIG. 55, the free end of the adhesive tape is captured in the position shown and, after the capture, immobilized by the closing of the clamping device 60.

The embodiments of the adhesive tape stamp 1, shown in FIGS. 48 to 55, accordingly relate to an embodiment with an oscillating or reversing plate, wherein, for the embodiment in FIGS. 48 to 51, the stamp plate is rotated or swiveled through 90° and, in the embodiments of FIGS. 52 to 55 is rotated or swiveled through 180°. The supplying device 59 in the example of FIGS. 48 to 51 carries out a linear-swiveling motion in during the course of motions. On the other hand, the supplying device 59 of the example of FIGS. 52 to 54 only carries out a linear motion in the stamp direction 4 without a swiveling motion.

FIGS. 56 to 57 show a further example of the adhesive tape stamp 1, which also works with a stamp plate 11, which has precisely one clamping device 60 and wherein the clamping of the adhesive tape 19 during the backward motion of the stamp plate 11 is accomplished by a supplying device 59, which has a tape clamping 64 and is suspended in the resting part 2 of the housing. In contrast to the embodiments in FIGS. 48 to 55, the supplying device 59, especially the deflection roller 63, is positioned in the resting part 2 of the housing. The tape clamping is constructed as an L-shaped clamping jaw, which contacts the deflection roller 63 positively.

The stamp plate 11 or the clamping device 60 is positioned relative to the supplying device 59 by a superimposed linear and swiveling motion of the stamp plate 11, wherein the stamp plate 11 is swiveled through 110° in this example. Due to the symmetrically disposed axis of rotation S, the alignment of the stamp plate 11 of the clamping device 60 is adapted to the output angle of the free end of the tape clamping 64 of the supplying device 59.

In contrast to the earlier examples, for which the axis of rotation S was always disposed centrally and/or symmetrically in the stamp plate 11, the axis of rotation S of the stamp plate 11 in the examples of FIGS. 56 and 57 is disposed asymmetrically next to the groove-shaped molding 62.

In order to achieve a sufficient and special uniform contacting pressure of the stamp plate 11 on the substrate nevertheless, a contacting organ, shown here by way of example as a rectangular bridge 65, which presses on the other side of the stamp plate 11 facing away from the stamp surface, is optionally proposed in addition.

FIGS. 58 to 61 show a further modification of the adhesive tape stamp 1, for which the roll of adhesive tape 9 and the stamp plate 11 once again is suspended in the actuation part 3 of the housing. In contrast to the earlier embodiments, the stamp plate 11 is, however, not rotatable, but undertakes only an oscillating or lifting motion during the course of motions.

On the other hand, the adhesive tape 19 is positioned by a pivotably suspended or mounted swiveling clamping 66, which in this example is mounted in the resting part 2 of the housing independently of the stamp plate 11. The swiveling clamping 62 has two clamping rolls or clamping surfaces, which are disposed parallel to the adhesive tape 19 and perpendicularly to the advancing direction of the adhesive tape 19 and, by moving towards one another, can exert a clamping effect on the adhesive tape 19 lying between them, in order to make a frictional immobilization of the adhesive tape 19 possible. The swiveling clamping 66 is disposed at a locking lever 67, which is mounted so that it can swivel or oscillate.

Moreover, the adhesive tape stamp 1 has a supplying device 59 with a tape clamping 64, wherein the tape clamping 64 is constructed as a pivotably mounted L-shaped clamping piece, which contacts the deflection roller 63 due to the clamping movement.

Figure 58:
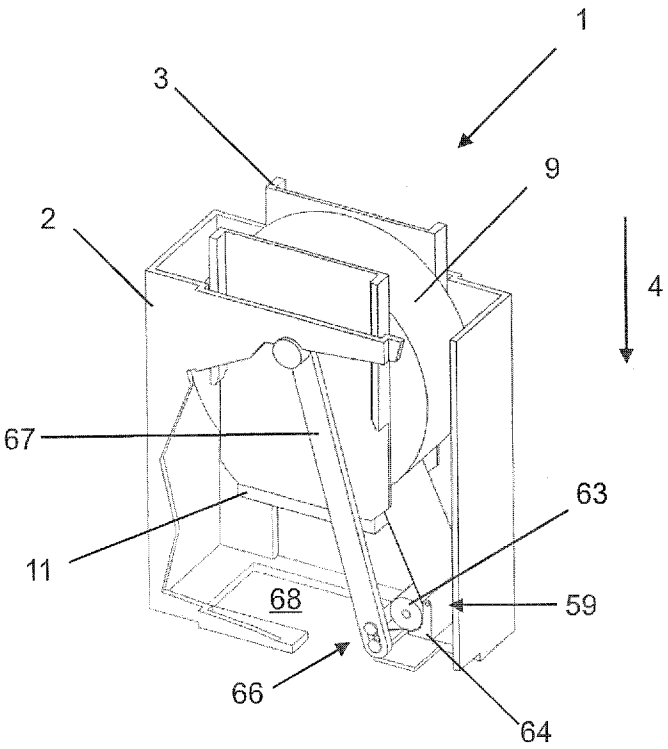

Starting out from the starting position in FIG. 58, the adhesive tape 19, coming around the deflection roller 63 from the roll of adhesive tape 9, is diverted by the swiveling clamping 66 in the stationary supplying device 59 and made available to the swiveling clamping 66, which captures the free end of the adhesive tape. In the starting position, shown in FIG. 58, the tape clamping 64 is closed and the swiveling clamping 66 is open.

Figure 59:
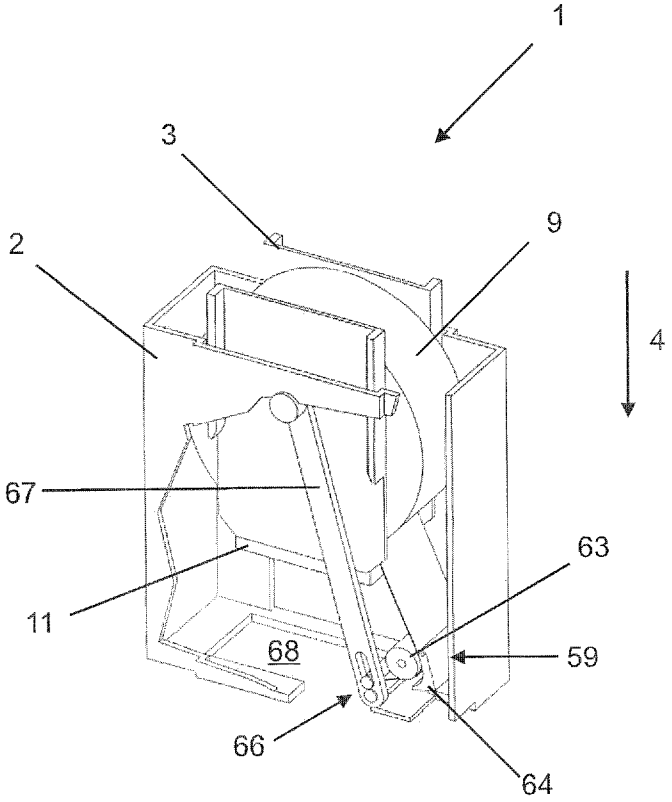

In the section of the course of the movement, shown in FIG. 59, the tape clamping 64 is open and, on the other hand, the swiveling clamping 66 is closed, so that the free end of the adhesive tape can now be immobilized by the swiveling clamping 60.

Figure 60:
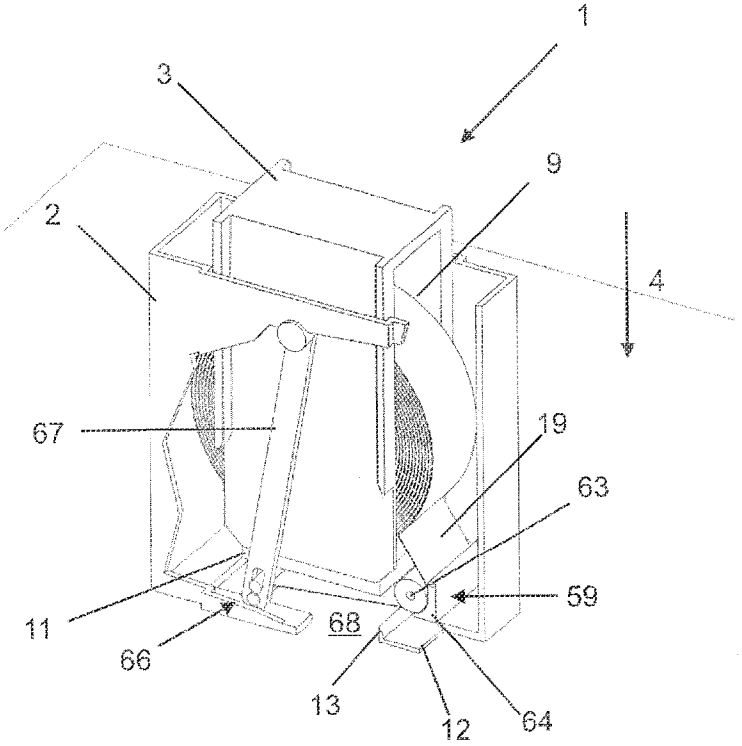

In the section of the movement, shown in FIG. 60, a back and forth swiveling of the rocking lever 67 and, with that, of the swiveling clamping 66 is achieved by a downward movement of the actuating part 3 of the housing in the direction of the stamp 4. Because of the swiveling, the adhesive tape 19 is pulled from the roll of adhesive tape 9 and positioned over a recess 68, which functions as a passage to the depositing surface for the free adhesive tape section 23 and is recessed in the housing in the lineup surface.

Figure 61:
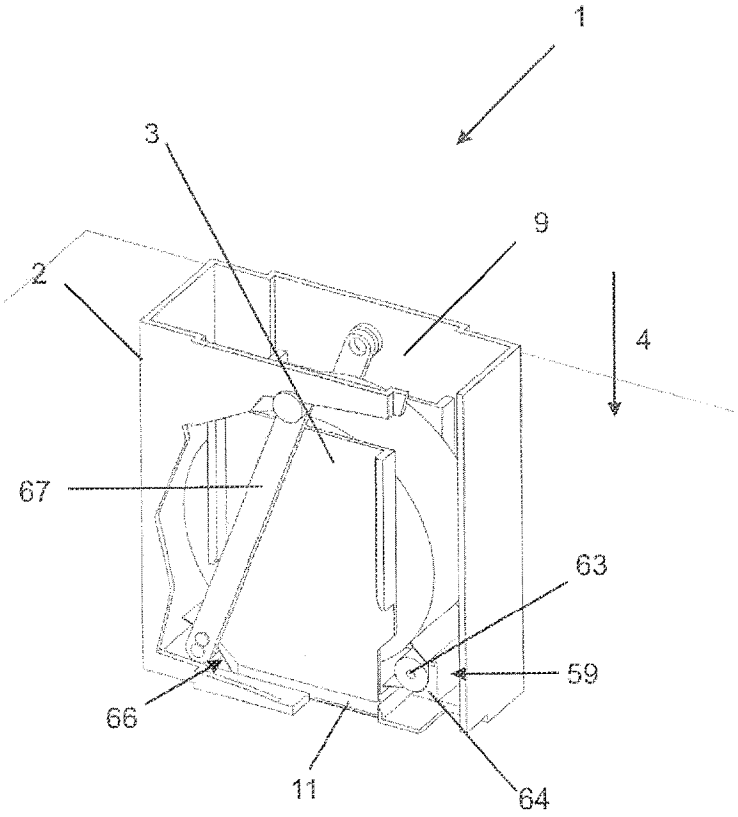
Figure 62:
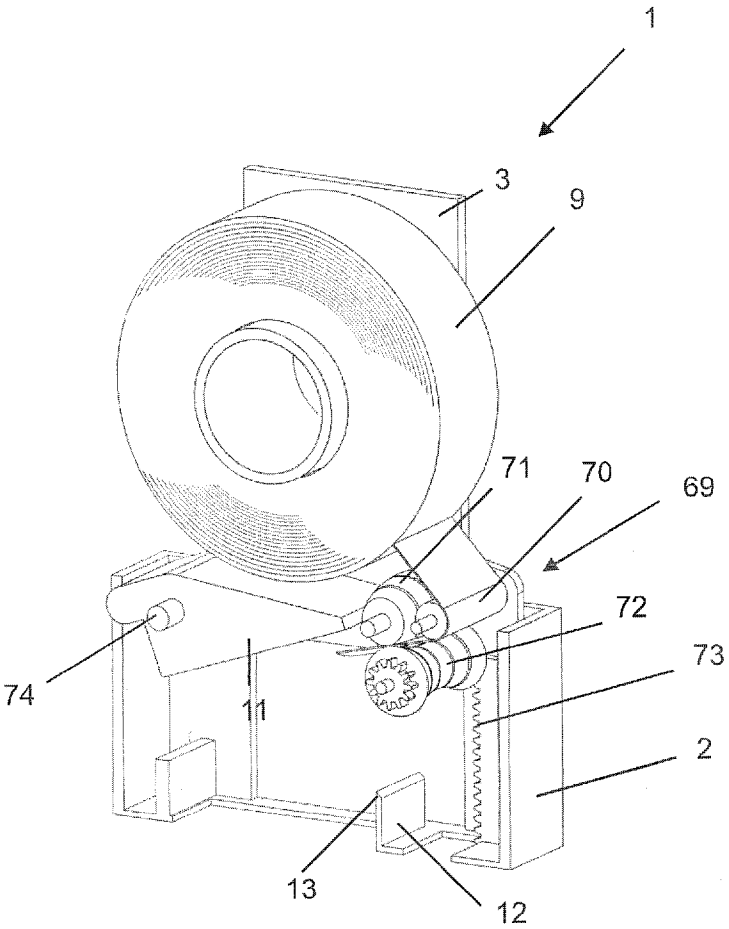

In the step shown in FIG. 61, the stamp plate 11 is pressed onto the adhesive tape 19 and, with that, onto the substrate and the adhesive tape 19 is cut off in the region of the supplying device 59 by a severing device 12, which comprises a vertically upward pointing blade 13. In the further course, the swiveling clamping 66 is opened and the tape clamping 64 is closed as soon as the swiveling motion of the rocking lever 67 is concluded. During the backward motion, the rocking lever 67 is moved back into the starting position and, with the opened swiveling clamping 66, takes hold once again of the now newly free end of the adhesive tape 19. With that, the adhesive tape stamp 1 once again is in the starting position of FIG. 58.

FIGS. 62 to 64 show a further example of the adhesive tape stamp. As in the embodiment of FIGS. 59 to 61, the stamp plate 11 does not have a clamping function. The adhesive tape 19, on the other hand, is made ready by a roller conveying system 69, which is suspended together with the roll of adhesive tape 9 in the actuating part 3 of the housing and driven by means of a toothed rack or the like in the resting part 2 of the housing.

The roller conveying system 69 comprises a deflection roller 70 and two conveying rollers 71 and 72, which, in longitudinal section, are constructed complementary to one another along the axis of rotation. The first conveying roller 71, which is disposed between the roll of adhesive 9, has a convex shape and the second conveying roller 72*a* concave shape, the two shapes engaging one another. The conveying rollers 71 and 72 are constructed in lamellar fashion or with individual discs. The individual lamellas or discs can rotate independently of one another about the axis of rotation, in order to be able to realize the different rotational speeds required by the adhesive tape 19.

The basic concept, on which this embodiment is based, is that the driven pair of rollers, consisting of the conveying roller 71 and 72, pulls off the adhesive tape 19 from the roll of adhesive tape 9 and holds and immobilizes it during the severing process. As a result of the profiling of the conveying rollers 71 and 72, the adhesive tape is provided with a transverse curvature, which makes it rigid in the longitudinal direction. Because of the rigidity, the end of the adhesive tape can protrude freely from the conveyor roll 71, 72, being held only on one side. The end of the adhesive tape is made available for deposition on the substrate by the free extension.

FIG. 62 shows the starting position of the adhesive tape stamp 1. During the actuation, the roller conveying system 69 is moved along the tooth contouring 73 into the resting part 2 of the housing, the conveyor rollers 71 and 72 being driven so that a free end of the adhesive tape slips out.

As is evident particularly from FIG. 63, the free end of the adhesive tape is moved at an angle between horizontal and perpendicular, so that its free end section contacts in the vicinity of or at the substrate.

In the starting position, the stamp plate 11 assumes an angle, so that the stamp surface is disposed approximately parallel to be free end section of the adhesive tape in the moved out state. On the side opposite to the roller conveying system 69, the stamp plate 11 is mounted so that it can be rotated.

After or during the downward motion of the stamp plate 11, the free section of the adhesive tape, commencing with the free end, is placed on the substrate. Subsequently, as is evident from FIG. 64, the stamp plate 11 is swiveled about the asymmetrically positioned axis of rotation 74. At the same time, on the one hand, the free section of the adhesive tape is pressed onto the substrate. On the other, by the interaction of a severing device 12, which is stationary in the resting part 2 of the housing, with the free end of the stamp plate 11, which faces away from the axis of rotation 74 and functions as a second severing partner, a complete severing of the adhesive tape 19 is carried out. During the return movement of the stamp plate 11 into the starting position as in FIG. 62, the adhesive tape 19 is clamped by the roller conveying system 69. As in the preceding examples, the adhesive tape is transported without damage or destruction with the exception of the complete severing by the severing device 12.

FIGS. 65 to 75 show different surface structures for the contact areas between the adhesive tape 19 and regions of the adhesive stamp 1, especially the stamp surface, deflection rollers, etc. Such surface structures are preferably used, when the adhesive tape stamp 1 is used with a so-called double-sided adhesive tape, that is, an adhesive tape coated on both sides, without additional liners.

The use of a double-sided tape together with the adhesive tape stamp 1 has great advantages, since contamination of the adhesive tape during storage is avoided and precise tape sections, economic and simple handling and a high operating speed and the avoidance of waste, especially the avoidance of useless liners are achieved.

For a first possibility, the contact surfaces have low adhesion properties due to the low surface energy of the materials used. Preferably, the surface energy is lower than the surface energy of Teflon with a surface energy of less than 20 $mJ/m^2$.

A supplementary or alternative possibility is the decrease in the adhesion properties by adhesive, geometric covering structures, especially reliefs, which, on the one hand, have a low contact area with the tape, so that the detachment force from the surface is less. Preferably, about 3% to 15% of the basic surface is contact surface.

Further supplementary or alternative measures include a pronounced surface pattern, which requires low detachment forces due to the geometry or the particular configuration of the pattern, or a configuration, for which the edge of the pattern has a lower tendency to adhere than does the center, so that the adhesive tape can be detached or peeled off more easily in the edge regions.

Figure 65:
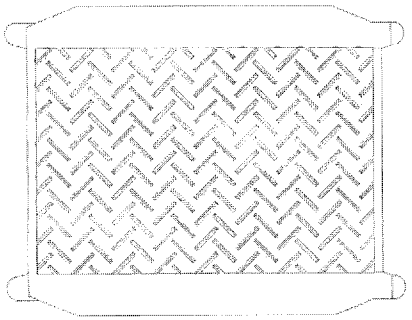

By way of example, FIG. 65 shows a sort of herringbone pattern wherein, in this example, the herringbone structures are aligned perpendicularly to the longitudinal extent of the adhesive tape 19.

Figure 67:
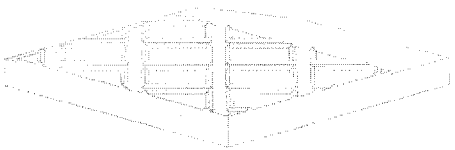
Figure 66:
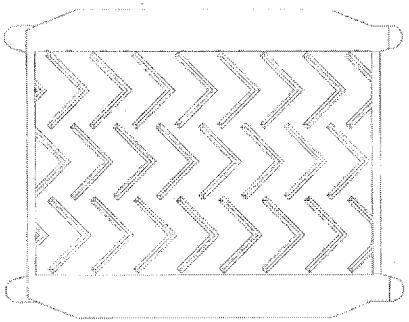
Figure 70:
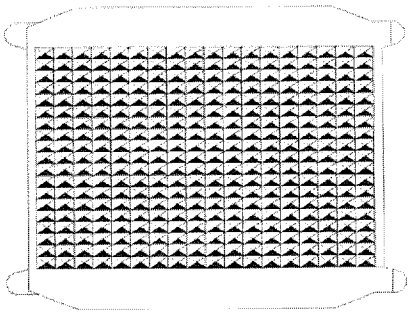
Figure 69:
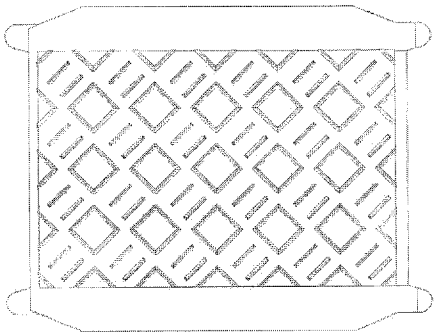
Figure 68:
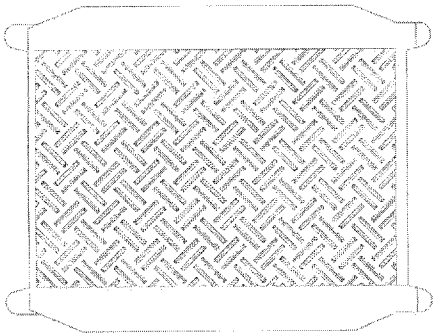

FIG. 66 shows angular, hook-like or arrow-like relief elements, which point in the direction of the longitudinal extent of the adhesive tape. On the other hand, FIG. 67 shows a frame-like relief, which is rotated by 45° to the longitudinal extent of the adhesive tape, so that, once again, a corner of the right angle points in the longitudinal direction. On the other hand, FIG. 68 shows a linen pattern and plate 69 a mixed form. Pyramid-like reliefs are shown in FIG. 70, the contact area being formed only by the peaks of the pyramids. Plate 71 shows a structure similar to that of FIG. 67, wherein the relief is realized as a square frame. FIG. 72 shows a honeycomb pattern. FIG. 73 shows a relief with regular burls arranged in rows and gaps. FIG. 74 shows a relief structure with burls of different sizes, which are distributed randomly or arranged chaotically. FIG. 75 shows an embodiment similar to that of FIG. 73, wherein, however, relief elements with a triangular cross-section are disposed.

FIGS. 76 to 78 show further alternative embodiments for a stamp plate 11, which can be used in an inventive adhesive tape stamp or in adhesive tape stamps of any of the preceding Figures. In the embodiments of the adhesive tape stamp with one-sided clamping shown, the stamp plates 11 of FIGS. 76 to 78 can be inserted particularly in an adhesive tape stamp 1 of FIGS. 48 to 57. In the event that the stamp plates 11, shown in FIGS. 76 to 78, have bilateral clamping, that is, clamping at both end sides and the face sides, the stamp plates can also be used in an adhesive tape stamp 1 of FIGS. 1 to 42. Basically, any stamp plate 11 can be used in any housing or construction of the adhesive tape stamp 1.

For the stamp plates 11, the tape is planned between the stamp plate 11 and the clamping function elements. Preferably, the tape is clamped at the front side of the stamp plate 11. Optionally, the front side of the stamp plate may be contoured, stepped or otherwise structured in a cross-sectional area perpendicular to the stamp surface 20, especially in such a manner that an extended or elongated zone is formed for the clamping. Preferably, the elements having a clamping function have two stable positions, namely an open position and a clamping position, and/or are constructed to be bistable. The clamping function elements preferably are held in the stable position or positions by springs. The clamping function elements are controlled, preferably, by the resting part of the housing, the clamping function elements and/or stamp plate 11 moving along a suitable geometry of the resting part of the housing.

FIGS. 76*a* and *b* show a diagrammatic side view or plan view from above of a first alternative of the stamp plate 11, wherein the clamping function element is constructed as a linearly movable element, especially as a beam 75. The longitudinal extent of the beam 75 is parallel to the front surface of the stamp plate 11. The beam 75 can be converted by a linear motion from an open position into a closed clamp position, the linear motion taking place in a plane parallel to the stamp surface 20. Preferably, the beam 75 is tied movably on one side to the stamp plate 11, in order to be able to thread the adhesive tape 19 easily when inserting a roll 9. Alternatively, a clamping beam 75 is possible, which is tied at both sides and, in the open position, opens up a plan view of the rectangular region, through which the adhesive tape 19 can be threaded. In a further alternative, the beam 75 is tied movably at both sides and open in the center, so that the two parts of the beam 75 can jam the adhesive tape 19 in the edge regions against the front side of the stamp plate 11. Preferably, the beam is guided bilaterally at the stamp plate 11.

FIGS. 77*a* and 77*b*, in a representation similar to that of FIGS. 76*a* and 76*b*, show an alternative to stamp plate 11, wherein the clamping function elements are formed as individual, pivotable clamps 76 with a construction, which is hook-shaped or angular in plan view. The swiveling motion also takes place in a plane parallel to the stamp surface 20. In the clamped position, the individual clamp 76 are swiveled over the two tape edges, so that the tape edges are clamped between individual clamp 76 and the end surface of the stem plate 11.

FIG. 78 *a* and *b* show a third alternative, however in the same representation as the preceding Figures. For the third alternative, a pivotable flap 74 is hinged as clamping function element, the axis of rotation extending parallel to the stamp surface 20 and the front side of the stamp plate 11. In a sideways plan view, the flap 78 is shaped to be complementary to the structured or contoured front side of the stamp plate 11, in order to make available a further contacting zone for the adhesive tape 19.

FIGS. 79 to 87 illustrates a further possible embodiments for a severing device 12, which can be used especially in conjunction with the adhesive tape stamp 1 in FIGS. 48 to 57 or together with any other type of adhesive tape stamp 1.

The severing device 12 may be formed, on the one hand, by a severing edge 79 at the stamp plate 11, which may be constructed, for example, in one piece at the stamp plate 11 and by a blade, which in particular is pre-tensioned, on the housing side. The blade 80 is pre-tensioned by an elastic device 81 pressing in the direction of the stamp plate 11. The longitudinal extent of the blade 80 is arranged cock-eyed to the cutting edge 79, especially in such a way that, when the adhesive tape 19 is severed, the severing edge 79 and the blade 80 make a punctiform or similar contact. Stated generally, the adhesive tape 19 is severed by a relative shear motion of two shearing edges, a first shearing edge, for example, in the form of a cutting edge 79, being fastened preferably immovably at the front side of the stamp plate 11. The shearing partner, for example, the blade 80, is fastened pivotably and/or elastically at the resting part 2 of the housing.

Figure 79:
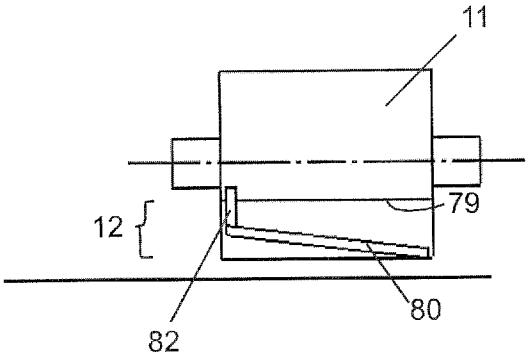

As is evident particularly from FIG. 79, which shows a diagrammatic front view of the stamp plate 11, the blade 80 is disposed at an angle to the cutting edge in this projection. FIG. 81, which shows a diagrammatic plan view of the stamp plate 11, illustrates that the blade 80 is disposed at an angle to the cutting edge also in this projection. During a cutting or shearing motion, the shearing commences at a guiding element 82, which, as can be seen best in FIG. 80, a lateral plan view of the stamp plate 11, contacts the cutting edge 79 initially and pre-tensions the elastic device 81.

Figure 80:
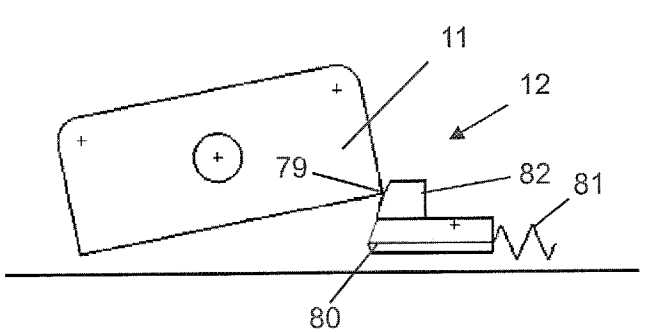
Figure 81:
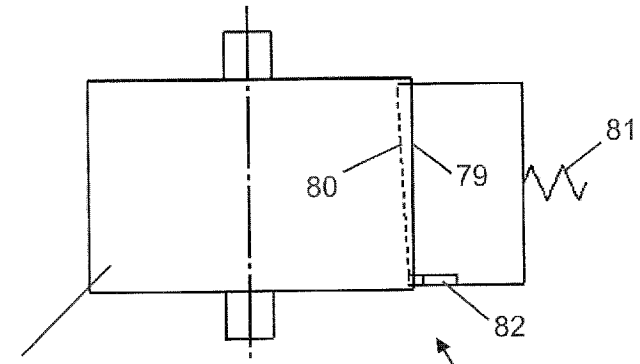
Figure 83:
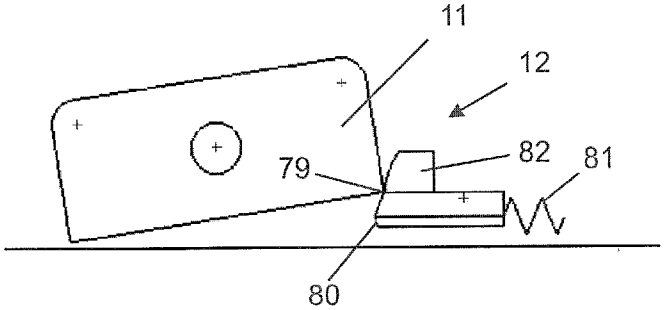
Figure 84:
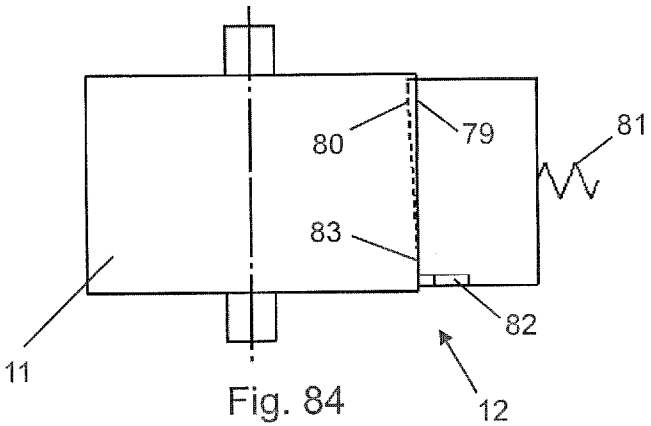
Figure 82:
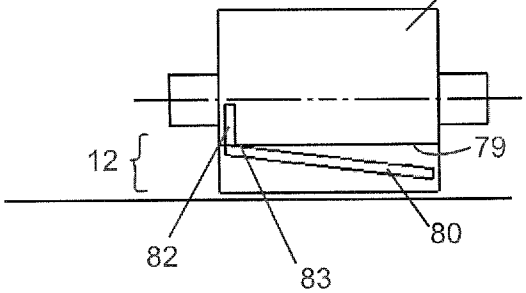

FIGS. 82, 83 and 84 show the stamp plate 11 in the same representations as in FIGS. 79 to 81, however, at the start of the shearing and cutting motion. As soon as the cutting edge 79 is level with the start of the blade 80, the shearing or severing of the adhesive tape 19 commences. As the stamp plate 11 is lowered further, the shearing point 83 shifts from the start of the blade 80 to the center and then further to the end, until the adhesive tape 19 has been severed completely. In the severed state, there is in plan view, as can be seen particularly in FIG. 87, a space which has been formed between the cutting edge 79 and the start of the blade 80.

Figure 86:
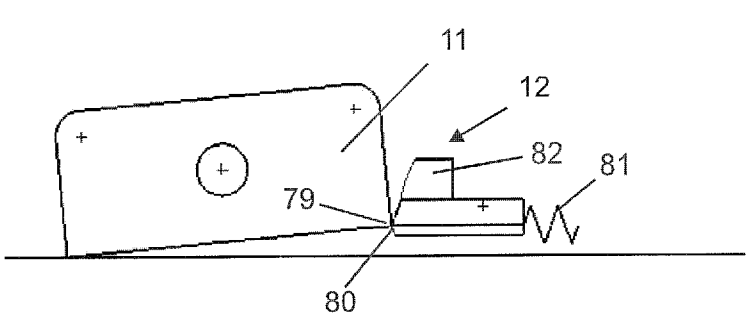
Figure 87:
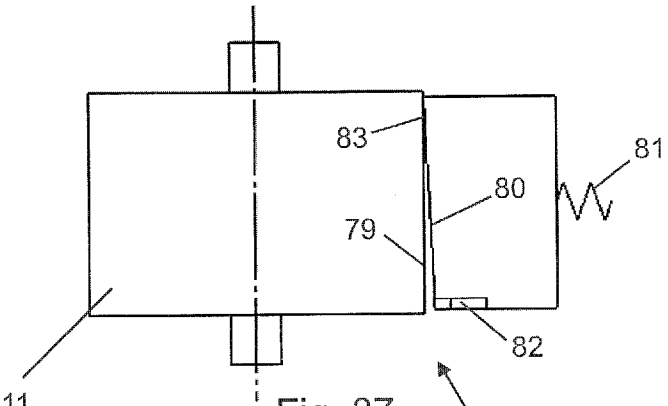
Figure 88:
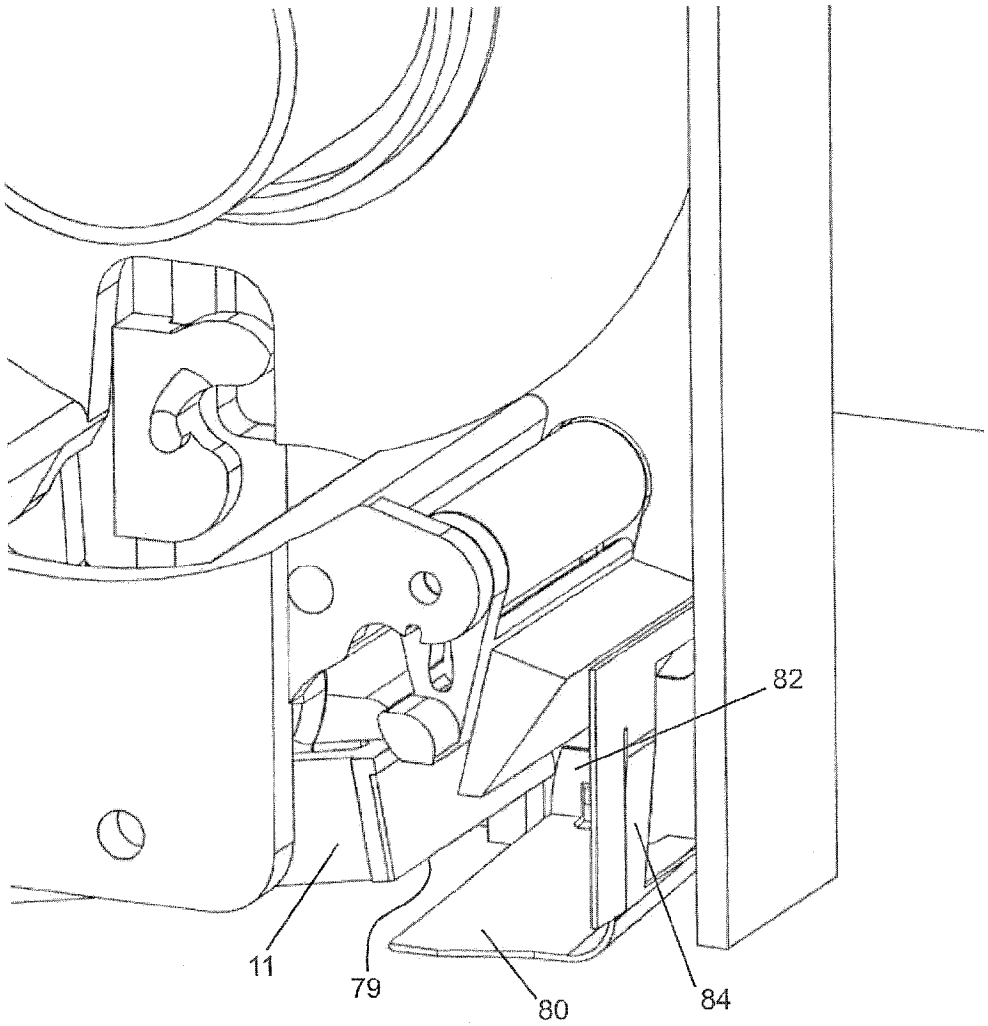
Figure 89:
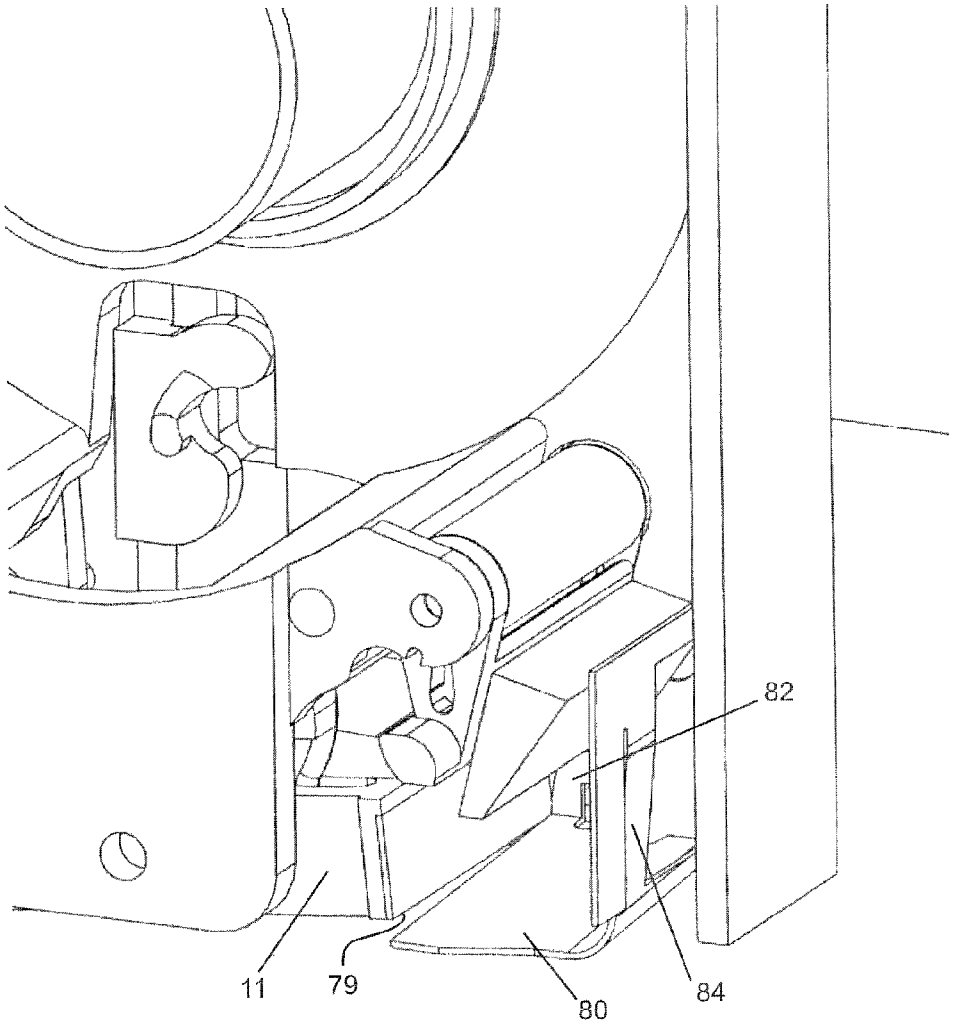
Figure 90:
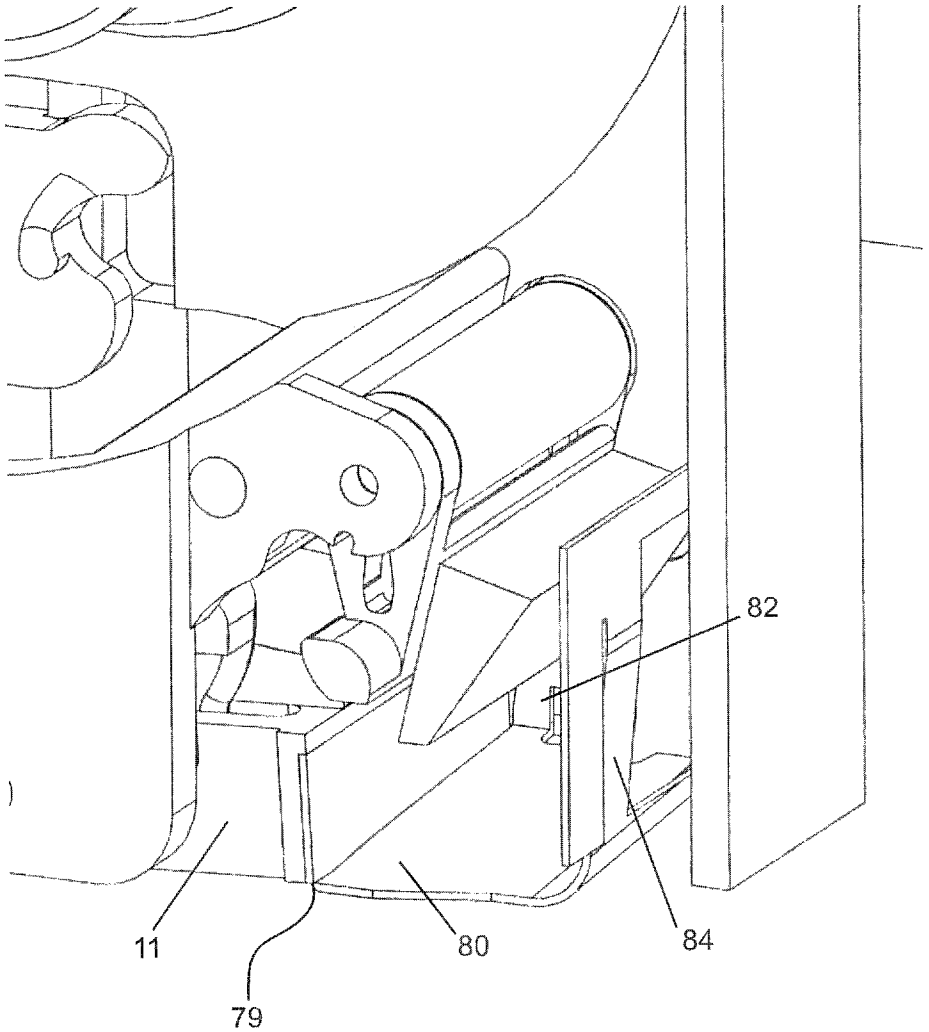

FIGS. 88, 89 and 90 show the adhesive tape stamp of FIGS. 48 to 57, however, with a severing device 12, which has been modified from that of FIGS. 79 to 87. The severing device 12 has a horizontally aligned blade 80, which is pre-tensioned by a pressure-exerting spring mechanism 84 in the direction of the stamp plate 11.

In FIG. 89, the stamp plate 11 is guided along the guiding element 82 up to the start of the blade 80 and the shearing of the adhesive tape 19 commences. There is a distance between the end of the blade 80 and the cutting edge 79.

Figure 85:
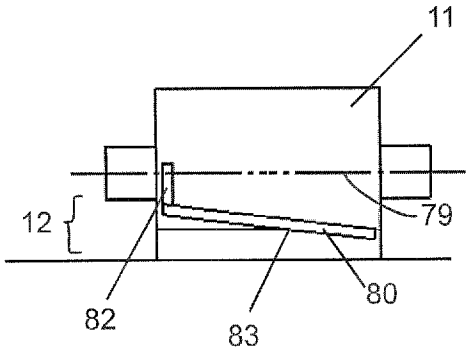

FIG. 90 finally shows the severing device 12 in the position corresponding to that of FIGS. 85 to 87. It can be seen that the adhesive tape now has been divided at the end of the blade 80.

Due to the arrangement of the cutting edge 79 and the blade 80, the shearing edges, as a result of their geometry, exist only at one point. Preferably, the start-up incline is integrally molded to the blade 80 and ensures accurate assignment and contact of the cutting partners at the start of the shearing or cutting process. The elastic support over the elastic devices 81 and 84 controls the position and contacting pressure of the elastically suspended blade 80. The shearing edges, that is, the cutting edge 79 and the blade 80, are inclined in two planes to one another; in other words, they are not parallel. In the working axis, that is, in plan view, the cutting partners, that is, the cutting edge 79 and the blade 80, overlap and intersect.

LIST OF REFERENCE NUMERALS

1 Adhesive Tape Stamp
2 Resting Part of the Housing
3 Actuating Part of the Housing
4 Stamp Direction, Arrow
5*a,b* Projections
6 Spring Device
7 Support
8 Fastening Foot
9 Endless Adhesive Tape Roll, Adhesive Roll
10*a,b* Clamps
10*c,d* Clamps
11 Stamp Plate
12 Severing Device
13 Blade
14 Spring Blade
15 Latch
16 Release Mechanism
17 Actuation Wedge
18 Opening
19 Adhesive Tape
20 Stamp Surface
21 Center Axis
22 Severing Site
23 Adhesive Tape Section
24 Elastic Overmolding
25 Contacting Region
26 Arrow Direction
27 Spring
28 Arrows
29 Clamp Switch
30 Inner Control Surface
31 Outer Control Surface
32 Point of Inflection
33 Locking Nose
34 Covering
34*a,b* Covering with a higher or lower coefficient of friction
35 Center Axis
36 Forks
37*a,b* Guide Bolts
38 Link Guide
39 First Ratchet Lever
40 Ratchet Lever
41 Nose Plate
42*a* Drive Clutch
42*b* Reversing Safeguard
43 Nose Guide
44 Diverting Kidney
45 Circular Disk
46 Ratchet
47 Elongated Holes
48 Planned Severing Site
49 Pins
50 Actual Severing Site
51 Locking Hook
52 Swivel Joint
53,54 Connecting Organ
55 Clamping Levers
56,57 Clamping Organ
58 Groove
59 Supplying Device
60 Clamping Device
61 Clamping Organ
62 Molding
63 Deflection roller
64 Tape Clamping
65 Rectangular Bridge
66 Swiveling Clamping
67 Swiveling Lever
68 Recess
69 Roller Conveying System
70 Deflection roller
71,72 Conveying Roller
73 Toothed Contouring
74 Axis of Rotation
75 Beam
76 Individual Clamp
77
78 Flap
79 Severing Edge
80 Blade
81 Elastic Device
82 Guiding Element
83 Severing Point
84 Spring Device

The invention claimed is:

1. An adhesive tape stamp for applying an adhesive tape section to an object, comprising:

a housing;

an endless adhesive tape roll rotatable mounted in the housing;

stamping plate mounted in the housing for superimposing rotational-linear movement so as to pull an un-severed adhesive tape section from the endless adhesive tape roll and to press a pulled adhesive tape section onto an object;

a clamping device for clamping a free end of the un-severed adhesive tape section on the stamping plate during the superimposed rotational-linear movement of the stamping plate; and a blade for cutting the pulled adhesive tape section from the endless adhesive tape roll, in the housing.

2. The stamp of claim 1, wherein the clamping device is on the stamping plate.

3. The stamp of claim 2, wherein the clamping device comprises two damping partners which jointly the free end of the un-severed adhesive tape section.

4. The stamp of claim 3, wherein the damping partners are hinged and mounted on the stamping plate.

5. The stamp of claim 2, wherein the clamping device is mounted at one end of the stamping plate.

6. The stamp of claim 1, wherein the housing comprises a supporting housing and an actuating housing which is linearly movable in relation to the supporting housing.

7. The stamp of claim 6, wherein the stamping plate is in the actuating housing and the stamping plate moves linearly with the actuating housing to press the pulled adhesive taped section onto the object.

8. An adhesive tape stamp for applying an adhesive tape section to an object, comprising:

a housing comprises a supporting housing and an actuating housing which is linearly movable in relation to the supporting housing, and the actuating housing is enveloped in the supporting housing;

an endless adhesive tape roll rotatable mounted in the housing;

stamping device mounted in the housing for superimposing rotational-linear movement so as to pull an un-severed adhesive tape section from the endless adhesive tape roll and to press a pulled adhesive tape section onto an object;

a clamping device for clamping a free end of the un-severed adhesive tape section on the stamping device during the superimposed rotational-linear movement of the stamping device; and a blade for cutting the pulled adhesive tape section from the endless adhesive tape roll, in the housing.

9. The stamp of claim 6, wherein the housing can be opened for inserting the endless adhesive tape roll and the supporting and actuating housing are mechanically linked.

10. The stamp of claim 6, wherein the stamping plate is rotatably mounted in the actuating housing;

a forced guidance is in the supporting housing; and rotational movement of the stamping plate is superimposed on linear movement of the stamping plate during linear movement of the actuating housing.

11. The stamp of claim 10, wherein the force guidance is a connecting link guide.

12. The stamp of claim 6, wherein the support housing has a control element;

the control element controls the clamping of the damping device.

13. The stamp of claim 6, wherein the stamping plate is rotatable mounted in the actuating housing; and the clamping device comprises damping partners which are mounted on the stamping plate, the clamping partners envelope corner regions of the stamping plate, the clamping partners jointly immobilizing a free end of an un-severed adhesive tape section on the stamping plate and puffing the un-severed adhesive tape section from the endless adhesive tape roli by a rotational motion of the stamping plate.

14. The stamp of claim 1, wherein the endless adhesive tape roll has an adhesive coating on both sides.

* * * * *